US012344985B2

(12) United States Patent
Simsek

(10) Patent No.: US 12,344,985 B2
(45) Date of Patent: Jul. 1, 2025

(54) WASHING MACHINE WATER-FREE ZONES OF THE DRUM

(71) Applicant: Texdreme Arastirma Gelistirme A.S., Istanbul (TR)

(72) Inventor: Tulga Simsek, Istanbul (TR)

(73) Assignee: TEXDREME ARASTIRMA GELISTIRME A.S., Besiktas/Istanbul (TR)

( * ) Notice: Subject to any disclaimer, the term of this patent is extended or adjusted under 35 U.S.C. 154(b) by 594 days.

(21) Appl. No.: 17/555,084

(22) Filed: Dec. 17, 2021

(65) Prior Publication Data

US 2022/0106725 A1 Apr. 7, 2022

Related U.S. Application Data

(63) Continuation of application No. PCT/TR2019/050453, filed on Jun. 18, 2019.

(51) Int. Cl.
*D06F 39/08* (2006.01)
*D06F 37/04* (2006.01)

(52) U.S. Cl.
CPC ..... *D06F 39/085* (2013.01); *D06F 37/04* (2013.01)

(58) Field of Classification Search
None
See application file for complete search history.

(56) References Cited

U.S. PATENT DOCUMENTS 2,332,769 A 10/1943 Zimarik
2,534,267 A 12/1950 Kahn
2,534,268 A 12/1950 Kahn et al.
2,534,269 A 12/1950 Kahn et al.
3,117,926 A 1/1964 Starr et al.
3,214,946 A 11/1965 Starr et al.
5,280,660 A 1/1994 Pellerin et al.
5,318,705 A 6/1994 Pellerin
5,471,692 A 12/1995 Wasinger et al.
(Continued)

FOREIGN PATENT DOCUMENTS

AT 388 758 B 8/1989
CN 203683949 U 7/2014
(Continued)

OTHER PUBLICATIONS

WO 2017206922 translation, Drum Washing Machine and Cleaning Method Therefor, Hao (Year: 2017).*
(Continued)

*Primary Examiner* — Cristi J Tate-Sims
(74) *Attorney, Agent, or Firm* — Crowell & Moring LLP

(57) ABSTRACT

A washing machine for performing wet, dry, physical or chemical treatments on materials includes a front loading or side loading perforated drum. The perforated drum may be mounted respectively by means of a drum shaft at the rear, or by means of drum shafts at both sides horizontally, or having an angle with a horizontal axis to a drum shaft bearing system so as to rotate around a central axis of the drum. The drum may have at least one water-free dry zone on at least one outer surface of the drum, which is not accessed or contacted by the water draining from the drum during all wet treatment application processes carried out by the washing machine with water.

15 Claims, 35 Drawing Sheets

(56) References Cited

U.S. PATENT DOCUMENTS

| | | | | |
|---|---|---|---|---|
| 5,782,111 | A | 7/1998 | Sights et al. | |
| 6,510,715 | B1 | 1/2003 | Simsek | |
| 2002/0029594 | A1 | 3/2002 | Monteiro et al. | |
| 2004/0221474 | A1 | 11/2004 | Slutsky et al. | |
| 2012/0291498 | A1* | 11/2012 | Park | D06F 39/083 68/212 |
| 2016/0348295 | A1 | 12/2016 | Bae et al. | |
| 2018/0223465 | A1 | 8/2018 | Chae et al. | |
| 2019/0264362 | A1 | 8/2019 | Hao et al. | |
| 2021/0156069 | A1 | 5/2021 | Lv et al. | |

FOREIGN PATENT DOCUMENTS

| | | | |
|---|---|---|---|
| CN | 105463765 | B | 10/2017 |
| DE | 3710723 | C1 | 9/1988 |
| DE | 39 35 382 | A1 | 5/1990 |
| DE | 199 61 462 | A1 | 6/2001 |
| EP | 2 460 922 | A1 | 6/2012 |
| EP | 2 671 995 | A1 | 12/2013 |
| EP | 2 229 475 | B1 | 7/2017 |
| EP | 3252207 | A1 | 12/2017 |
| EP | 3 333 301 | A1 | 6/2018 |
| FR | 2 514 793 | A1 | 4/1983 |
| JP | 2013-141508 | A | 7/2013 |
| KR | 10-2013-0114478 | A | 10/2013 |
| KR | 10-2013-0123543 | A | 11/2013 |
| WO | WO 02/04734 | A1 | 1/2002 |
| WO | WO 03/006728 | A1 | 1/2003 |
| WO | WO 2008/125974 | A2 | 10/2008 |
| WO | WO 2009/064262 | A2 | 5/2009 |
| WO | WO 2017/151074 | A1 | 9/2017 |
| WO | WO 2017/206922 | A1 | 12/2017 |
| WO | WO 2018/072625 | A1 | 4/2018 |
| WO | WO 2018/205932 | A1 | 11/2018 |

OTHER PUBLICATIONS

DE19961462 A1 translation, Domestic Laundry Appliance Has Closure Device For Selectively Blocking Washing Liquid Exit Openings In Mantle Surface Of Laundry Drum, Rainer (Year: 2001).*

International Search Report for priority application No. PCT/TR2019/050453 dated Jun. 24, 2020, 6p.

* cited by examiner

A

B

A

B

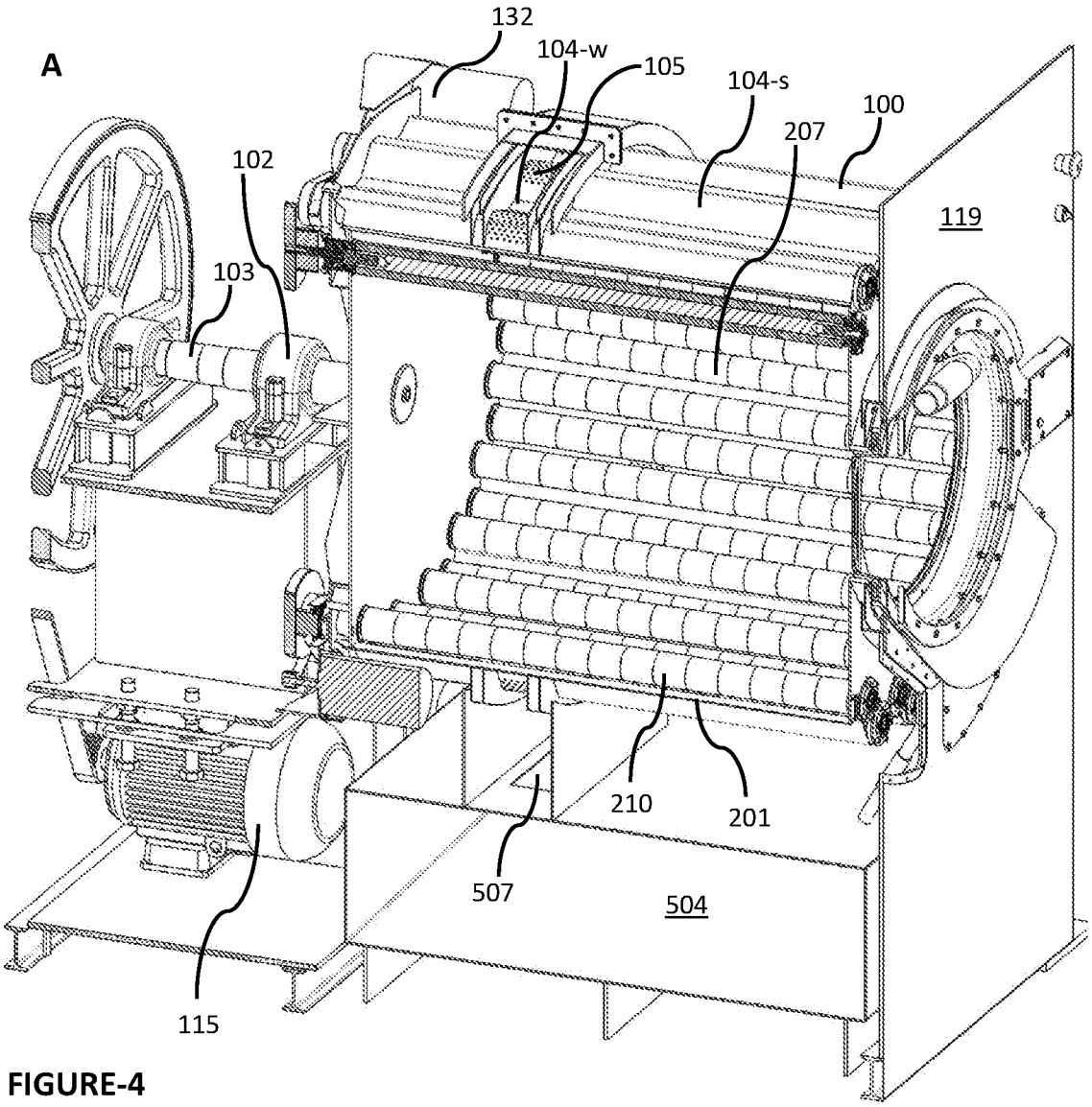
FIGURE-4
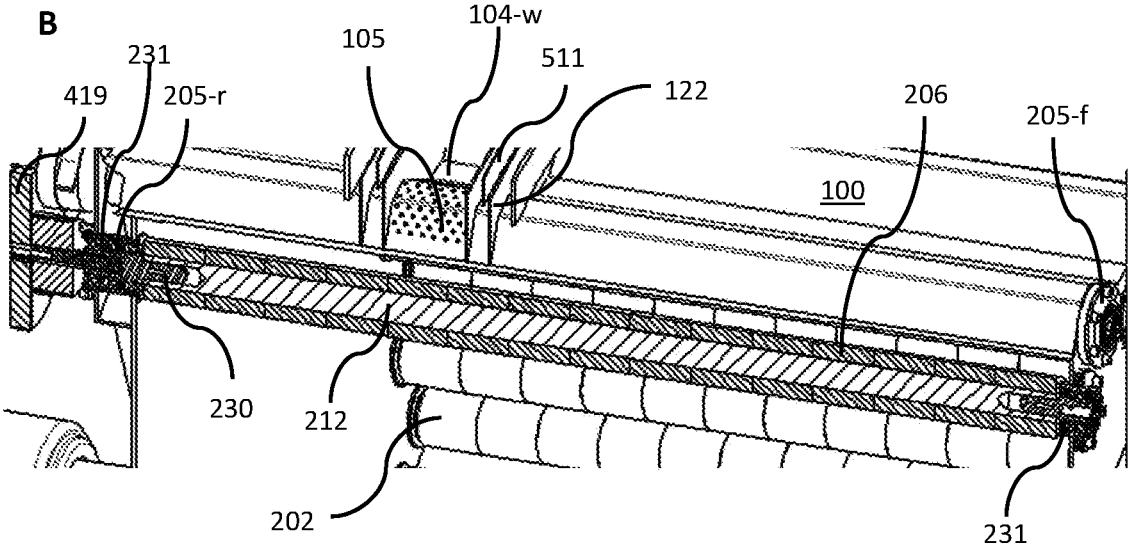

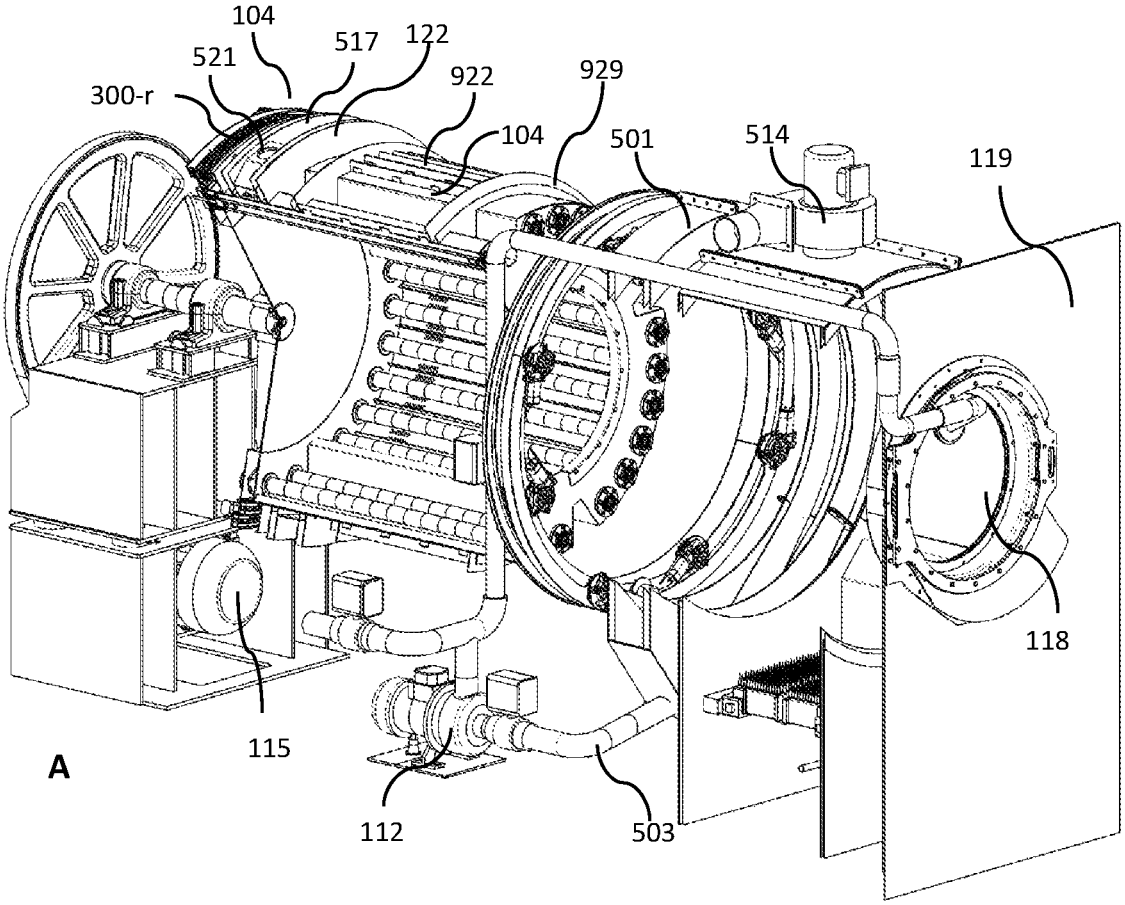
FIGURE-8
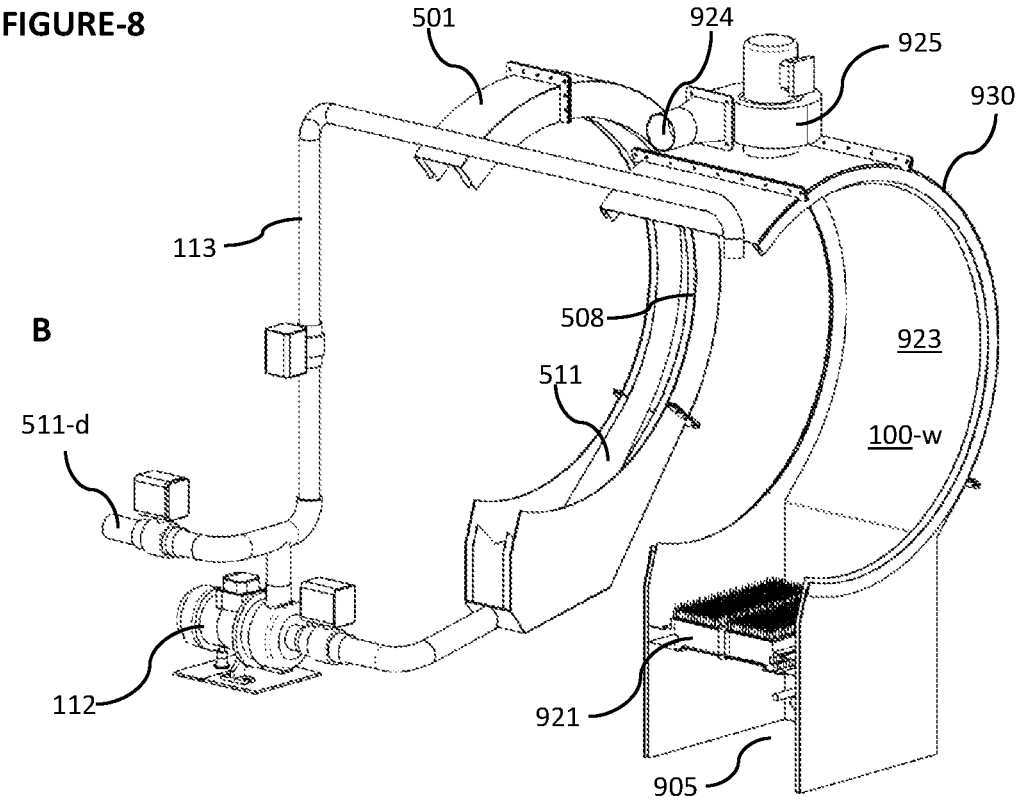

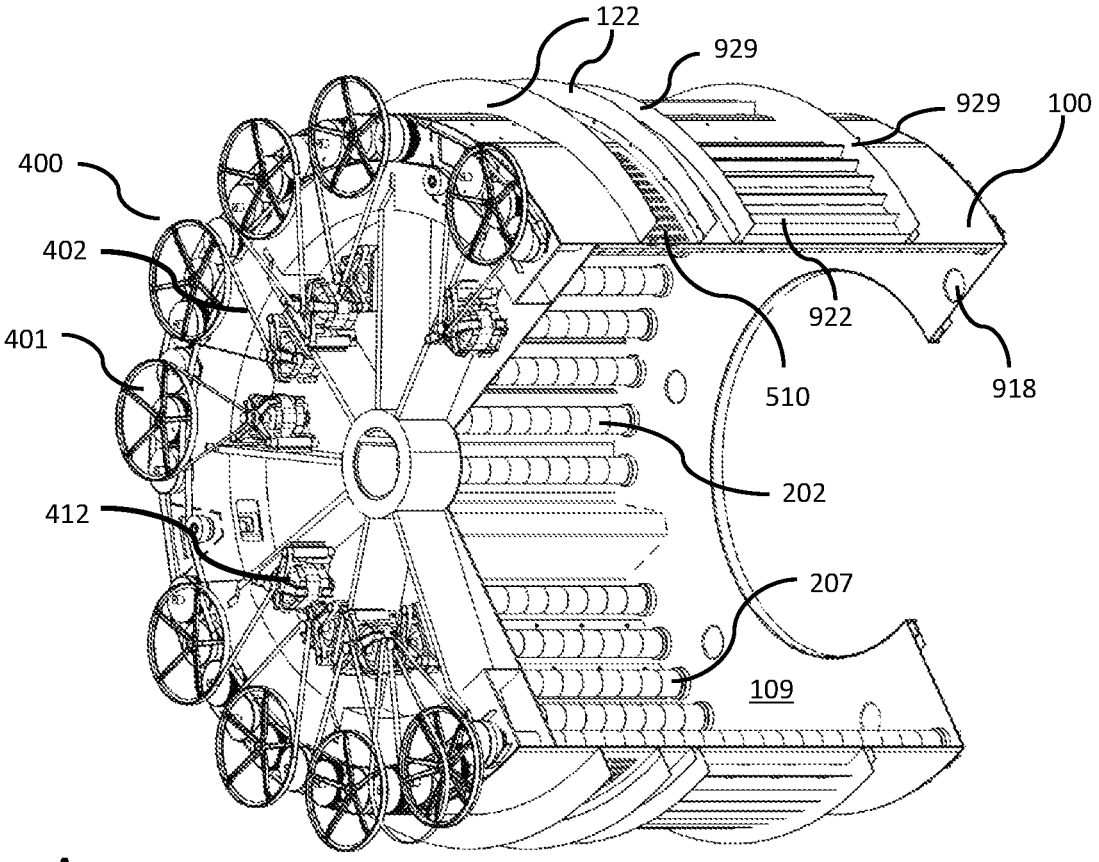
A
FIGURE-20
B
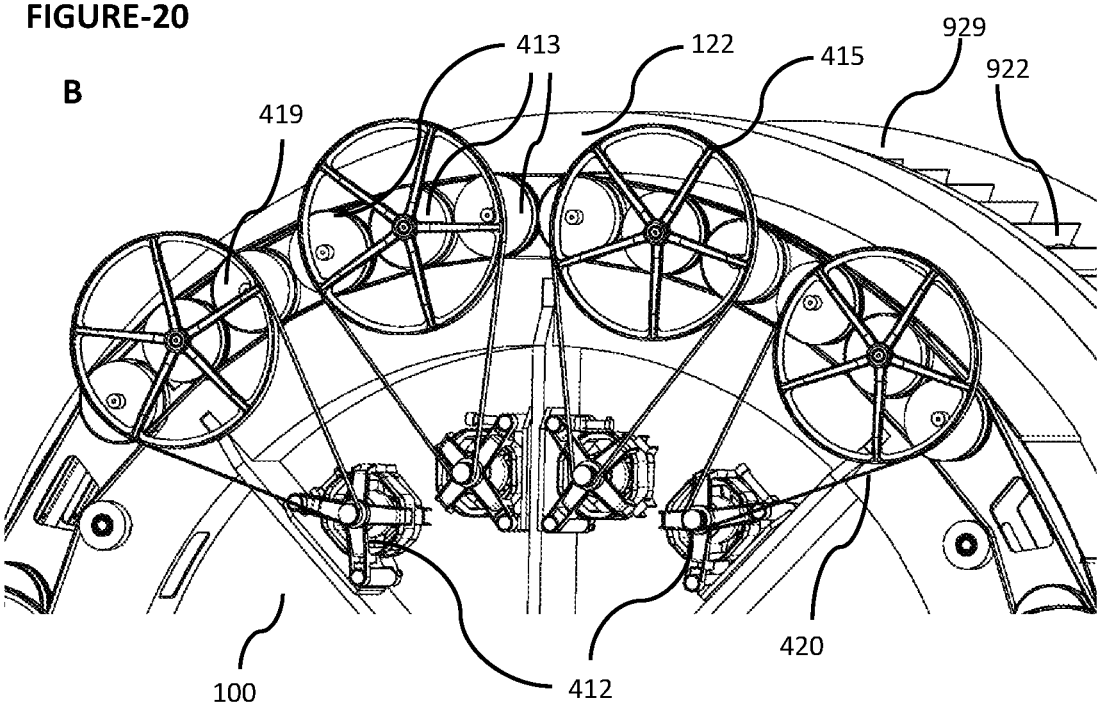

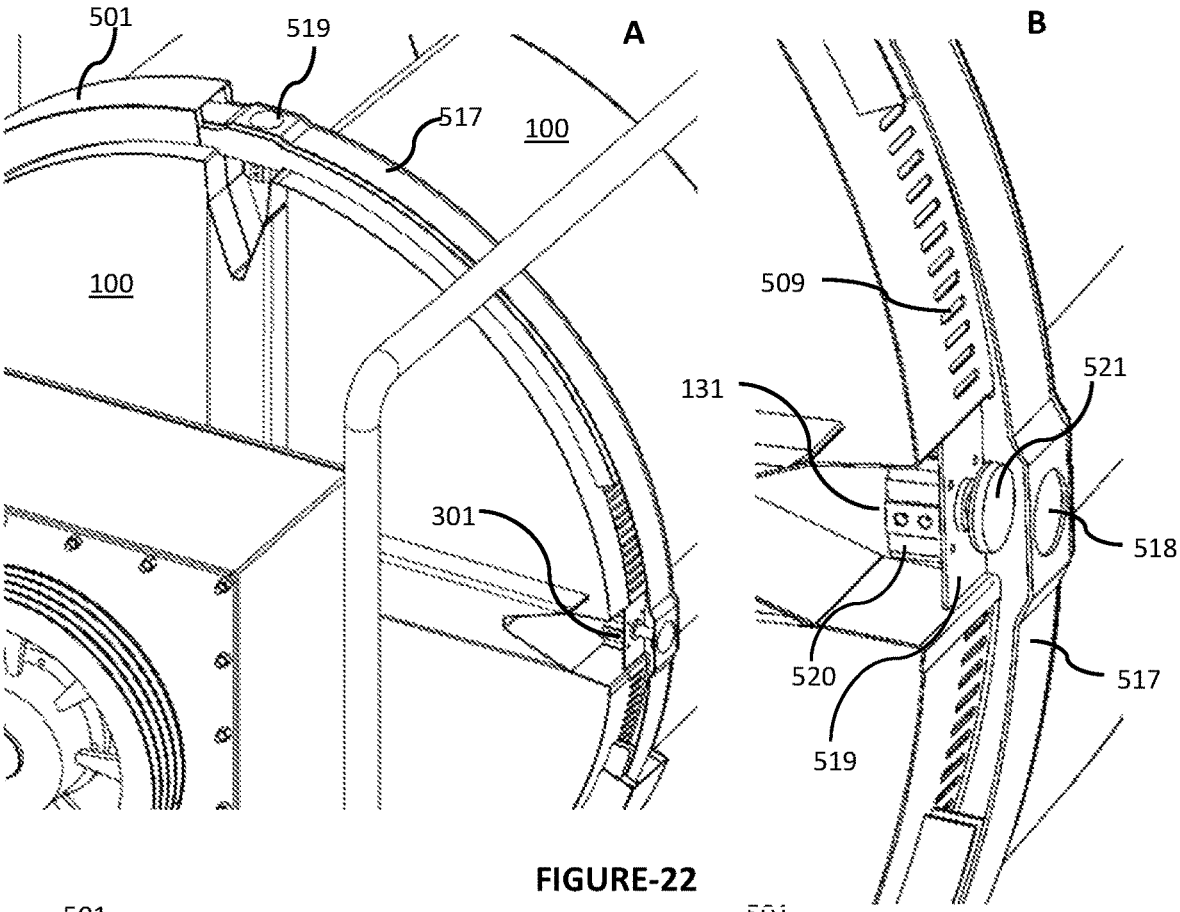
FIGURE-22
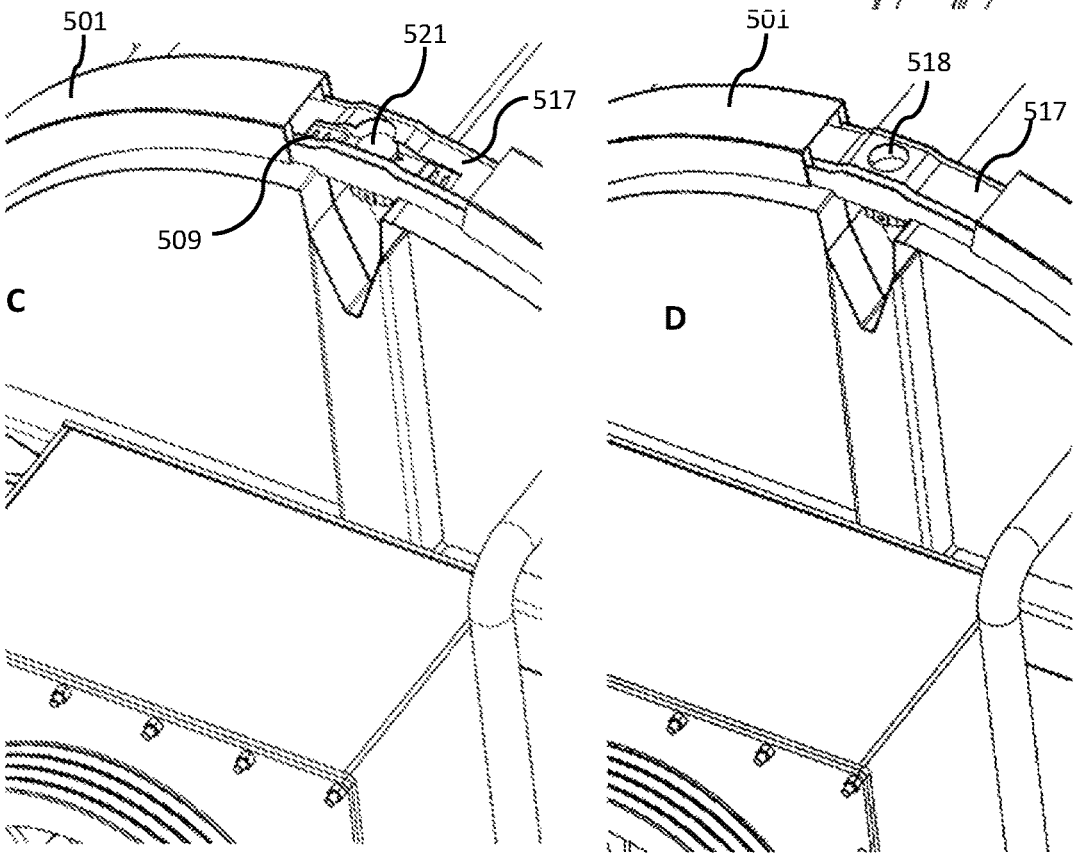

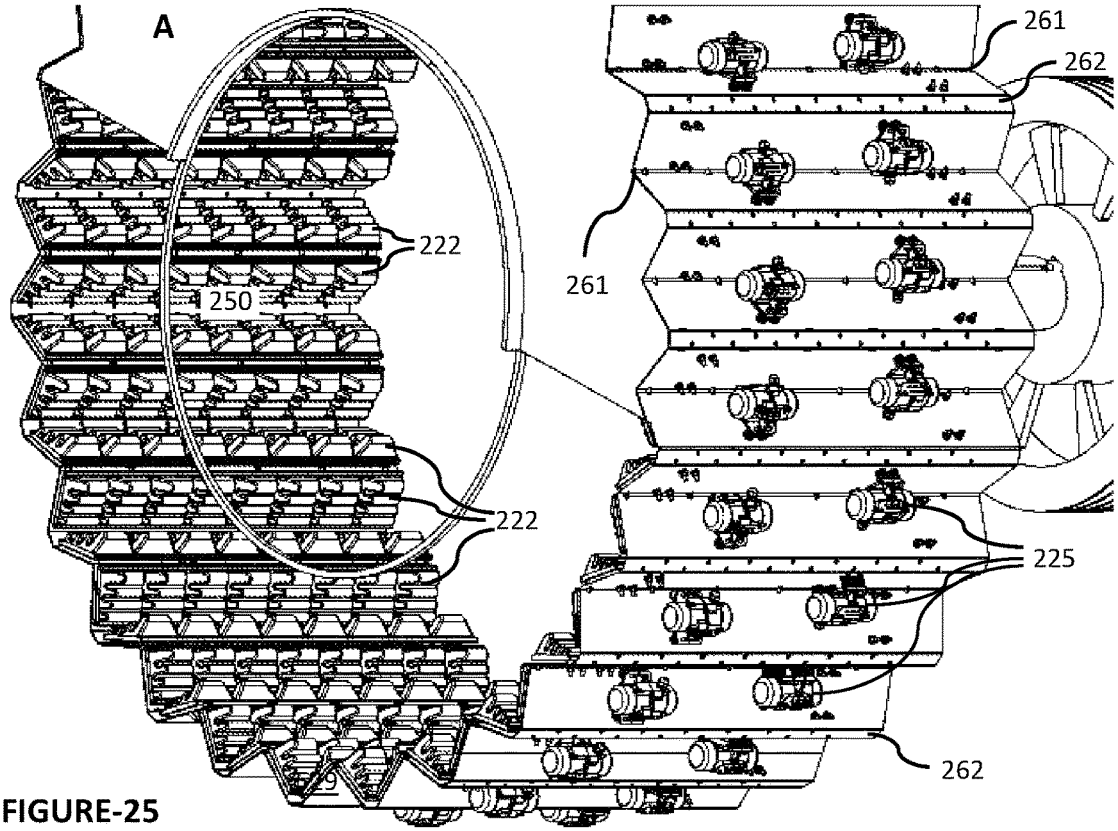
FIGURE-25
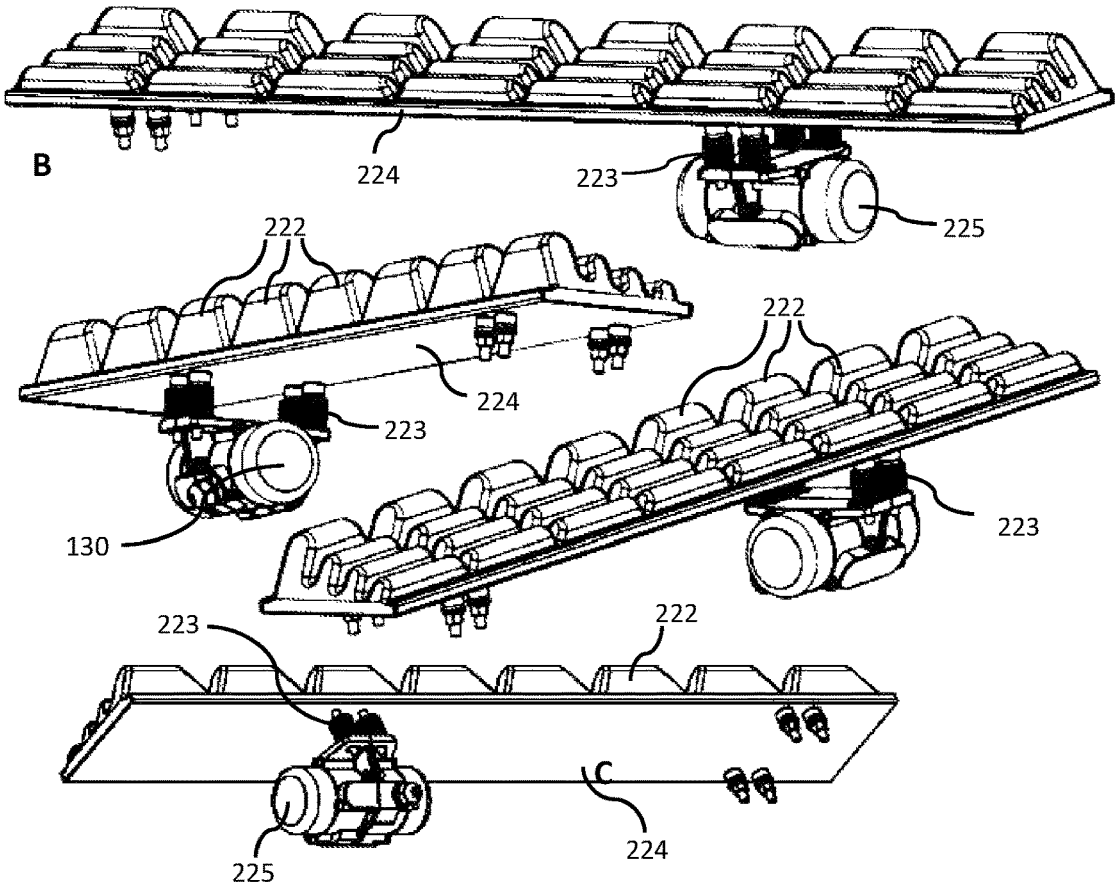

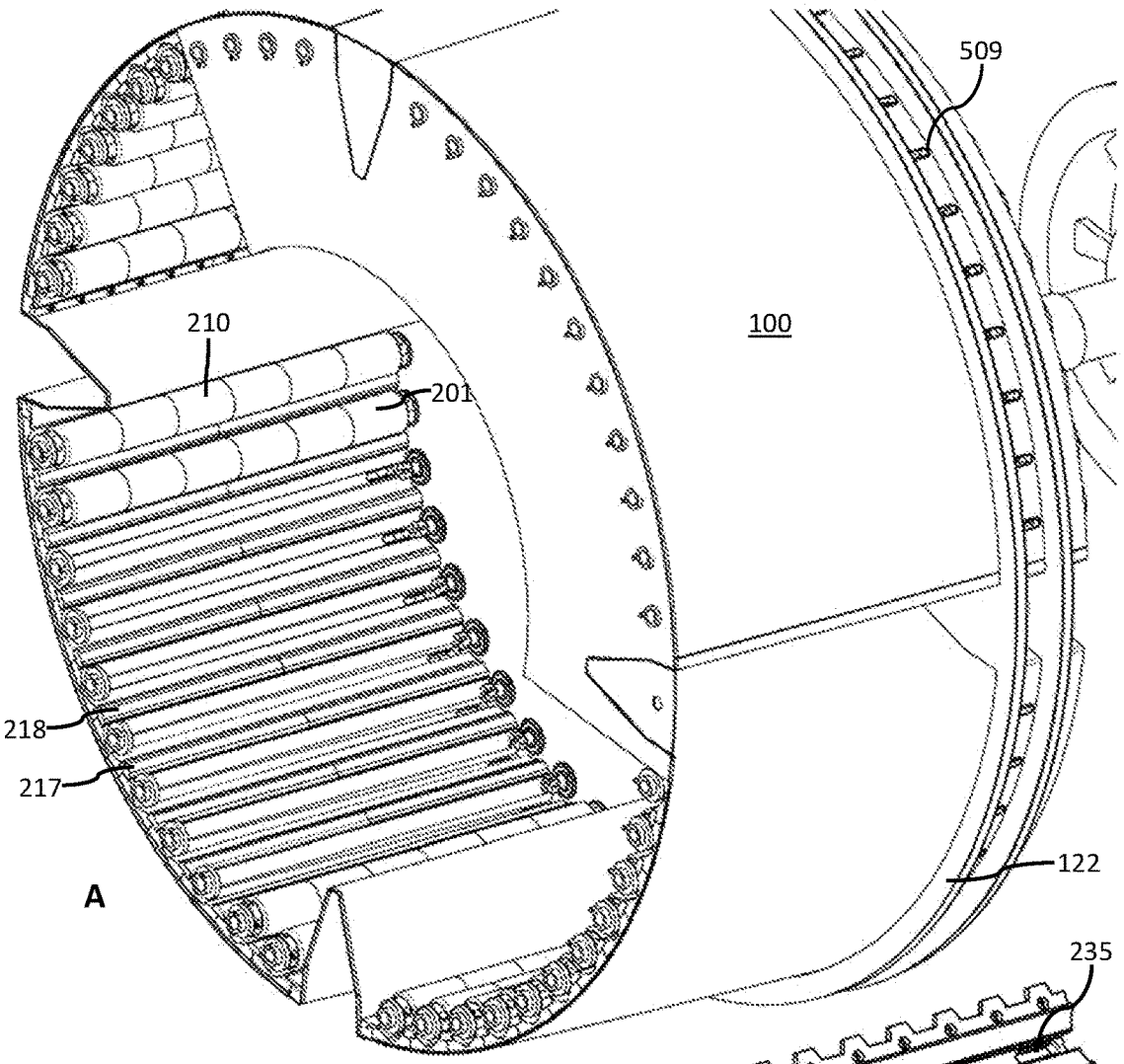
FIGURE-26
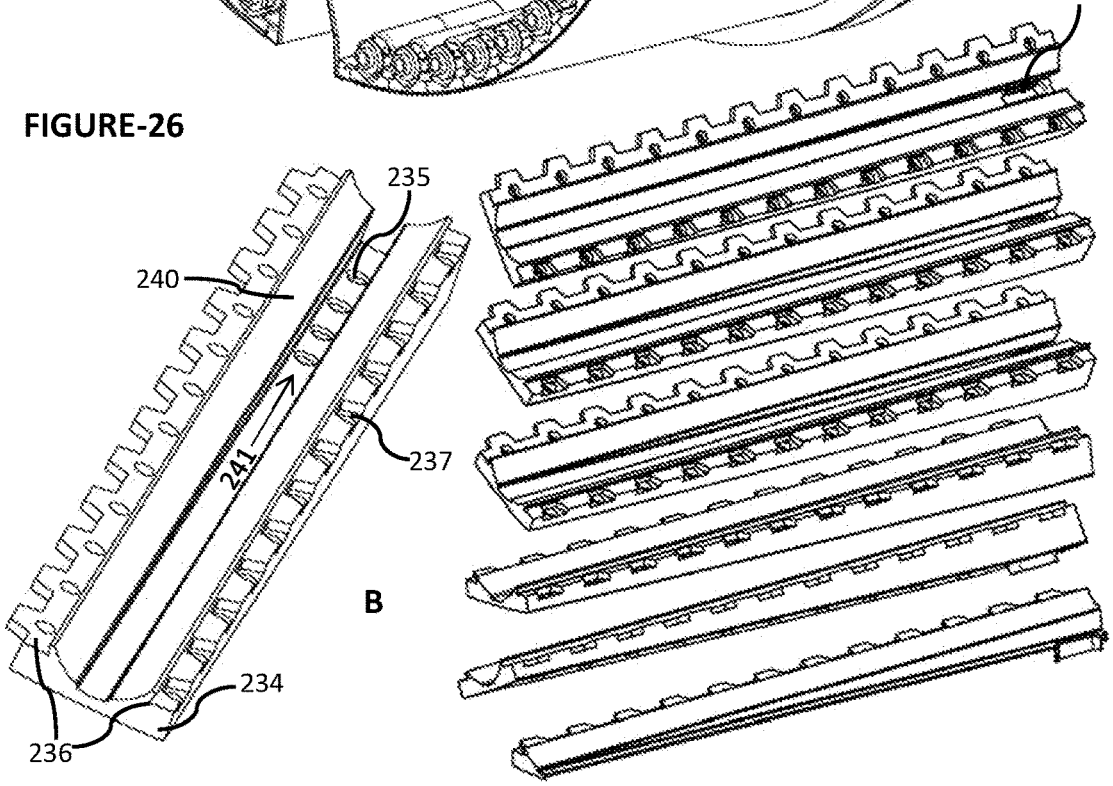

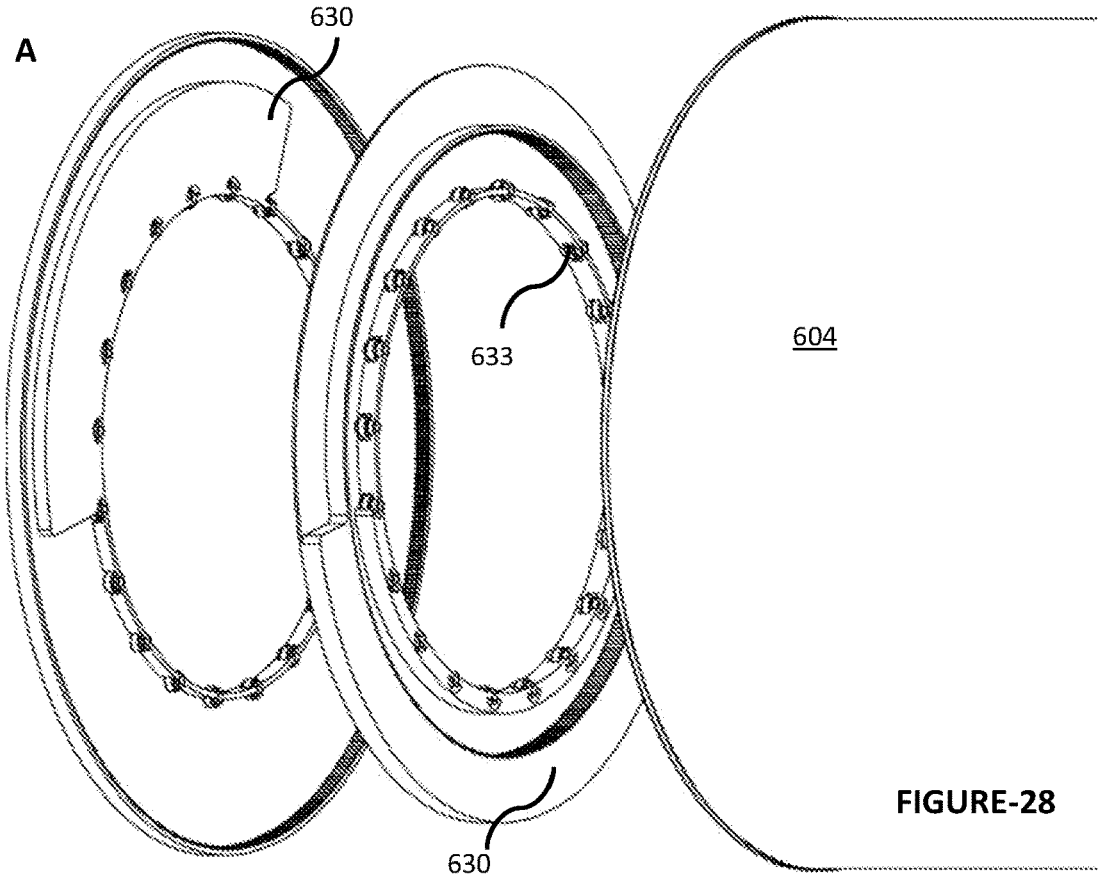
FIGURE-28
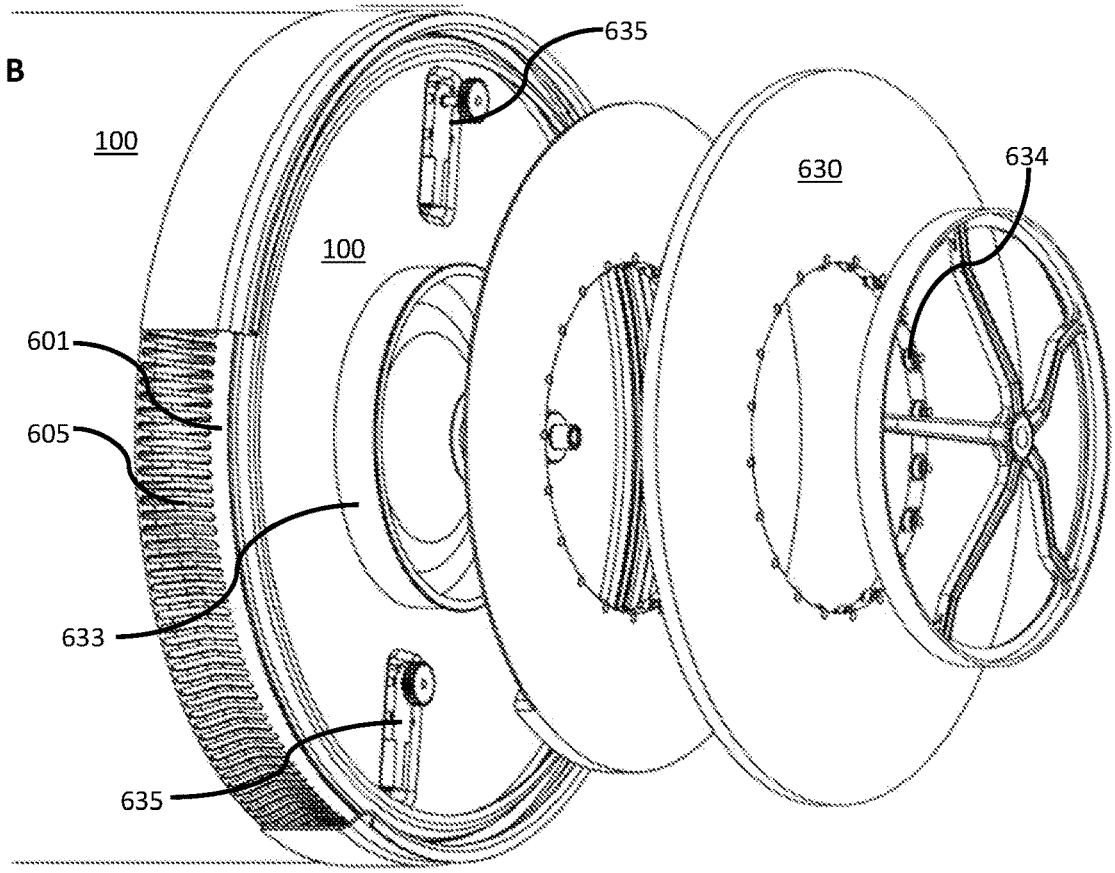

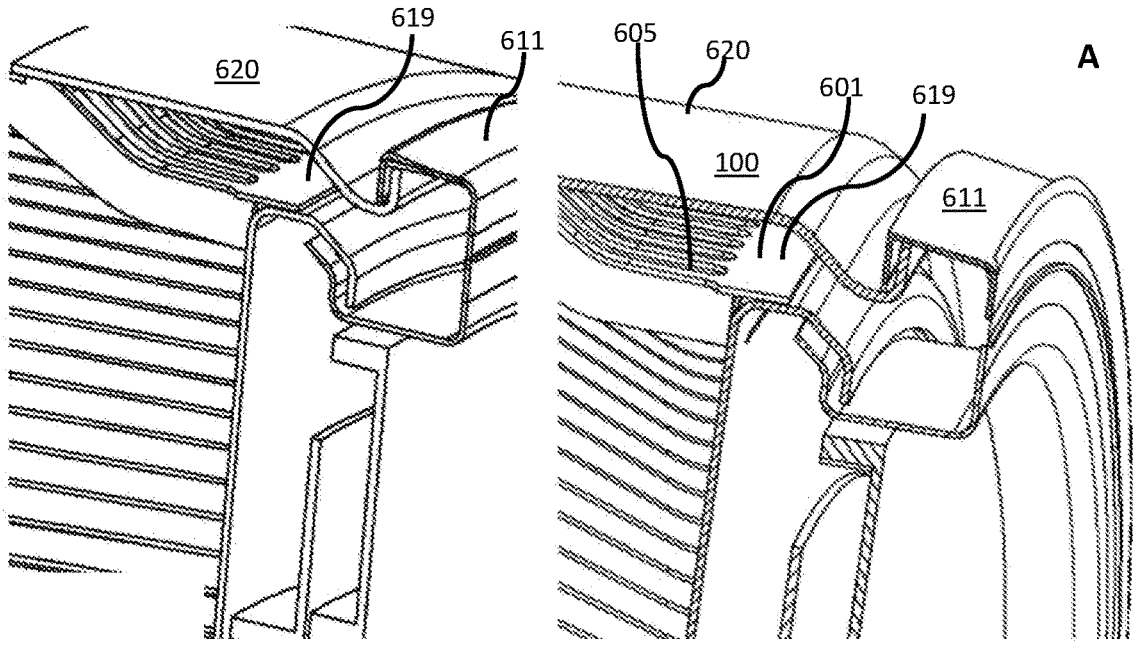
FIGURE-30
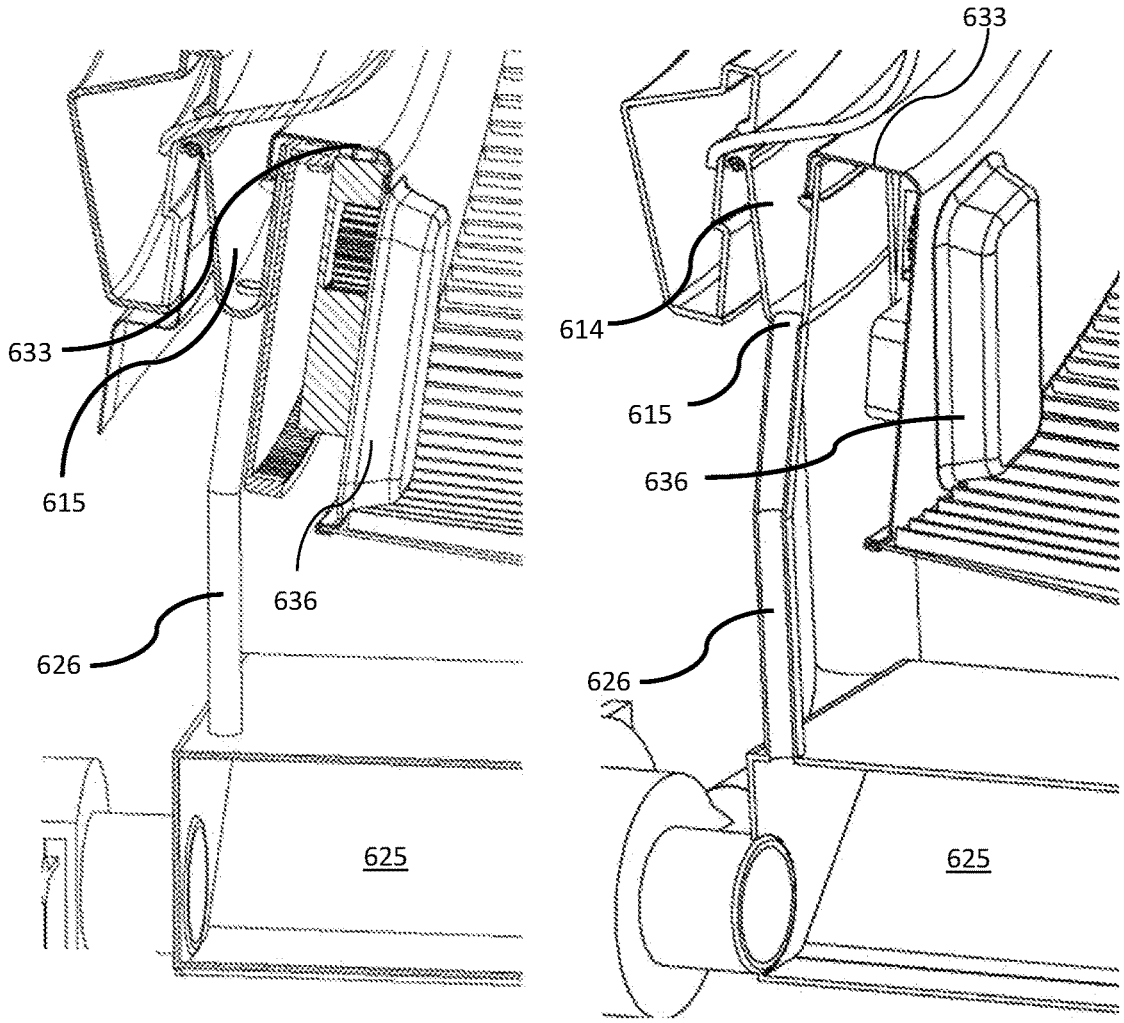
B

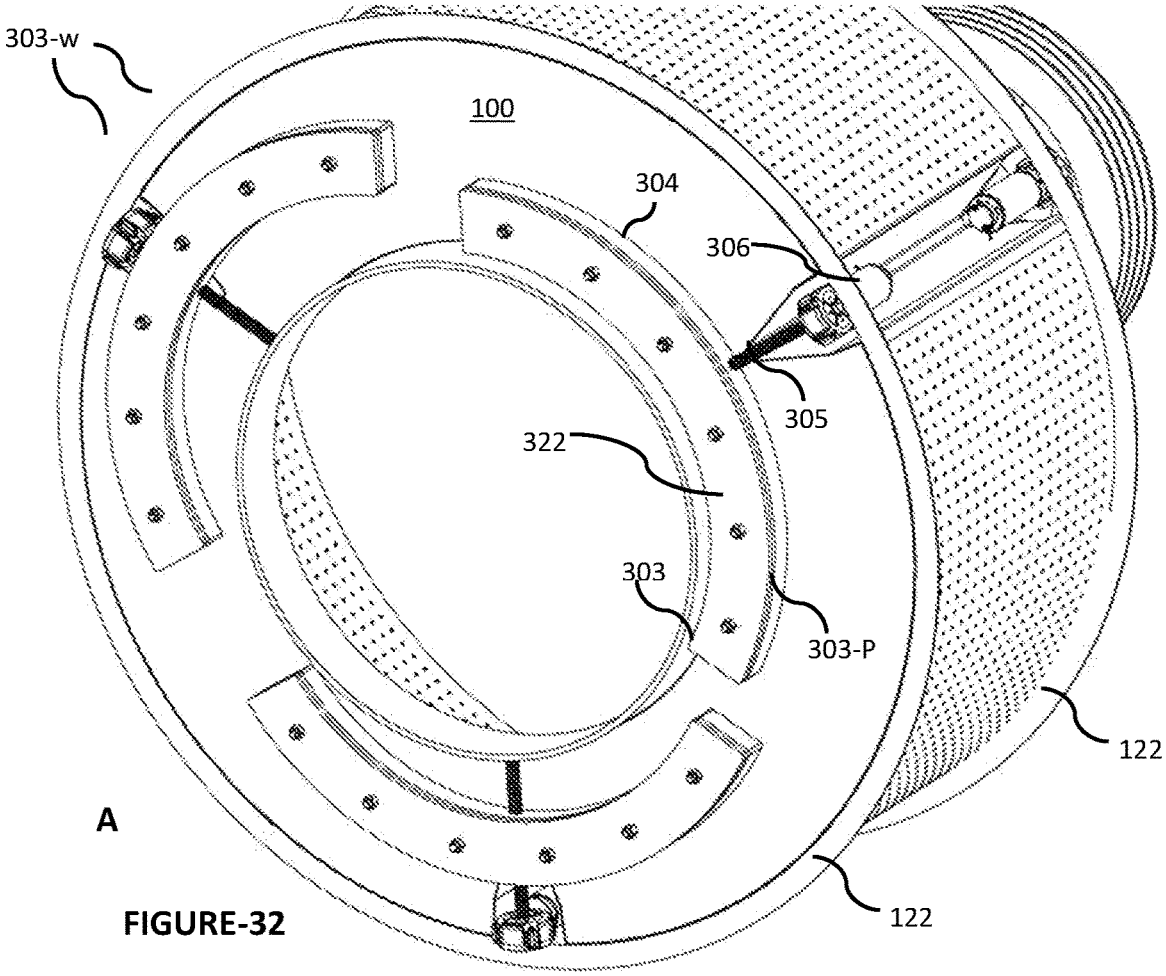
FIGURE-32
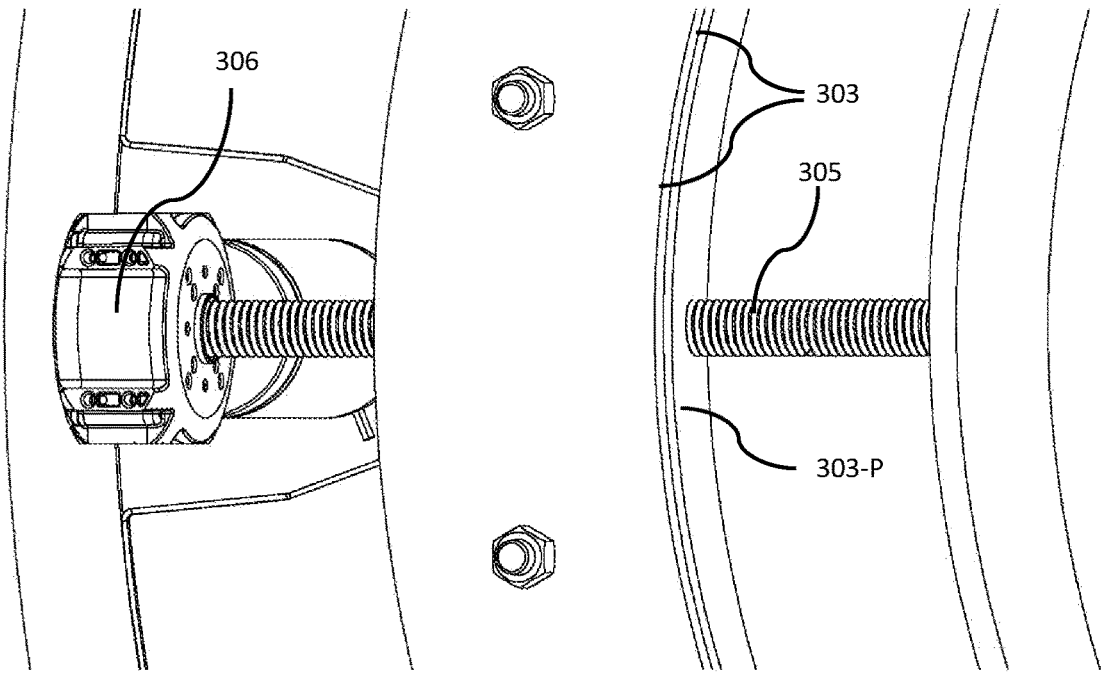

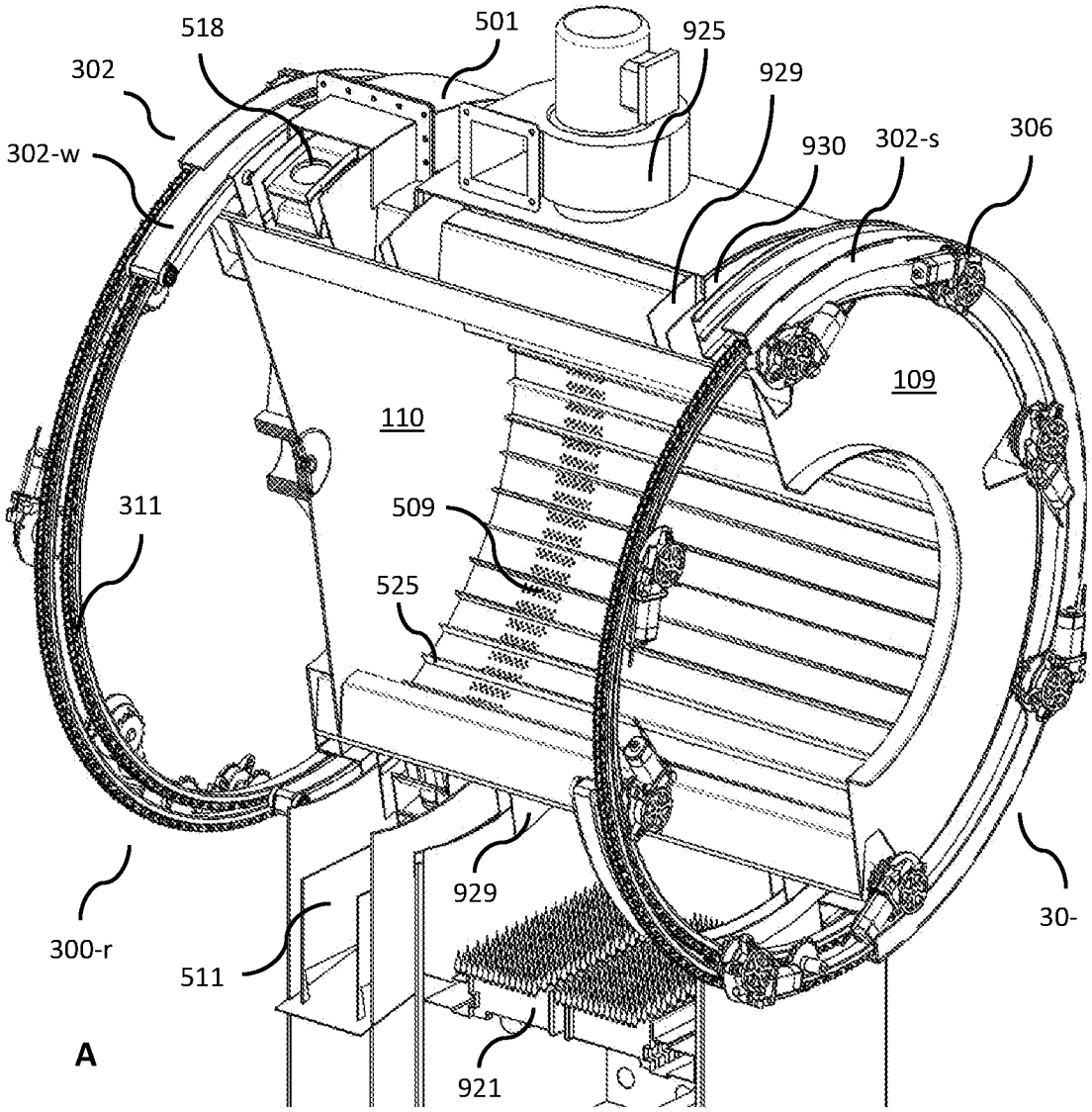
A
FIGURE-37
B
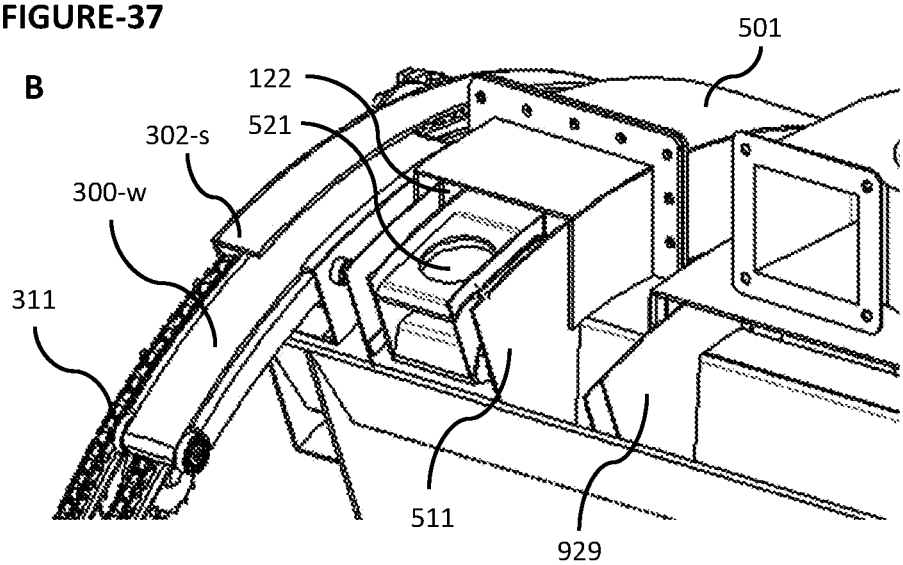

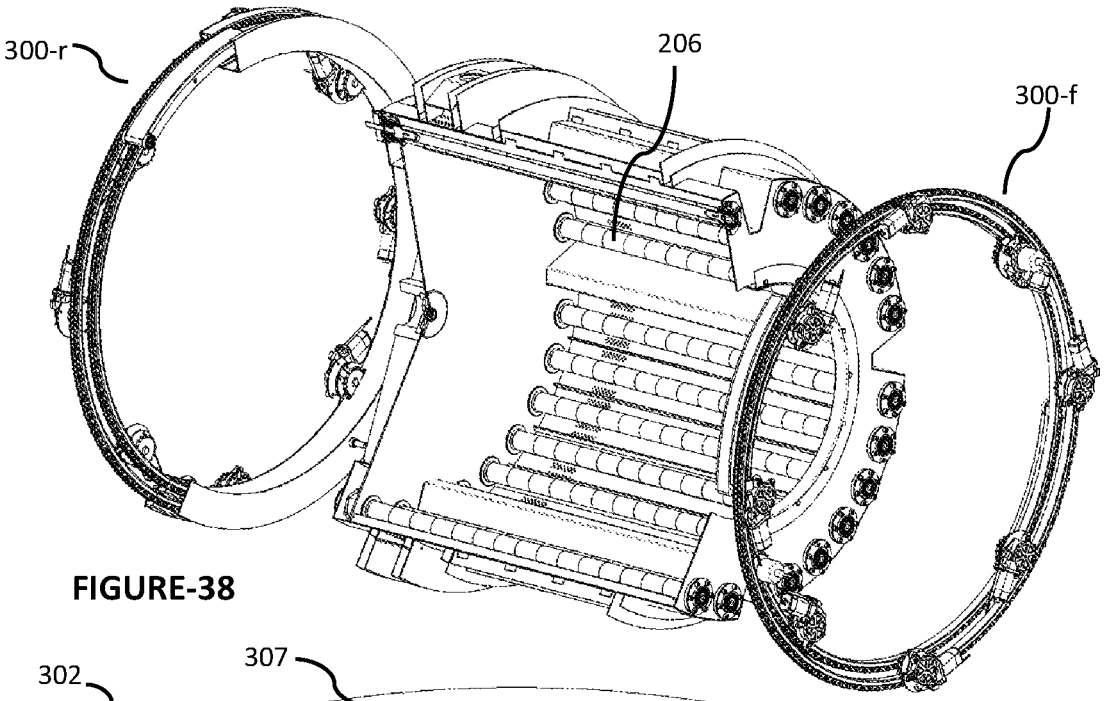
FIGURE-38
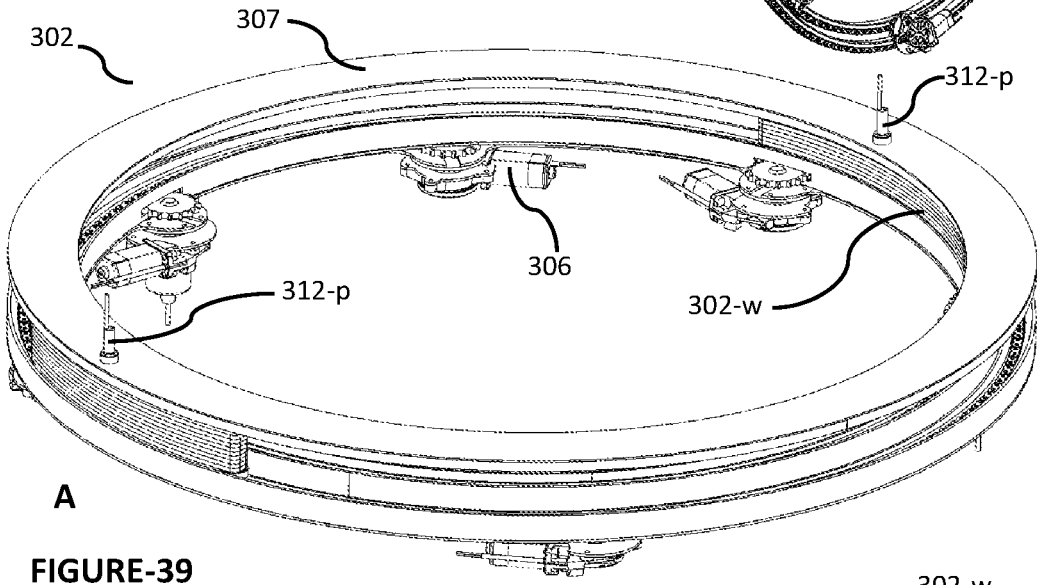
A
FIGURE-39
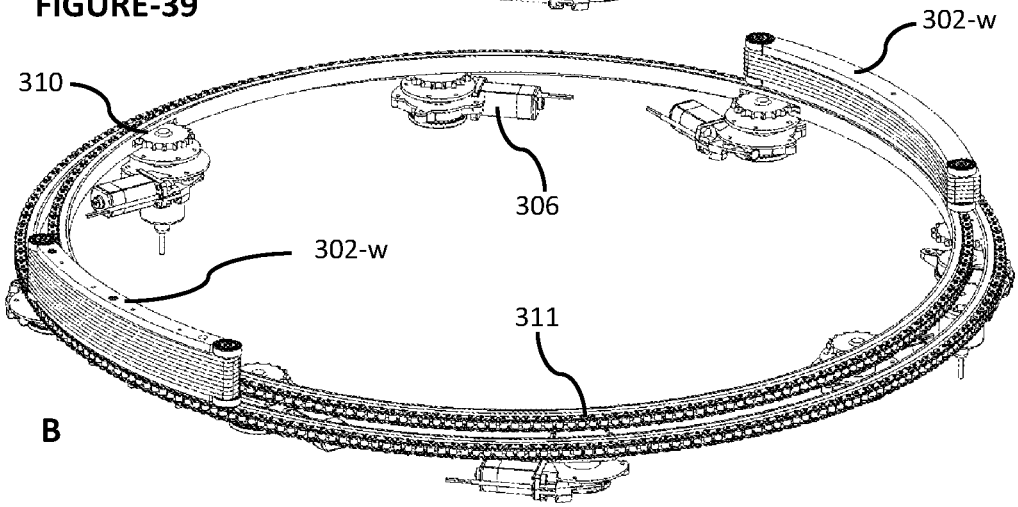
B

900
A
901
901-c
902 - 908

902 - 908
102-k
102
103
B
902
102-b
912
910
911
116-p
C
909
915
903
103
911

WASHING MACHINE WATER-FREE ZONES OF THE DRUM

PRIORITY

This application is a continuation of International Application No. PCT/TR2019/050453, filed on 18 Jun. 2019, the entire contents of which are incorporated herein by reference.

TECHNICAL FIELD

The present washing machine disclosed herein relates to a washing machine for applying wet, dry, physical or chemical treatments onto materials.

BACKGROUND

Washing machines are commonly used in households for washing laundry using water and chemicals such as detergent, bleach and fabric softener. However, washing machines can be used for a variety of purposes and can have different capacities. Machines of this kind having a capacity between 4 and 16 kg are used in households and those having a capacity between 16 and 500 kg are used in industry. These appliances are most widely used in washing, dry cleaning, piece dyeing and stone washing. Even though they are mostly used for wet treatments, they can also be used for dry treatments in special applications such as stoning or sanding. Another appliance that is similar to washing machines from a technical standpoint and that is front-loading and has a perforated drum is a drying machine. There are 3-4 carrying ribs on the perforated cylindrical surface of the drum to ensure that the material moves along with the rotation of the drum. The physical effect is realized by this movement caused by the rotation of the drum.

SUMMARY

A washing machine, as disclosed herein may include a shaft positioned horizontally or having an angle with the horizontal axis, a perforated drum turn around a bearing system, a water chamber outside the drum wherein the water coming out of the drum is collected, moving parts placed inside or outside the drum in order to aid the working of the machine and/or increase the performance of the machine and/or provide economy of resources used by the washing machine such as water, energy, chemicals and time, motors, mechanical, pneumatic, electrical and electronic systems placed inside or outside the drum that are connected to said moving parts for moving said moving parts in a controlled manner and auxiliary equipment required by said systems and wherein energy sources such as electricity, pressurized air and steam is provided on the drum and areas where the contact of devices, instruments and equipment used in said systems placed outside of the drum in fully or partially water-free zones. Said washing machine may comprise a front load drum having shaft and bearings in the rear or a drum having bearings on both sides that can be loaded from the cylindrical surface. In order to not cause confusion, a front loading drum having a bearing on one circular surface and a loading opening on the other circular surface is depicted in the description and the terms front and rear are used to describe these two circular faces of the drum. It should be understood that, in the case of a drum having two shafts and a loading opening on its cylindrical surface, the terms front and rear refer to the two circular surfaces of the drum where the shafts are located.

Stone Washing

One of the treatments requiring physical effect is the "stone washing" treatment that was first used on denim jeans in the 1970s and became more widespread in the 1980s to impart a used and worn appearance to textiles such as denim products. Currently, stone washing utilizing different mechanical or chemical abrasive materials is still widely used for textile products. The first and most commonly used technique in mechanical abrasive treatments is pumice stone. Pumice stone is a natural porous volcanic stone and is light in addition to being abrasive so it is advantageous in wearing treatments because it can float in washing water. However, it gets crumbled in the treatment water and loses its floating ability and causes serious pollution in the environment starting with the waste water system. During the abrasive stoning treatment, mechanical abrasive materials wear down areas they come in contact with such as the drum and the ribs and the chemicals used cause chemical corrosion.

One of the first solutions that was tried in order to replace pumice stone was placing materials having abrasive properties on the surface of the drum. For this purpose, Wadek has proposed in their 1981 application FR2514793 (1983 Apr. 22) the most suitable solution possible which was covering the interior of the drum used for stone washing with abrasive grindstones. Afterwards, similar systems were proposed by Juergen in 1987 (DE3710723, 1988 Sep. 29), Wasinger in 1994 (U.S. Pat. No. 5,471,692, 1995 Dec. 5) and Kingsford in 2001 (WO03006728, 2003 Jan. 23) wherein grindstones are placed in the drum. A different approach was proposed by Sights in 1996 (U.S. Pat. No. 5,782,111, 1998 Jul. 21) wherein the object was to distress textiles using nails placed on the surface of the drum. However, none of the above mentioned suggestions were able to be utilized in practical applications.

When abrasive quality is imparted on the surface of the drum, the abrading effect is only realized when the textiles that come in contact with the abrasive drum surface For this reason, abrasion treatments using abrasive drums surface take much longer than those using pumice stone and cannot be utilized despite all the other advantages. As it is not possible to increase the surface area of the drum, the solution is to increase the friction between the abrasive surface and the textile in the time when they are in contact. To achieve this, a dynamic movement needs to be created inside the drum aside from the rotation of the drum itself that will increase friction. This can be provided by moving parts placed within the drum, providing vibration or rotation. For example, grindstones in the shape of rollers rotating at 200 up to 5000 rpm would be able to increase the speed of abrading imparted onto the textiles by hundreds of times. Use of rollers having abrasive surfaces for abrading applications is known in the state of the art. Rollers having abrasive surfaces are used in many different types of machines such as potato peelers. The problem to be solved is mounting the mechanical and electrical systems to drive the abrasive parts such as rollers placed inside the drum at the desired speeds on the outside of the drum. The present washing machine disclosed herein aims to solve this problem. The first step to solving this problem was described in the system disclosed by Simsek in EP2229475. Application of the system disclosed in EP2229475 makes it possible to drain all the water that is exist in between inner and outer drum. So by application of the EP2229475 outside the inner drum and inside the outer drum is empty.

The textile will move contacting with abrasive surface across the abrasive moving parts during the rotation of the drum and therefore the desired wearing result will be achieved hundreds of times faster.

Moving parts placed within the drum will increase the physical effect provided by laundry washing appliances and therefore increase the quality of the treatment while reducing treatment time and chemical consumption. One of these effects is rubbing the laundry against each other. In 2001, Fraser Monteiro (US2002029594, 2002 Mar. 14) has proposed a system providing the rubbing effect within the drum and this system was also adapted for commercial use. Moving parts rotating, vibrating or oscillating eccentrically on the drum surface will increase the rubbing effect and the quality of washing. A machine having rotating brushes will be able to clean floor/dust mats and other hard material much faster. Similarly, rollers having plastic protrusions will create rubbing effect on the laundry by rotating slowly.

Moving Parts Inside the Drum

In order to have moving parts inside the drum, electrical or pneumatic motors for driving said moving parts should be mounted inside or outside the drum. Considering that the drum is placed in an outer water drum that also name as water tub, it is vital that the mechanical, electrical or pneumatic dynamic systems outside the drum be protected from water damage. It is possible to drive the moving systems inside the drum by motors that placed outside the drum. In order for the drive motors to work in water, they need to be water proof or water contact must be prevented. The best solution is to ensure there is no water in the areas where the motors are located, if possible. To achieve this, the area where water exits the drum should be limited and water should be prevented from entering the areas where the motors are located. It is possible to limit the flowrate of the water exiting the drum and the area where water exits the drum using, for example, the "Poly-Ribs/EP2229475" and "Eco-Drum/EP3252207" systems disclosed by Simsek. The Poly-Rib system (60) describes a protruding drum surface with reduced drum perforation to limit water discharge to circulation pump capacity. In conventional drums, a large portion of the drum holes are clogged by the laundry during draining and spin extraction. Therefore, although there are multiple holes in the drum, the water discharge is irregular. The holes must be kept open at all times to ensure regular, almost constant flow and continuous water discharge from the drum even though the amount of holes is much less than that of conventional drums. Poly-Rib system (60) ensures that the water outlet from the drum is continuous and limited, while the Eco-Drum system (61) pump that limited water from the outer drum back to the inner drum with a proper flow rate capacity pump. Eco-Drum system (61) describes a pumping system to pump draining water from the tub to the drum that have higher pumping capacity than draining water from inner drum to outer drum. The common purpose of the two systems is to prevent the presence of water in the outer drum. So these two systems together make it possible to collect all the water in the machine in the drum and evacuate all the water out of the outer drum. The evacuation of the outer drum allowed a significant amount of water savings in the washing machines. If there is no water in the outer drum, it is appropriate to ask why still an outer drum is needed. Together with this question and the systems described in EP2229475, has enabled many applications to be opened in a new era in washing machines. With the washing machine disclosed herein in subject, if we do not need an outer drum to cover the inner drum completely, it will be possible to take out most of the outer surface of the drum from the outer drum. Therefore it is possible to prevent the drum outer surface (104-*s*) from being in water. Thanks for these two systems make it possible to have dry outer surface areas of the inner drum to apply water sensitive mechanical, electrical or pneumatic appliances.

Balance

Moving parts can be moved using a motor system (400) placed outside of the drum. Possibility to have motor systems (400) placed on the drum outer surface (104-*s*) give many different mechanical applications on the washing machines. These moving parts can also eliminate the imbalance caused by the uneven distribution of the laundry within the drum during the spin cycle and the resulting vibration of the machine. As is known, front-loaded horizontal washing machines providing a spin cycle have a balance system that can be summed up by two principles. The most commonly used balance system utilizes spherical marbles that are free to move within a circular tube or channel placed at the same rotation axis of the drum, wherein these spherical shape weights can be displaced to provide a counterweight to the imbalance. A system comprising two weights rotating freely around the bearing at the rotation axis of the drum may be included in this system. Many application options are suggested for this system and some of these have been applied to the front, the rear or the front and the rear of the drum are together. Another balancing system known and used in the art is the addition of external weights to provide a counterweight. Obtaining a counterweight by adding a weight was first proposed by Kahn in 1945 (U.S. Pat. No. 2,534,267, 1950 Dec. 19) and then developed further in 1946 and 1948 (U.S. Pat. Nos. 2,534,268 and 2,534,269). This technique was further developed by Starr in 1958 (U.S. Pat. No. 3,117,926, 1964 Jan. 14 and U.S. Pat. No. 3,214,946, 1965 Nov. 2) and by Pellerin in 1992 (U.S. Pat. No. 5,280,660, 1994 Jan. 25). In 1998, the inventor of the present washing machine disclosed herein, Simsek, developed a water-balance system that presents an improvement over systems providing balance by adding water to three carrier ribs in the drum by adding water to water compartments placed in the front and the rear of the drum (U.S. Pat. No. 6,510,715, 2003 Jan. 28). The proposed system provides a much more sensitive balance system because the imbalance is balanced from the front and the rear. The solution proposed by the present washing machine disclosed herein provides a system where the balance weights are displaced, which is completely different from the aforementioned two systems. The balance system (300) proposed by the washing machine disclosed herein operates under the principle of counterweights driven by motors to be displaced in a controlled manner to balance the loads in the front and rear of the drum to restore the balance. As the displacement of the weights happens very fast in this balancing system, the spinning process will be much faster compared to water-based balance systems and much more sensitive compared to ball balance systems, the balance can be maintained at high sensitivity throughout the spin cycle, the volume required to put aside for the balance system (300) will be much smaller and there will be no need for water consumption. Water free outer drum surface provide not only mechanical and motor system (400) application but also give possibilities apply sensors and control systems.

The washing machine disclosed herein proposes machines that are generally described as perforated-drum washing machines. The machines are designed to provide mechanical and/or chemical treatments in wet, and in some situations dry, conditions to the materials loaded into the drum. Generally, the physical effect provided by a drum rotating in a water tank to materials inside the drum such as mixing, dropping, rotating and rubbing aid in increasing the effect of the chemicals added to the water. Said machines can be produced for many purposes, starting from "small scale" machines having a drum volume of 40-100 L, for household use and can go all the way up to industrial scale machines having drum volumes up to 5000 L. While they are generally referred to as washing machines, they are used as dry cleaning machines in applications where chemical solutions are used instead of water, as washing machines in household and industrial applications and can also be used to wash materials other than laundry in textile applications, mechanical applications such as stone washing to abrade of textiles and chemical applications such as dyeing. In washing machines that are defined as laundry machines, the perforated drum is placed in a water tank that is fully sealed against water leakage from the door or around the drum shaft. While the drum is defined to be fully sealed, it is important to note that there are inlets to and outlets from the tank such as water and solid or liquid chemicals, steam inlets to the drum, a discharge system for waste water, an overflow system in case the water level in the drum rises excessively, excess steam and water vapor outlets.

The present washing machine disclosed herein comprises systems that are suitable for adapting to any type of washing machine. Therefore, the phrase "washing machine" indicates all machines providing wet, dry, chemical or mechanical treatments in a perforated drum. However, the description and figures depict an example of a medium-scale industrial machine in order to exemplify the applications. Unless specified otherwise, the figures depict a drum having a diameter of approximately 1600 mm and a depth of approximately 600 mm. Based on these measurements, a cylindrical drum would have a volume of 1200 L. For example depicting small scale machines for household use, the drum has a diameter of approximately 575 mm and a depth of approximately 4500 mm, having a gross volume of 110 L, and net volume of 100 L, the difference between gross and net volumes is a feature of the washing machine disclosed herein and will be explained below.

The aim of the washing machine disclosed herein is to increase the physical effect provided by the rotation of the drum and decrease the physical effect caused by the uneven weight distribution during the spin cycle. For this purpose, moving parts that are moving inside and outside the drum have been added to the drum. Moving parts inside the drum increase the physical effect required by the treatment while the moving parts outside the drum prevent the oscillations and vibrations caused by the unbalanced weight distribution during the spin cycle. In this manner, the perforated drum of the washing machine is no longer just a cylindrically shaped canister, but gains the characteristics of a functional machine by itself.

The addition of dynamic parts inside and outside the drum also requires drive sources and drive transfer means (mechanical systems) to be included. It is clear that electrical and electronic systems are required to drive and control the mechanical systems. It can be deduced that, even though it is normally possible for said systems to apply on conventional washing machines to operate between the inner and outer drum, i.e., in water, applications of this kind have associated problems. To overcome these problems, it must be ensured that areas outside the drum where said systems are situated are as water-free zones (100) as possible.

While the presence of electrical, electronic and pneumatic systems required for mechanical systems are not a mechanical requirement but the examples of the washing machine disclosed herein will also allow application of electrical or electronic systems together with mechanical dynamic systems to drive and control.

Moving parts inside the drum create physical effects in addition to those created by the rotation of the drum and are used to increase the physical and chemical performance inside the drum. Said moving parts are placed inside the drum, which increase the desired physical effects on the materials placed within for treatments such as washing, dyeing, stoning, polishing and brushing.

All these are possible by applying Poly-Ribs/protrusions/sheet bar/grate bars (525) inside of the cylindrical drum inner surface (104-*n*), which are also referred to herein as channel members extending radially toward the axis of rotation of the drum. Protrusions on the perforated surface hold washing materials away from drum surface to keep holes open and also create water channels to flow water from any area of the drum till to perforated area at the end of the washing and during the extraction. This means from now on no more need to spread the perforations on the whole drum surface for draining efficiency. So even if the holes were only within a certain area of the drum surface, the water in other regions was able to flow through the channels formed under the protrusions and reach the holes quickly. This allows the drum holes to be located in a limited area on the drum surface.

If the washing machine has an extraction feature, the addition of moving parts outside the drum provides a new solution to the problem of oscillations and vibrations caused by unbalanced load distribution during the spinning extraction cycle. In this method, moving parts can be moved in such a way to provide a counter weight against to the unbalanced load distributed in the drum. In this manner, the loss of balance during the spin cycle can be compensated consistently. The use of a known, sensitive system that is in use for providing balance to the drum during the spin cycle allows freedom from the springs attaching the drum to the chassis, the suspension systems and the weights attached to the drum chassis that were previously deemed necessary to use.

As electricity connected with the drum, it will become possible to mount all types of electrical and electronic devices, systems and sensors onto the drum. Electrical connection of the drum can be realized by any method known in the art as well as application of the systems of the washing machine as disclosed below. In this manner, sensors directed to getting desired information from the materials undergoing treatment in the drum and control systems for evaluating the measurements and interfering when necessary can be mounted onto the drum. The new system will facilitate access to the external surface of the electricity connected drum, making it easier for service and maintenance.

Supplying electricity and air to the drum makes it possible for all kinds of electrical and pneumatic systems to be mounted onto the drum. Aside from movement systems, devices serving particular purposes, such as valves and pistons will be functionally usable on the drum. In this manner, in the embodiments disclosed herein, it will be possible to cut off draining water from the inner drum to the outer water chamber by a valve. As the water filled into the drum will remain only inside the drum after the valve is closed, the water and chemicals added to the drum are fully used in an efficient manner therein. This means that the point reached in water and chemical savings is the highest possible level.

According to the characteristics of the process in the drum, the water therein also contain added chemicals, insoluble solid particles and water soluble substances transferred to the water from the processed material inside the drum. It is inescapable that dynamic systems inside the water tank come in contact with the water containing chemicals and insoluble solid particles and that their operation be hindered due to the water. Precautions can be taken to ensure that dynamic systems inside the tank can operate without being affected by water and the chemical and physical substances in water. An exemplary application relating to this is a potato peeler having an abrasive roller. However, the main problem that needs to be solved is ensuring the smooth operation of motors, mechanical, pneumatic, electrical and electronic systems and moving parts in said liquid rich with chemicals and solid materials. The present washing machine disclosed herein proposes solutions for preventing contact between the liquid in the drum and the movement system on the drum in a practical and economic manner so that the dynamic system operates smoothly.

If a portion of the water tank can be water-free completely and permanently, it is understood that this part is practically not functioning. For example, if water does not reach up to the drum shaft within the tank, then use of conventional shaft sealing systems, such as sealing rings and felts, between the tank and the drum shaft are not necessary. In other words, if a part of the tank can be cleared of water, it is possible to eliminate said part. Elimination of a part of the tank means that said section of the drum will be taken out of the tank. Commonly, the part of the washing machine called as water tank or outer drum is mainly a part that is filled with water and that contains the inner drum. The water tank carries the water inside the drum. When the drum is not rotating the water levels inside the drum and the tank are equalized. In the proposed system water is not filled up to the level of the drum, therefore it would not be suitable to call this part as water tank. For this reason, a tank not fully surrounding the drum or not filled up to the level of the drum will be referred to as a water chamber (500). The water chamber is a chamber that surrounds only the perforated portion of the drum to collect and flow water away. That means all non-perforated parts of the drum are outside. All non-perforated external surfaces of the drum are free of water, meaning they are dry.

Heating

It is not preferable to add steam directly to the washing water in industrial washing machines (51) during heating. When steam is directly added to water, the amount of steam to be added is dependent on the initial water temperature and the desired water temperature. When steam is mixed with water, it condenses into water, which leads to a change in the amount of water in the drum. This is undesirable, especially for processes where the ratio of chemicals and water is important. Especially for processes such as dyeing where all conditions have to be controlled in industrial parts dyeing machine (53), a change in the amount of water will lead to a lot of issues. Therefore, indirect heating by heat exchangers are used in industrial parts dyeing machines (53) used for these types of processes, even though they are more costly. Another disadvantage of mixing steam directly into water is the danger of foreign materials entering from the steam system and fixtures carrying with steam. Steam fixtures need to be constantly kept clean, otherwise foreign materials entering along with steam may cause problems with the quality of the material being processed. Steam obtained using a steam boiler or steam generator also has an economic disadvantage. The whole boiler with full of steam needs to be heated even when a small amount of steam is needed. This process takes a long time and produces more steam than is needed which causes unnecessary energy consumption that is costly.

Non-perforated external surfaces of the drum on the outside of water chambers (500) allow the drum to be directly heated by furnace. The drum is in direct contact with the washing water and the materials being treated therein. Therefore, when the drum is heated from the outside, the washing water will be heated indirectly. This method has many advantageous consequences. This technique is one of the well-known heating methods since humans started to control and use fire. We still cook and heat meals in the saucepan on the fire cooker. With a burner placed under the drum, washing water heating in the machine is looks very simple and practical. It is also very economical; there will be no need to invest in a steam boiler/generator and all expensive steam pipeline system together with all related parts and equipment. On the other hand if there is no further need for steam, the leftover steam in the steam boiler will condense into water, which leads to an energy loss, especially in plants that are not operating continuously. On the other hand, if the drum is heated directly by any fuel in the required amount, only the necessary amount of energy is consumed and maximum efficiency is obtained. In the proposed washing machine disclosed herein, water in the drum is heated directly; therefore the need for water fixtures containing heat exchangers and pumps is eliminated. As a result, there will be no need for a costly investment and a system comprising elements requiring maintenance such as heat exchangers, pumps, fitting parts, valves and filters is eliminated. In addition, heat losses related to the heat exchanger and related fixtures are also eliminated.

Describing all machines under the title washing machines regardless of their different capacities may lead to some confusion while disclosing the examples of the washing machine discussed herein. While some embodiments of the washing machine disclosed herein can be applied to household washing machines (57), commercial washing machines (56) and industrial washing machines (51), others may only be applied to one type of washing machines. The main targets of the washing machine disclosed herein are first and foremost commercial washing machines (56) and industrial washing machines (51). For this reason, the descriptions below are given for medium and large capacity machines. Sections specifically related to household washing machines (57) and industrial washing machines (51) must be evaluated by taking this into account.

Industrial washing machines (51) do not solely refer to industrial textile washing machines (52). Machines having similar features are used for many different washing treatments and these machines are also defined as washing machines. Household washing machines (57) and commercial washing machines (56) are generally used for washing laundry. However, aside from industrial textile washing machines (52), large capacity industrial washing machines (51) also comprise industrial parts dyeing machines (53), industrial stone washing machines (54), final washing of the textile products of the textile manufacturing, rubber-covered dust mat washing machines and industrial heavy material (such as carpets) washing machines (55). While they are similar in terms of looks and basic structure, they have very different structural features.

The present washing machine disclosed herein comprises many features having a technical advantage that are based on the system where a section of the drum is taken out of the water tank and/or water-free zones are formed on the outer surface of the drum using the Poly-Ribs Eco-Drum technique that explained by EP2229475. However, it has become necessary to organize the disclosure to cover all the features, because they have features that complete/complement each other in application, one feature makes it possible for another feature to be used, using the features together lead to advantages greater than their individual advantages and the details of their applications can be described by embodiments that are realized by using multiple features together. One of the principles and preferred purposes of the washing machine disclosed herein is the presence of moving parts in the balance system (300) inside and/or outside the drum. Providing the conditions wherein moving parts (200) that can be moved in a controlled manner can be mounted onto the drum, what the moving parts may be, the advantages brought about by the moving parts and the operations possible with these machines are organized and described under the headings below.

Feature of the washing machine disclosed herein is to directly connect electrical energy to the drum and to move all moving parts in the drum with electric motors.

We call the water-filled part surrounding the inner drum a "water tank or an outer drum", as well sometimes a water tub. Water tank and outer drum are good definition for water fill closed container. But if the chamber at the outside, or radially outward, of the perforated inner drum is only functioning to collect drain water come through inner drum perforations, water chamber will be more suitable to define. In this description, the outer drum, water tank, water drum is used to describe the water container in conventional washing machines. In our system the outer chamber only for collecting water likes a chamber. So it is more appropriate to refer to this part as water chamber.

The system described in EP2229475 aimed to save water by collecting all the water exist in the outer drum into the drum. For this purpose, the presence of water in the outer drum or even completely emptied can be controlled. For this purpose, the amount of water contained in the outer drum or even the complete discharge of the outer drum was controllable. In fact, if there is no water in the outer drum in any circumstances, what is the reason for the outer drum existence? The outer drum is no longer outside the drum, i.e., there is no known water tank surrounding the drum. It is enough to cover by the collection chamber a small part of the outer surface of the drum which water draining from the drum may be received by the collection chamber to collect water from the drum. The drums being largely out of the water tank open the door to many new applications in the design of the washing machine. Thus, mechanical moving systems can be mounted inside and outside of the drum. Motors that provide these mechanical moving systems to operate can be mounted directly outside the drum. The electrical energy that enables the motors to drive said mechanical moving parts can be directly connected to the drum. In addition, various sensors on the drum, pressurized air systems, liquid or gas-driven equipment, liquid or gas transfer connections required for these systems can be provided. In a sense, the drum was gain freedom from coming out through outer drum. Until now, the rotating perforated cylindrical part that mounted in a water tank is called drum. After that, it will be possible to call this piece as "free-drum" and from now on, the free-drum itself can be defined as a machine.

1. Moving Parts (250) Inside the Free Drum (104) and Industrial Stone Washing Machine (54) are Described Below.

A main idea of the machine subject disclosed herein is the moving parts (200) that give dynamism to the free-drum. The addition of moving parts inside of the drum (250) in order to increase the mechanical and chemical effects onto the materials being treated will increase the performance of the treatment and decrease operation time. Cylindrical rollers (201) that can complete a full rotation around their rotation axes and grindstones placed on vibrating parts (222) are given as example for the practical applications to explain methods wherein the moving parts (250) inside of the free drum (104) mounted in the drum. When rollers (201) are placed as close to the surface as possible onto cylindrical perforated drum sheet (106) or into the hollows formed by protrusions on cylindrical drum surface (261), the dynamic character of the free-drum (104) will be increased without giving up drum volume. When said rollers (201) and vibrating parts (222) are abrasive for use in stoning they are referred to as abrasive rollers (202) inside free-drum and when they are used for rubbing, mixing and felting treatments they are referred to as eccentric rollers (204) inside free-drum. The embodiment that will stand out the most will be industrial stone washing machines (54) comprising abrasive grindstone rollers (206).

2. Moving Parts Outside Free-Drum (251) and Balance System (300) Outside the Free-Drum are Described Below.

A second important application area of mounting moving parts (200) onto the free-drum is that it allows the machine to perform the spin cycle without vibration by weights placed in free-drum front circular base/opening side (109) and free-drum rear circular base/shaft side (110) of the outside of the free-drum to balance the imbalance produced during the spin extraction. An exemplary embodiment of said dynamic balance system (300) may be a system comprising two-weight balance system (302) mounted front and rear side of the free-drum that contain 2 balance weights for two-weights balance system (302). Each balance weight can move around in the balance weight bearing system (302-S) around the free-drum cylinder (104). During balanced conditions of the drum spinning, two balance weights (301) balancing each other when placed in opposite positions on a balance weight bearing system (302-S) on the central axis of the drum that can be rotated 360° by a gear connected to motor (310) connected to a balance weight movement motor (306). The balance weights for two-weights balance system (302) are placed in the front and the rear of the drum and outside of the balancing process; they are positioned in the manner to balance each other. During balancing they are displaced in order to offset the imbalance in the free-drum. In a similar system is two liquid container weight balance system (330), the two weights are two balance liquid containers (331) that are positioned opposite each other and that can be rotated 360° during and outside of the balancing process without changing their positions relative to each other. The two balance liquid containers (331) each contain a certain amount of balance liquid to balance each other out. During the balancing process, the containers are rotated together in the same direction as the imbalance load force vector while maintaining their positions opposite each other. While the containers are in this position, liquid transfers from one tank to another through balance liquid transfer connection line (334-L) so that the weight of one tank increases while the other decrease, until the counterweight to balance the unbalance load in the drum. Another balance system is to create an opposite force to balance the unbalance force created by the centrifugal force by moving of minimum 3 balance weight pieces for three-weights balance system (303-P) placed on the drum independently. We named this balance system for three-weights balance system (303-W) that able to mounted on planar surfaces at the front and/or at the rear of the drum placed at equal distances from weight guide bearing for three-weights balance system (304) on a threaded balance weight movement screw (305). If balance weight pieces for three-weights balance system (303-P) move away from the rotation axis of the drum by screw turning, each create more centrifugal force. Thus, when 3 or more weights are moved away from the axis of rotation, by separate motor driving to rotate screw to which each weight is mounted to create a counter-balance force. Thus, a control circuitry may control the threaded balance weight movement screw (305) to independently actuate a respective movable balance weight radially and parallel to the planar surface of the front or rear circular cover of the drum to radially move toward the axis of rotation of the drum or radially move away from the axis of rotation of the drum to adjust the counter-balance force.

3. The Presence of the Movement System Outside the Free-Drum in the Water-Free Zones is Described Below.

When physical or chemical treatments such as washing, stone washing and dyeing are performed in the free-drum, the chemicals and solid substances in the water will harm mechanical, electric and electronic systems providing movement outside the free-drum. For this reason, either said devices and equipment need to be produced to be waterproof and resistant to corrosive chemicals or these sections of free-drum (104) need to be water-free zones (100) that are fully free from water. The function of water chamber (500) is to collect the water leaving the drum. Ensuring that water does not reach some sections of water chamber (500) is only possible if said sections are placed higher than the maximum possible water level in water chamber (500). In other words, the water level in water chamber (500) needs to be kept at a level where water cannot reach undesired areas. It is possible to limit the amount water in water chamber (500) so that it only takes up a small volume at the bottom of water chamber (500) or even empty out water chamber (500) entirely. When this is achieved, the large portion of water chamber (500) aside from this small portion at the bottom can be referred to as water-free zone (100). Controlling the amount and area of the water outside free-drum (104) can prevent water contact with parts placed outside drum (104).

It can be ensured that the water inside washing machine (50) with perforated free-drum (104) remains at the bottom region of water chamber (500) and inside free-drum (104). It will be sufficient to pump the water from water chamber (500) also defined as water tank/outer drum (101) in the Eco-Drum system (61), back into the inner free-drum (104) by a circulation pump (112) having a pumping flowrate that is higher than the drain flowrate of discharged water exiting through drum perforations into the water chamber (500). In other words, circulation pump (112) collects the draining discharged water from the free-drum (104) through water chamber (500) and directs it back into the drum via a circulation line (113). In this manner, a large portion of the water is constantly collected in the free-drum (104).

4. Limiting the Drain Water from Drum (104) at a Steady Flowrate and at Pump Capacity is Described Below.

It is possible control the volume and amount of water exist at the outside of the drum (104) using the Eco-Drum system (61) described in EP3252207. Protrusions on cylindrical drum surface (261) placed around drum perforations on cylindrical perforated drum sheet (106) of the Poly-Rib system (60) described in the EP2229475 may prevent the materials undergoing treatment from reaching and fully or partially blocking drum perforations/holes (105). The Eco-Drum system (61) describes evacuation of the water in water chamber (500) by draining water from the free-drum (104) where the quantities and/or dimensions of holes are calculated or reduced compared to conventional drums with a limited flowrate and being pumped back into free-drum (104) by a circulation pump (112) having a larger pumping capacity that the flowrate of the water draining form drum (104). It can be deduced from the description that this system also provides savings of water, chemicals and energy in the washing machine (50). Poly-Rib system (60) describes a system where protrusions placed on the surface of free-drum (104) prevent the laundry from fully blocking drum perforations/holes (105).

BRIEF DESCRIPTION OF THE DRAWINGS

FIG. 4 demonstrates a side sectional view of an example of a midsize industrial abrasive roller stoning washing machine with abrasive rollers in the drum driven by motors in groups and having a drain system through water collection chamber and water storage tank with circulation pump.

FIG. 8 demonstrates a side sectional view of (A) an example of a midsize industrial abrasive roller stoning washing machine having a two-weights balance system applied around cylindrical drum surface at front and rear side of the drum and discharge chamber drain system closed around perforated zone surrounded with water collection chamber directly connected with circulation pump and having direct heating gas combustion chamber and (B) water collection chamber with circulation pump and gas combustion chamber with gas burner.

motor.

Figure 12:
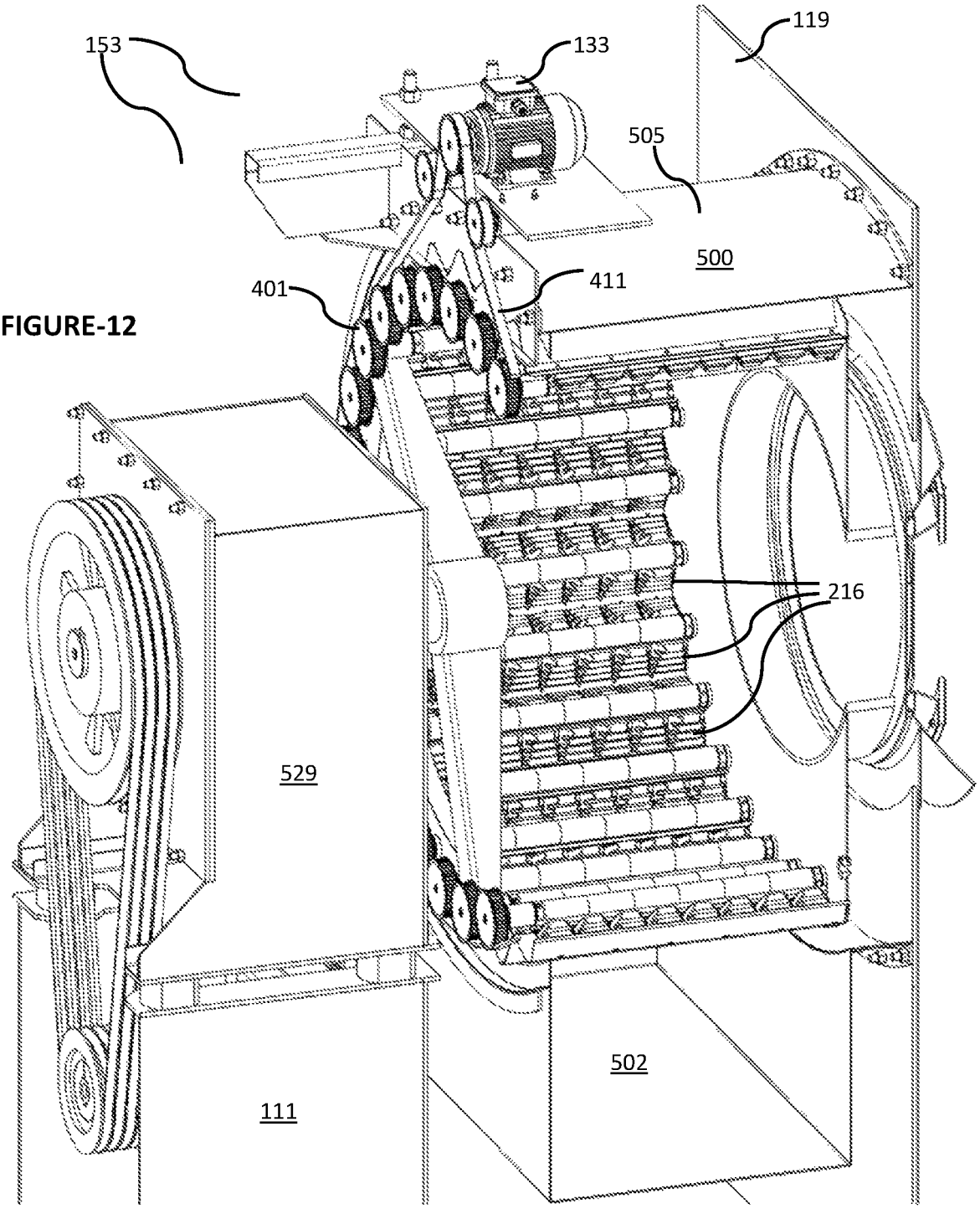

FIG. 12 demonstrates side sectional view of an example of an indented drum comprising rollers having cylindrical grindstone pieces and that are attached to gear pulleys driven by a gear belt rotated by a motor on a fixed chassis and coarse grindstones in-between said rollers.

Figure 13:
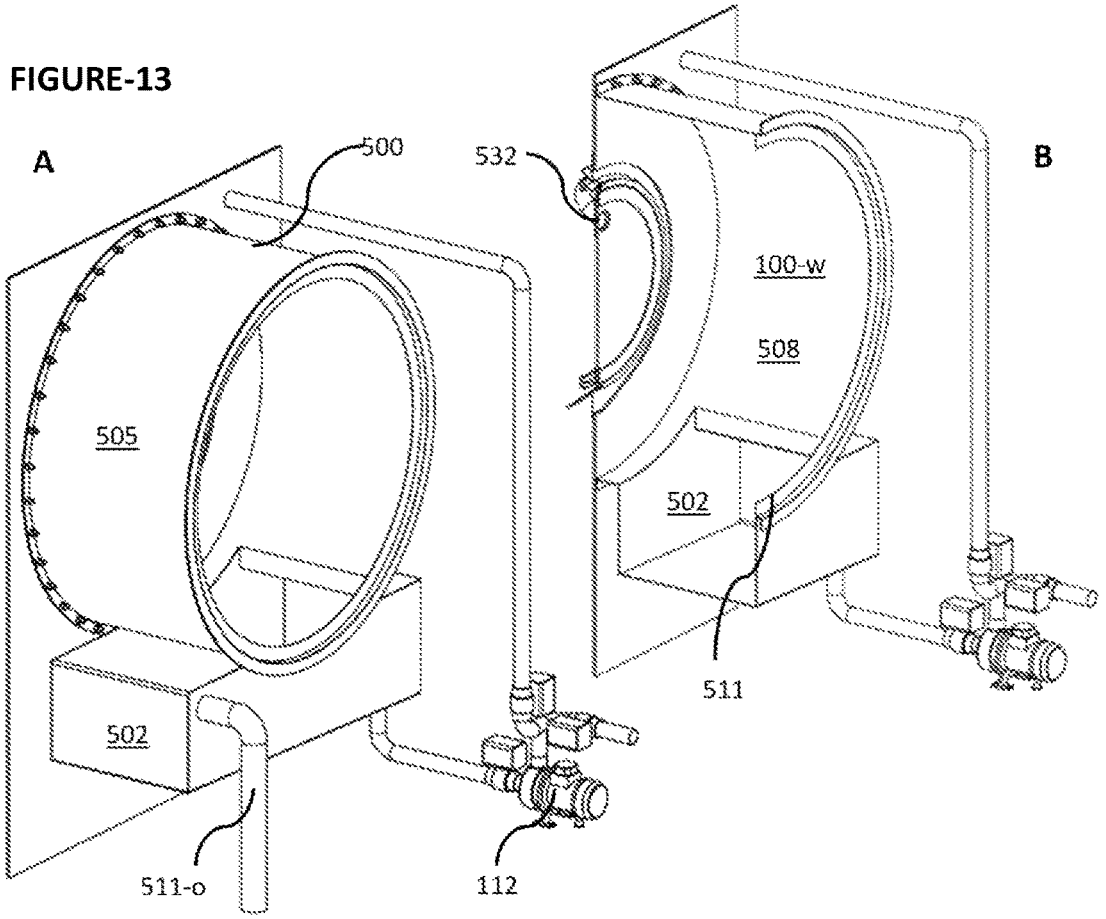

FIG. 13 demonstrates (A) a perspective view and (B) a side sectional perspective view of an example of a rear side opened half water tank comprising a water accumulation.

Figure 14:
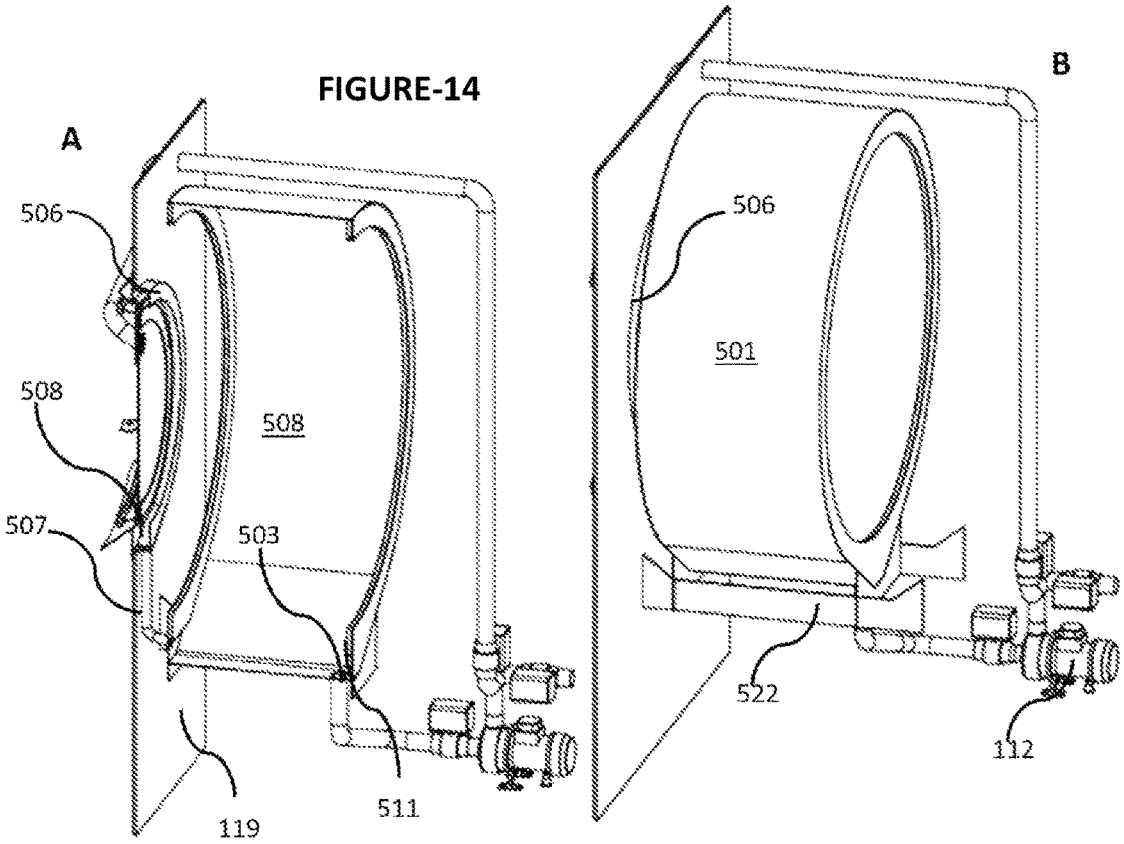

FIG. 14 demonstrates (A) a side sectional perspective view and (B) a perspective view of an example of a water collection chamber around drum and a chamber around drum opening gap.

Figure 15:
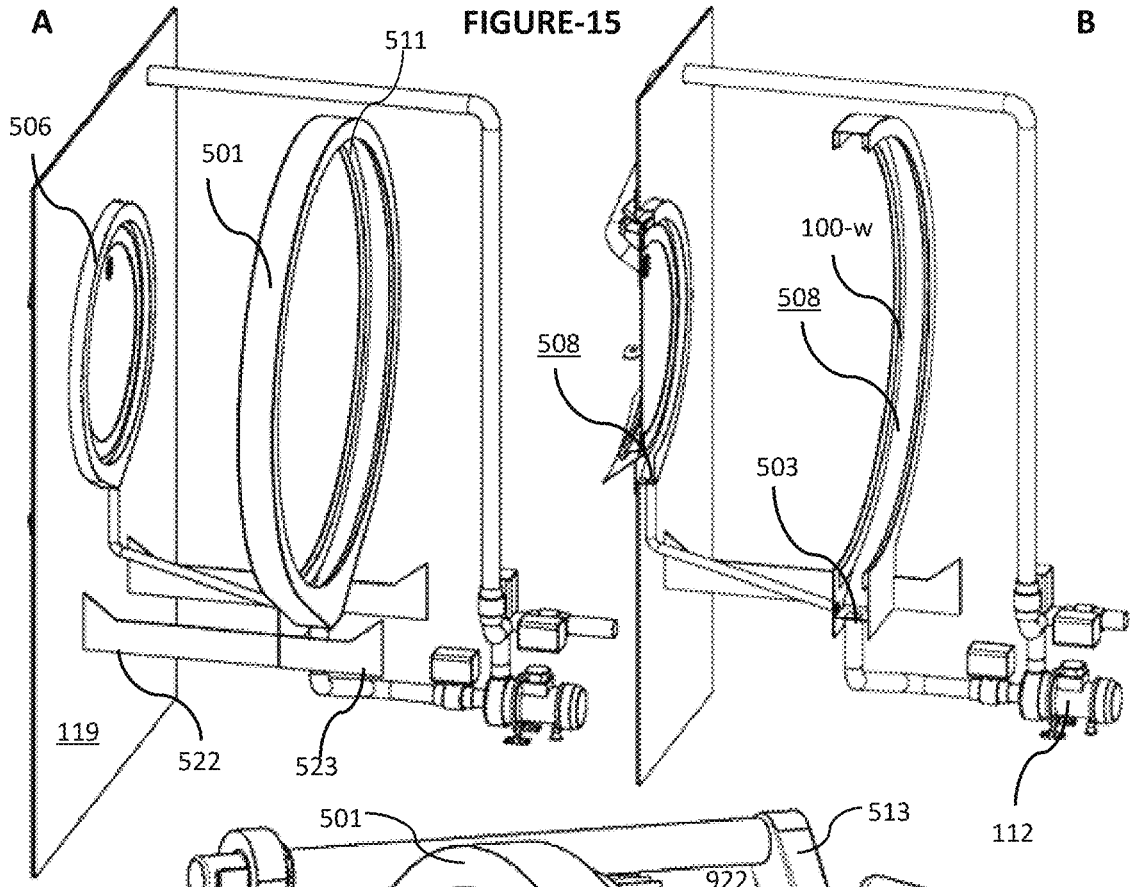

FIG. 15 demonstrates (A) a perspective view and (B) a side sectional perspective view of an example of a drum opening water collection chamber comprising a circulation system connected to narrow water collection chamber of drum having drum holes in a narrow zone.

Figure 16:
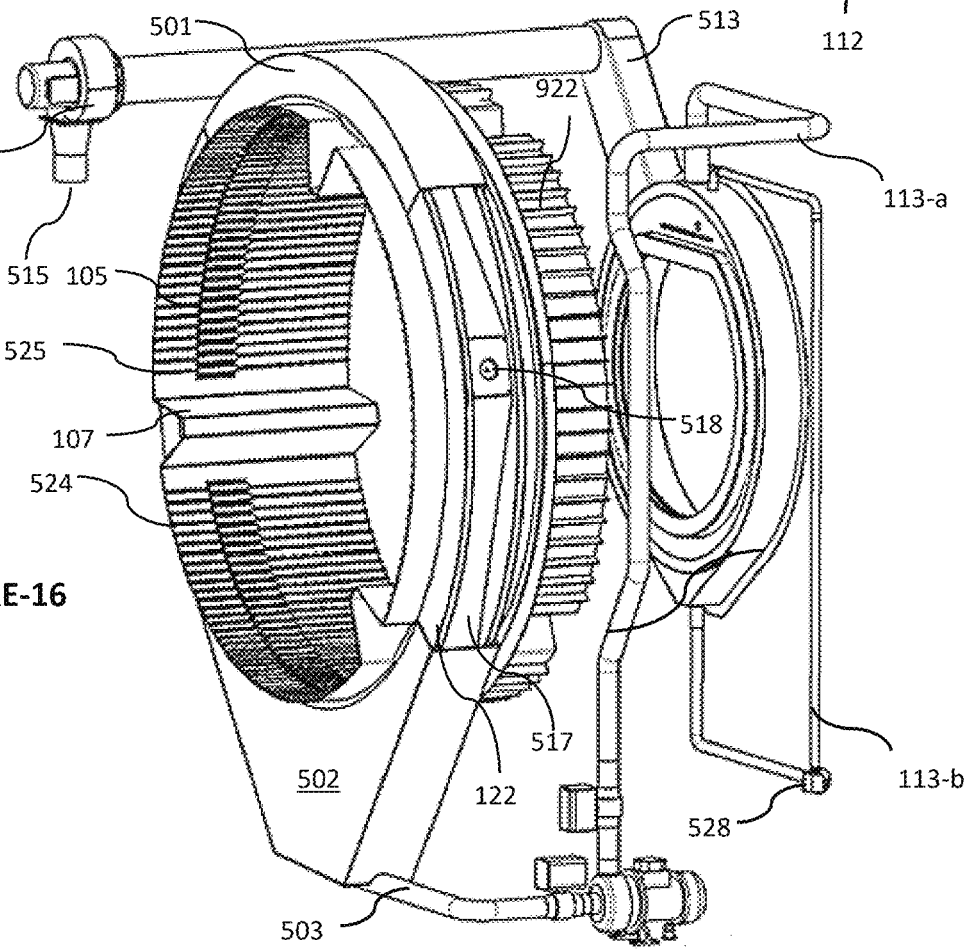

FIG. 16 demonstrates a perspective sectional view of an example of the part of the ribbed drum of a big size industrial washing machine comprising discharge chamber surround perforated narrow zone of the drum draining through narrow water collection chamber and water collection chamber placed around drum opening gap.

Figure 17:
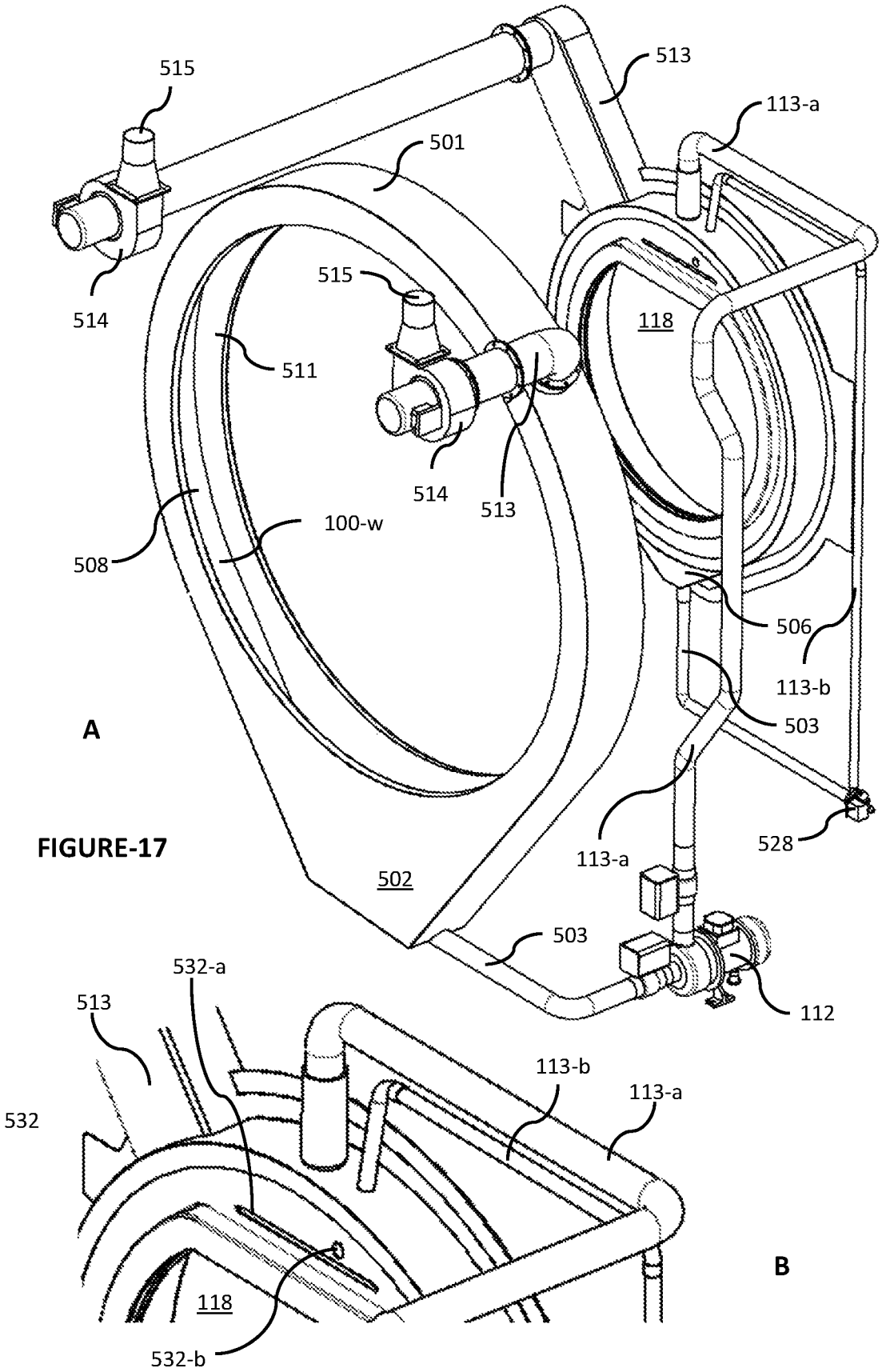

FIG. 17 demonstrates (A) a perspective view of an example of the narrow water collection chamber surrounding perforated narrow zone of the drum and water collection chamber applied around drum opening to collect drain water from gap together with gas flue outlet from and fan and both water collection system comprising pump to inject water into the drum and (B) a close-up perspective view of water inlets placed over drum door as shown detailed.

Figure 18:
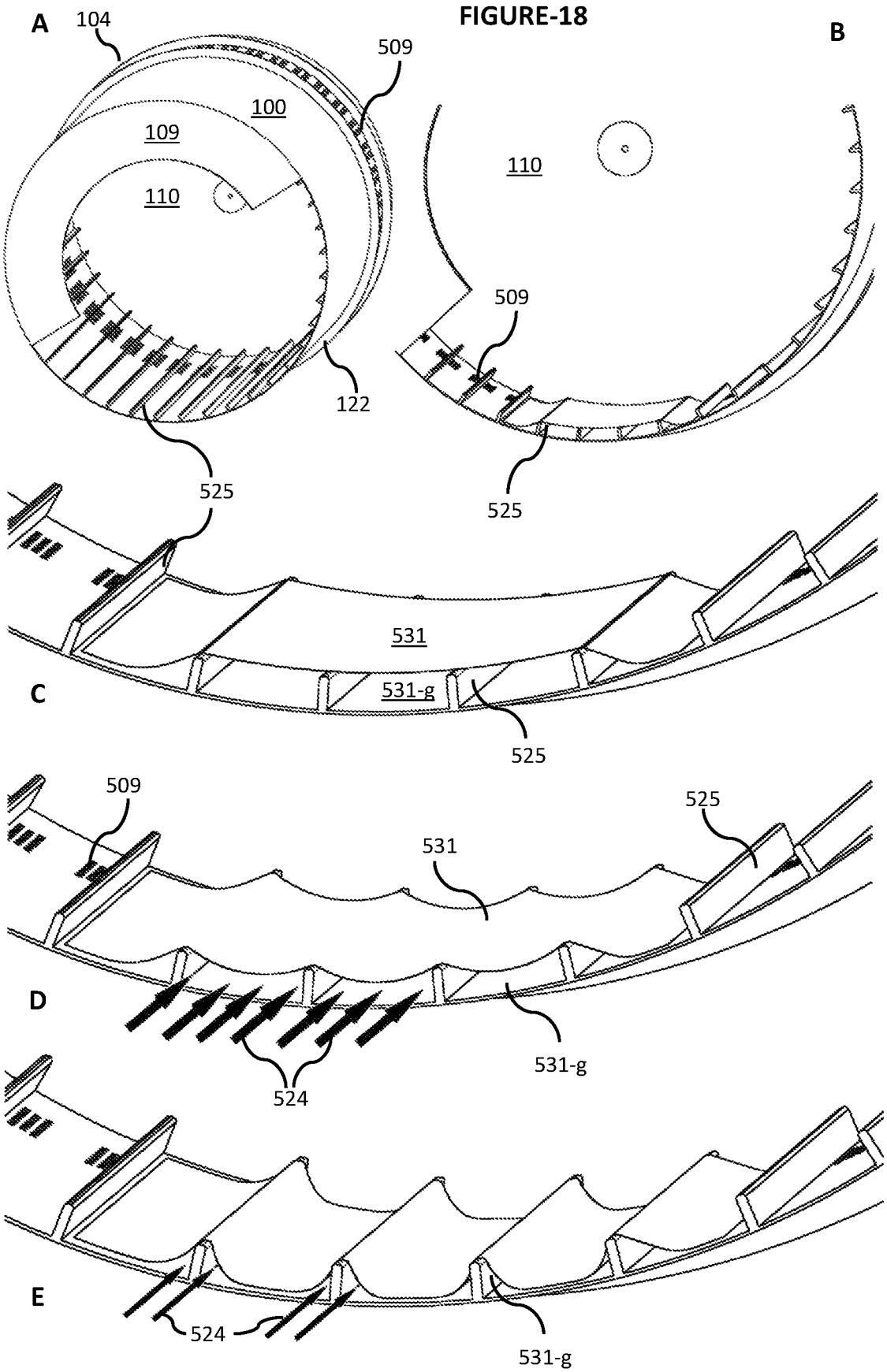

FIG. 18 demonstrates a schematic view of an example of a washing machine drum (A) comprising poly ribs on cylindrical inner surface, which may also be described as channel members extending radially toward the axis of rotation of the drum, and (B) a piece of textile has fallen and lay on the surface of the drum and from (A) to (E) show forming a tent from said textile over poly ribs leaving water passage gap under the tent.

Figure 19:
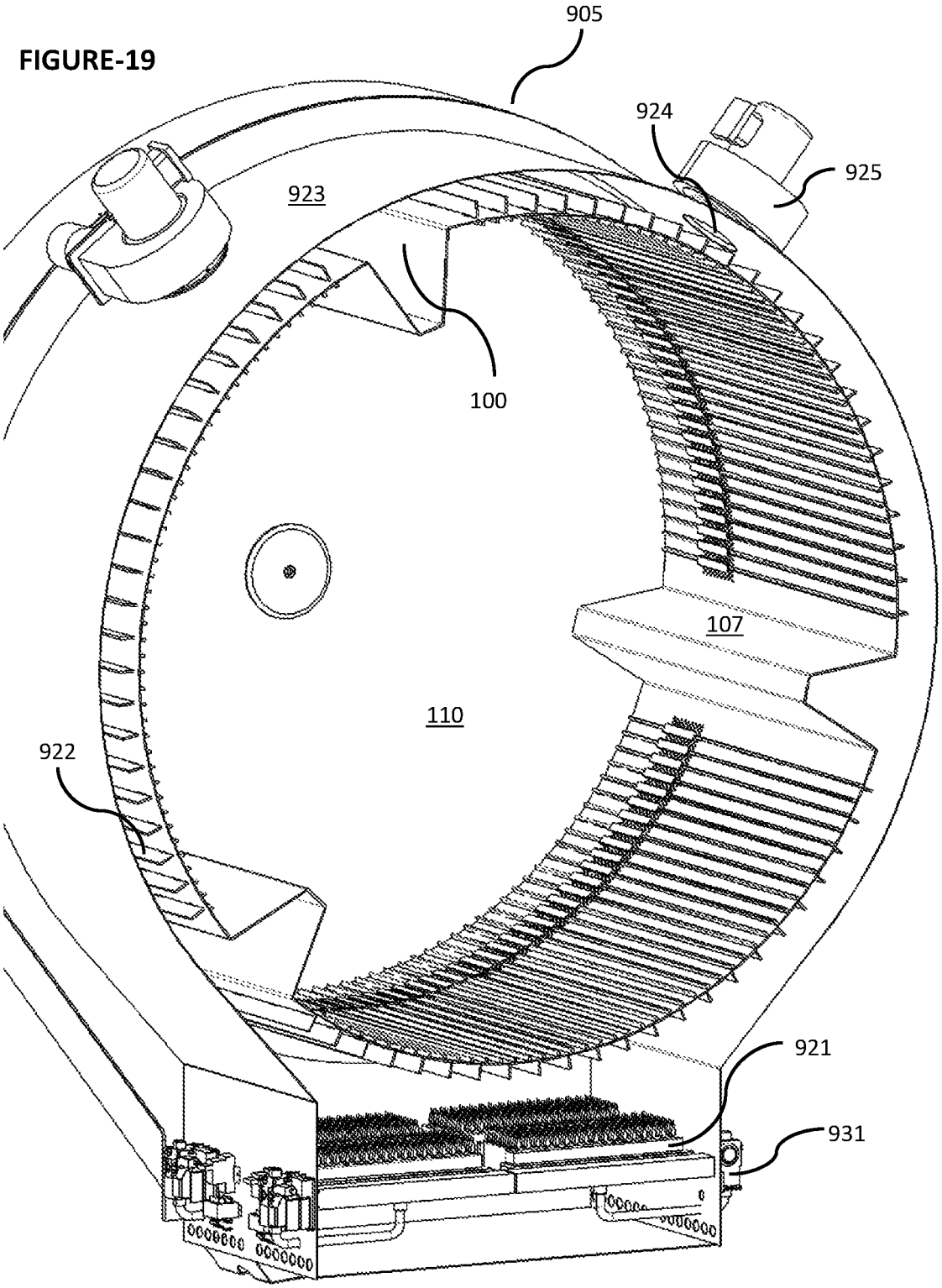

FIG. 19 demonstrates a perspective sectional view of an example of a big size industrial washing machine comprising protrusive drum and a direct gas heating system to heat drum through protrusive outer surface of the drum.

FIG. 20 demonstrates (A) a perspective sectional and (B) close-up rear side perspective view of an example of a big size industrial stone washing machine drum (A) comprising cylindrical abrasive rollers applied over drum surface (B) 3 rollers drive in groups by electric motors.

Figure 21:
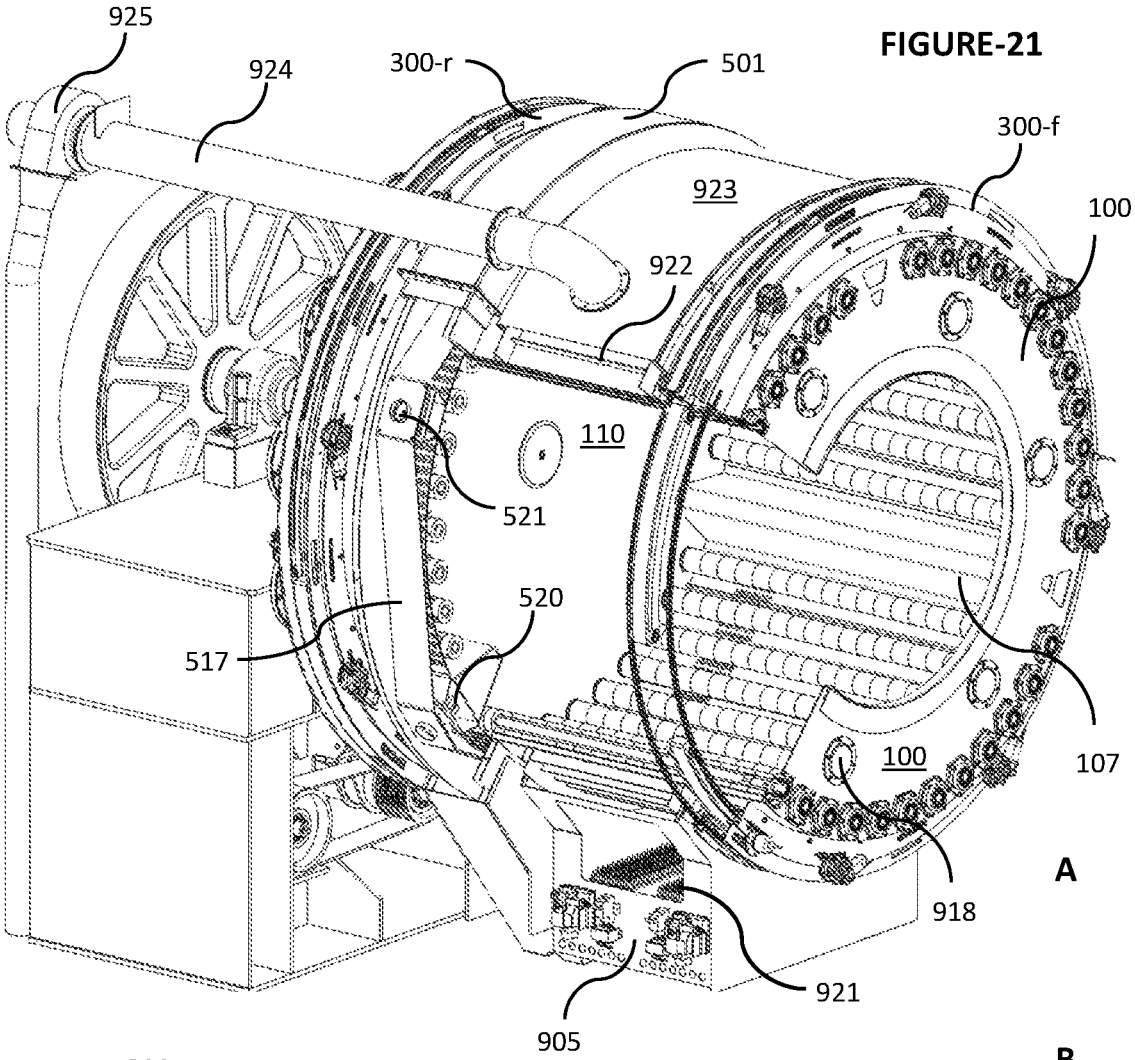
Figure 21:
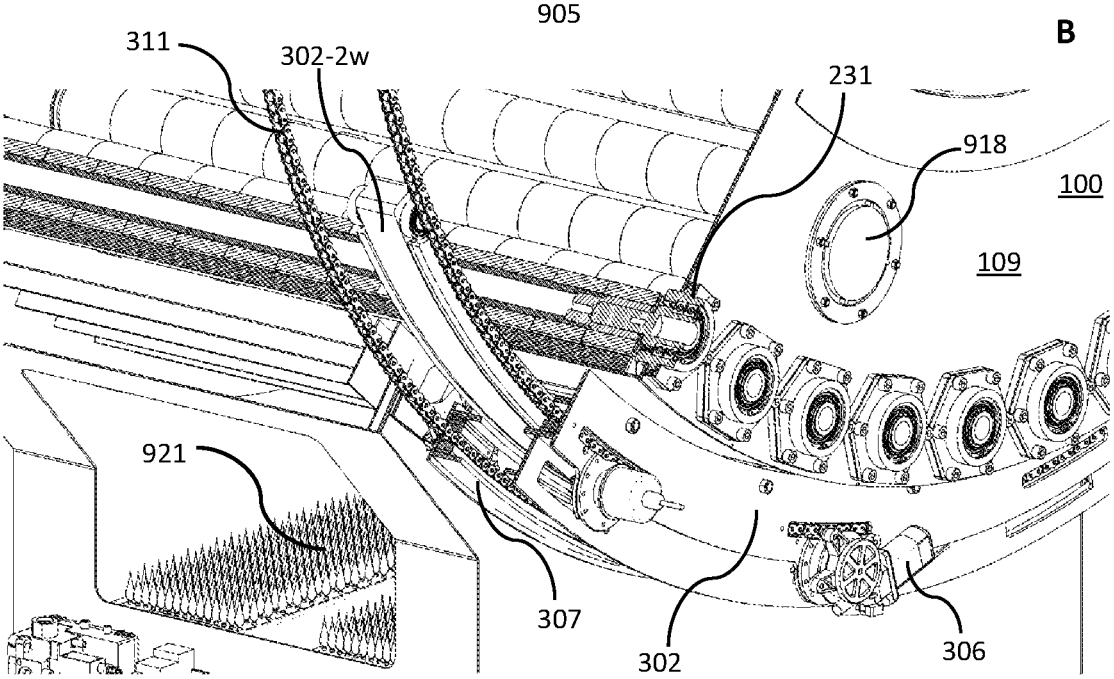

FIG. 21 demonstrates (A) a perspective sectional view and (B) close-up sectional perspective view of an example of a big size industrial stone washing machine comprising cylindrical abrasive rollers applied over drum surface and narrow water discharge chamber surround drum perforations in narrow zone and water collection chamber placed around water discharge chamber and having direct heating system with gas burner in combustion chamber and two rotatable weight balance system mounted at front and rear side of the cylindrical drum surface and light apparatus directly mounted on front drum base.

FIG. 22 demonstrates (A) a sectional perspective view and (B, C, close-up sectional perspective view of an example of a drum discharge chamber comprising pneumatic piston valves surround around the drum perforations in the narrow zone on the conical drum sheet and water collection chamber around water discharge chamber.

Figure 23:
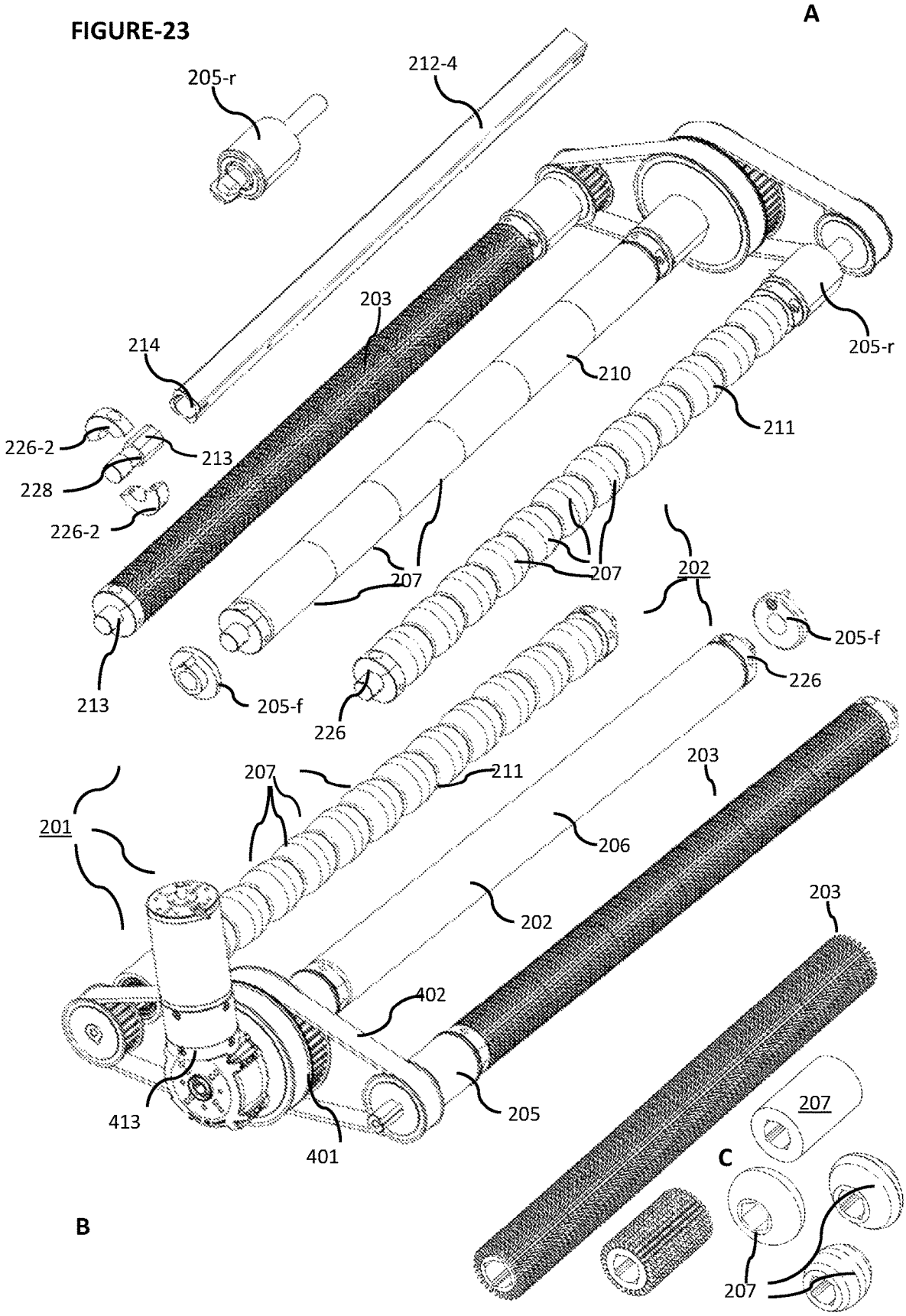

FIG. 23 demonstrates a perspective view of an example of different roller structures and shapes wherein said rollers are driven along with neighboring rollers by a central roller (A) with geared pulley and threaded belt (B) with the details of roller with a motor directly connected to the central roller and (C) with different grindstone or brush parts of the rollers.

Figure 24:
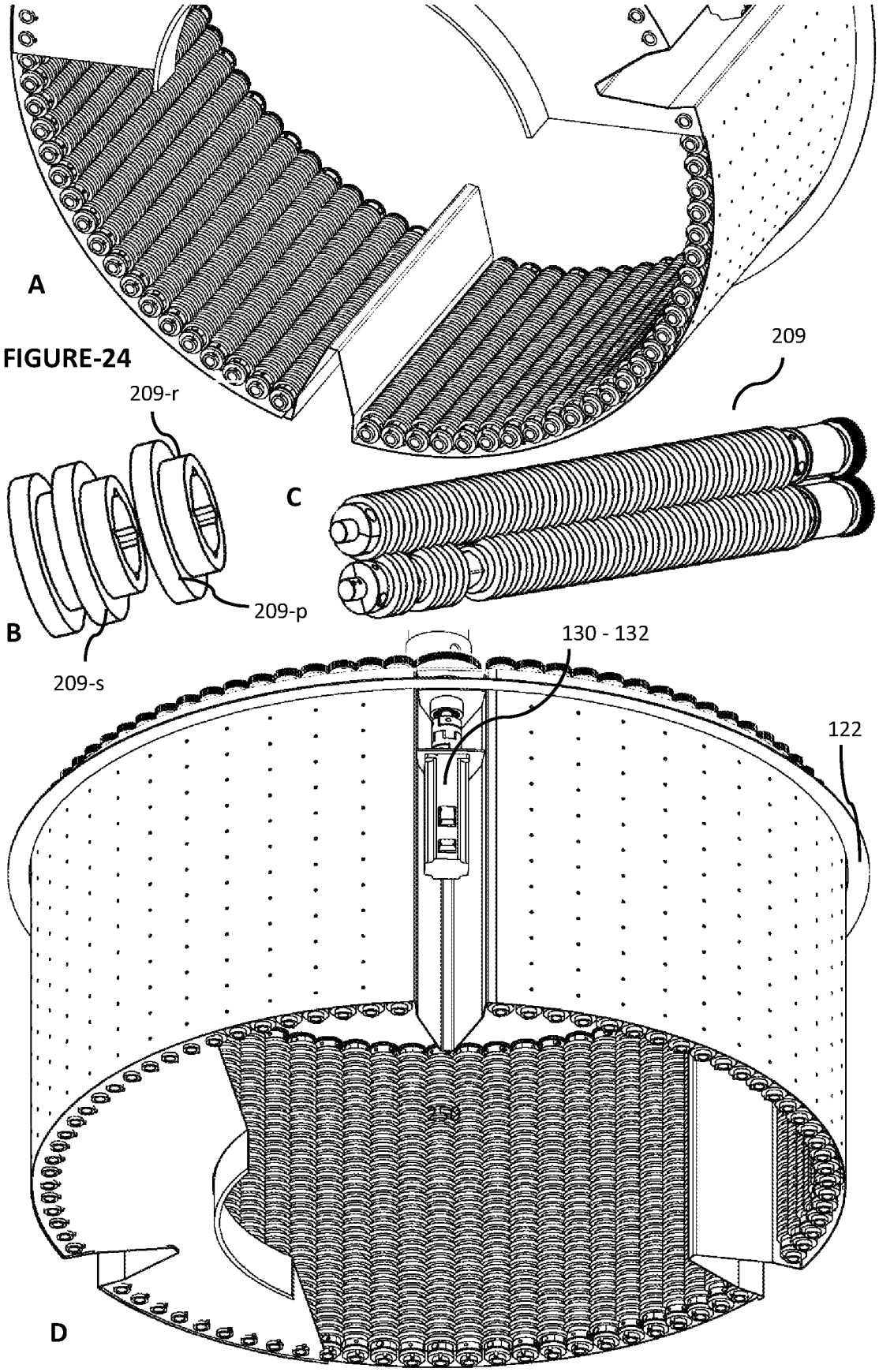

FIG. 24 demonstrates (A, D) a perspective view of an example of mounting of interlocking rollers side by side in a drum, (B) a perspective view of an example of grindstone pieces of interlocking rollers and (C) a perspective view of an example of interlocking rollers.

FIG. 25 demonstrates a perspective view of the mounting of (B) an example of indented grindstone pieces placed on vibrated platforms (A) mounted on the drum surface via a spring mechanism with vibrators having electrical motors.

FIG. 26 demonstrates a perspective view of an example of (A) the mounting in the drum of (B) roller housings of the drum wherein the discharge holes at the end of the water channel of molded roller housings that are wrapped below the cylindrical rollers that is inclined towards the holes correspond to the holes in the narrow zone of the conical cylindrical sheet drum.

Figure 27:
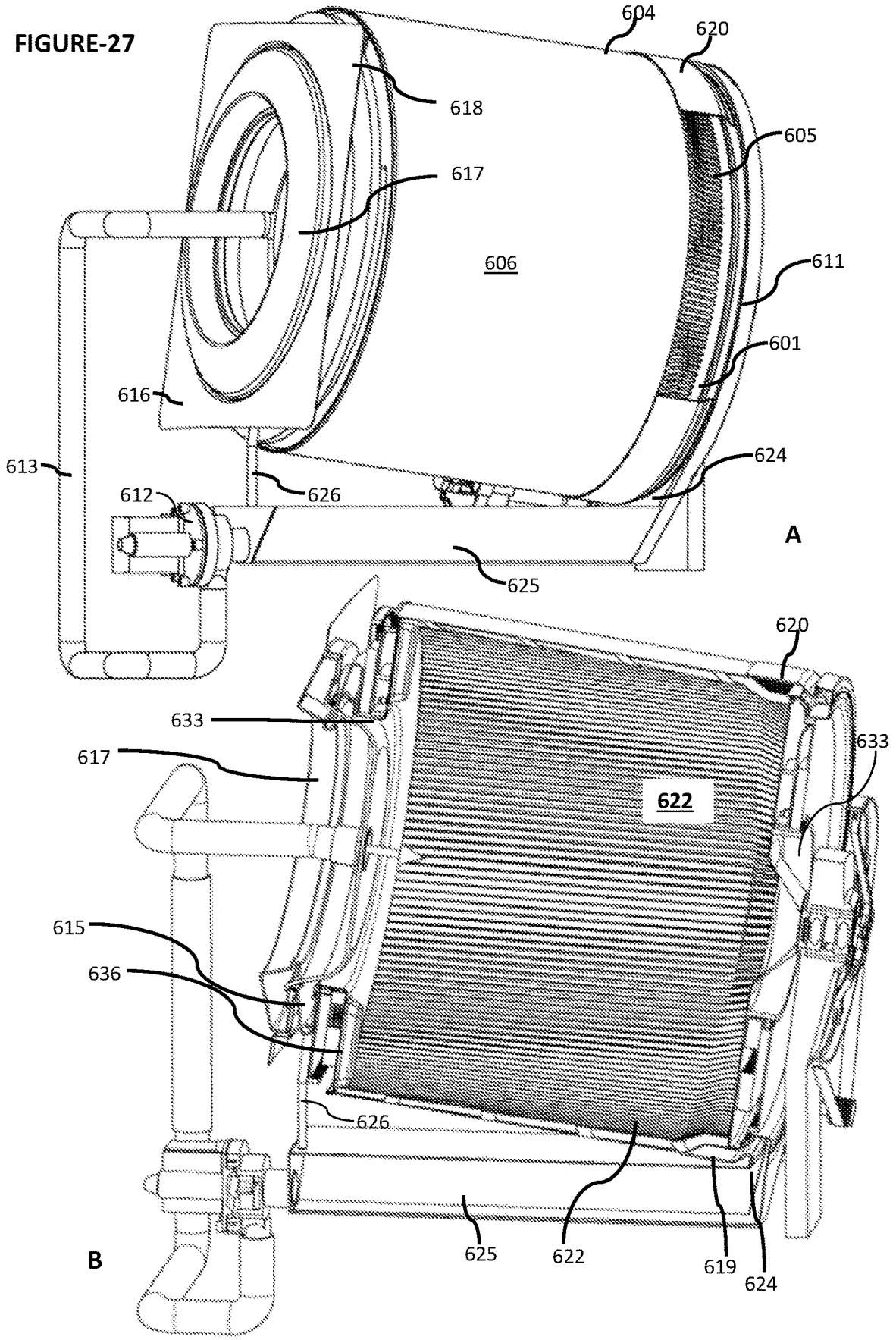

FIG. 27 demonstrates (A) a schematic perspective view of an example of a circulation pump and line, a perforated drum in the back in a narrow zone and water tanks of a household washing machine and (B) a schematic perspective sectional side view of a circulation pump, circulation line, cover, water grate angled on the cylindrical sheet inside drum, water tanks and motor-pulley parts of a household washing machine.

FIG. 28 demonstrates an exploded perspective view of (A) an example of a two rotatable weight balance system mounted on front side base of a household washing machine drum and (B) rear side base of a household washing machine drum.

Figure 29:
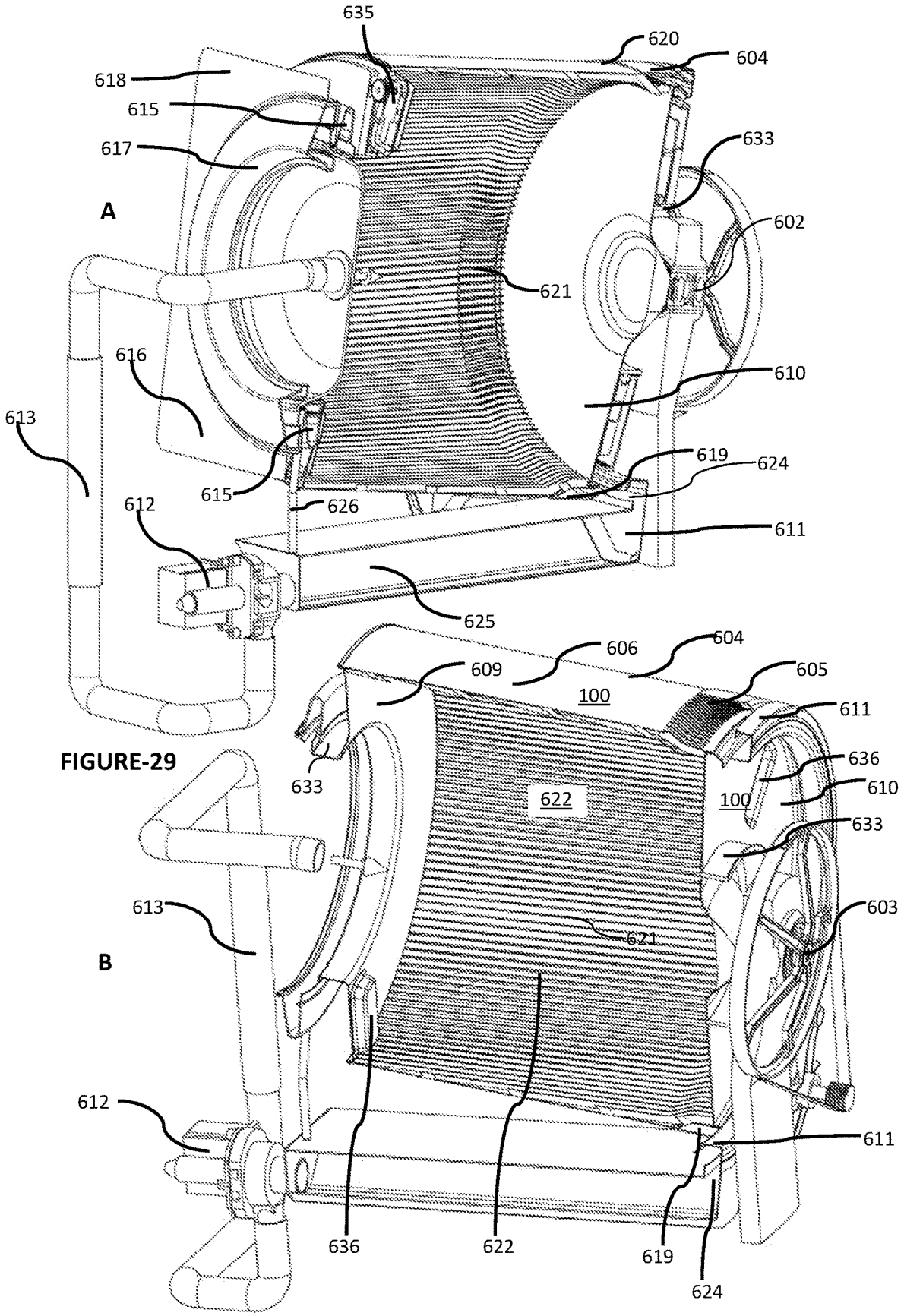

FIG. 29 demonstrates a side sectional (A) front and (B) rear perspective view of an example of a circulation pump, circulation line, cover, protrusive drum in the form of water grate angled on the cylindrical drum sheet inside drum and water collection chamber around drum perforations and water tank connected with chamber and two weight balancing system mounted at both side of the drum base of a household washing machine.

FIG. 30 demonstrates an example of (A) a side sectional detailed perspective view of cover sheet wrapping around the water discharge hole inside a perforated drum volume at the rear corner and outside the drum sheet to cover said water discharge hole and water collection tank of a household washing machine from two different angles and (B) a side sectional perspective view of a drum opening water collection tank, a water collection tank and the connection there between of a household washing machine from two different angles.

between of a household washing machine.

Figure 31:
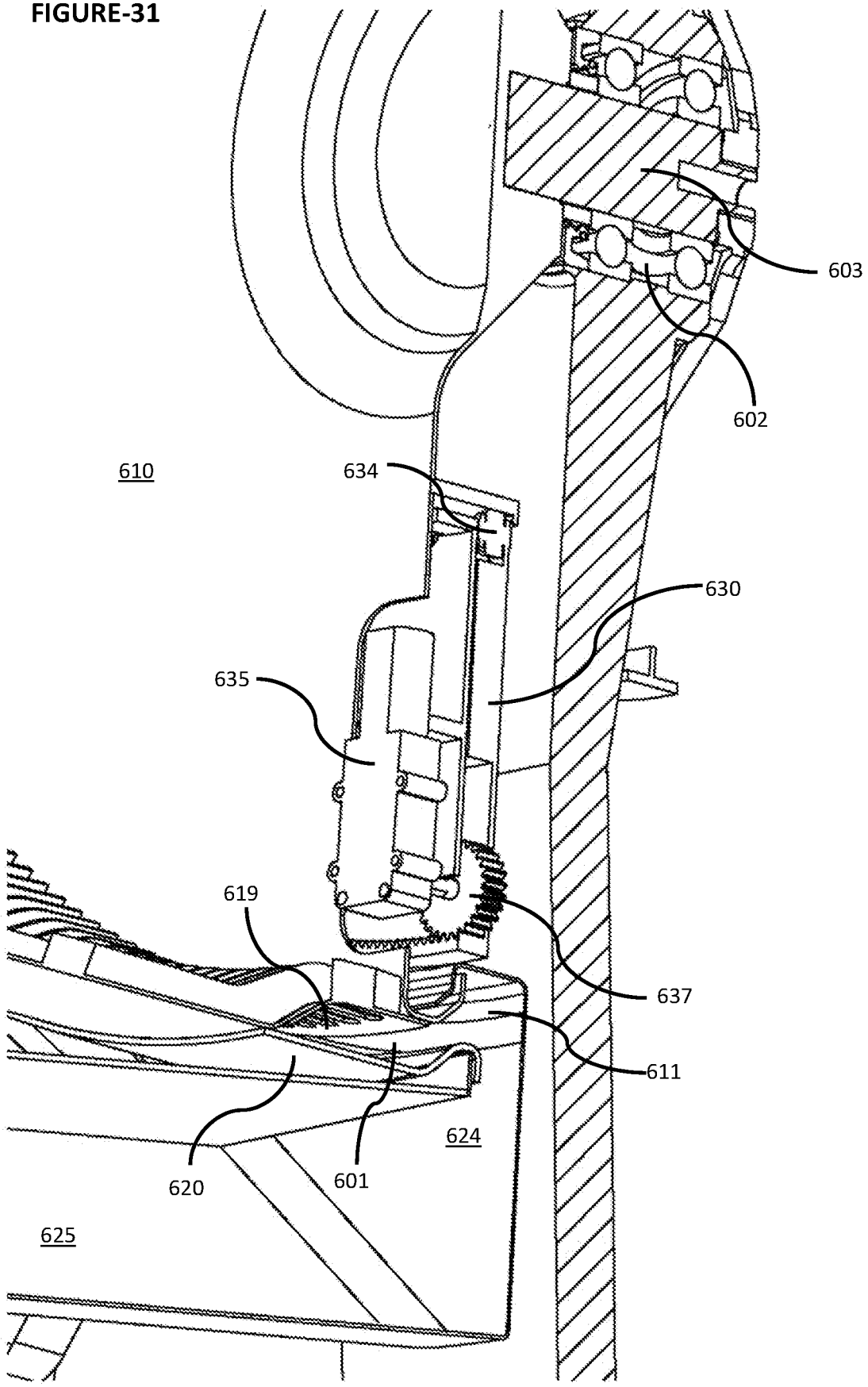

FIG. 31 demonstrates a side sectional detailed front perspective view of an example of a rear balance system, balance weight rotation system connected to gears on balance motor and a water collection tank, a water storage tank and the connection there between of a household washing machine.

FIG. 32 demonstrates a detailed perspective view of an example of a three weight threaded bearing balance system (A) from the front of the drum and (B) having a balance weight motor and the connected weight threaded bearing.

Figure 33:
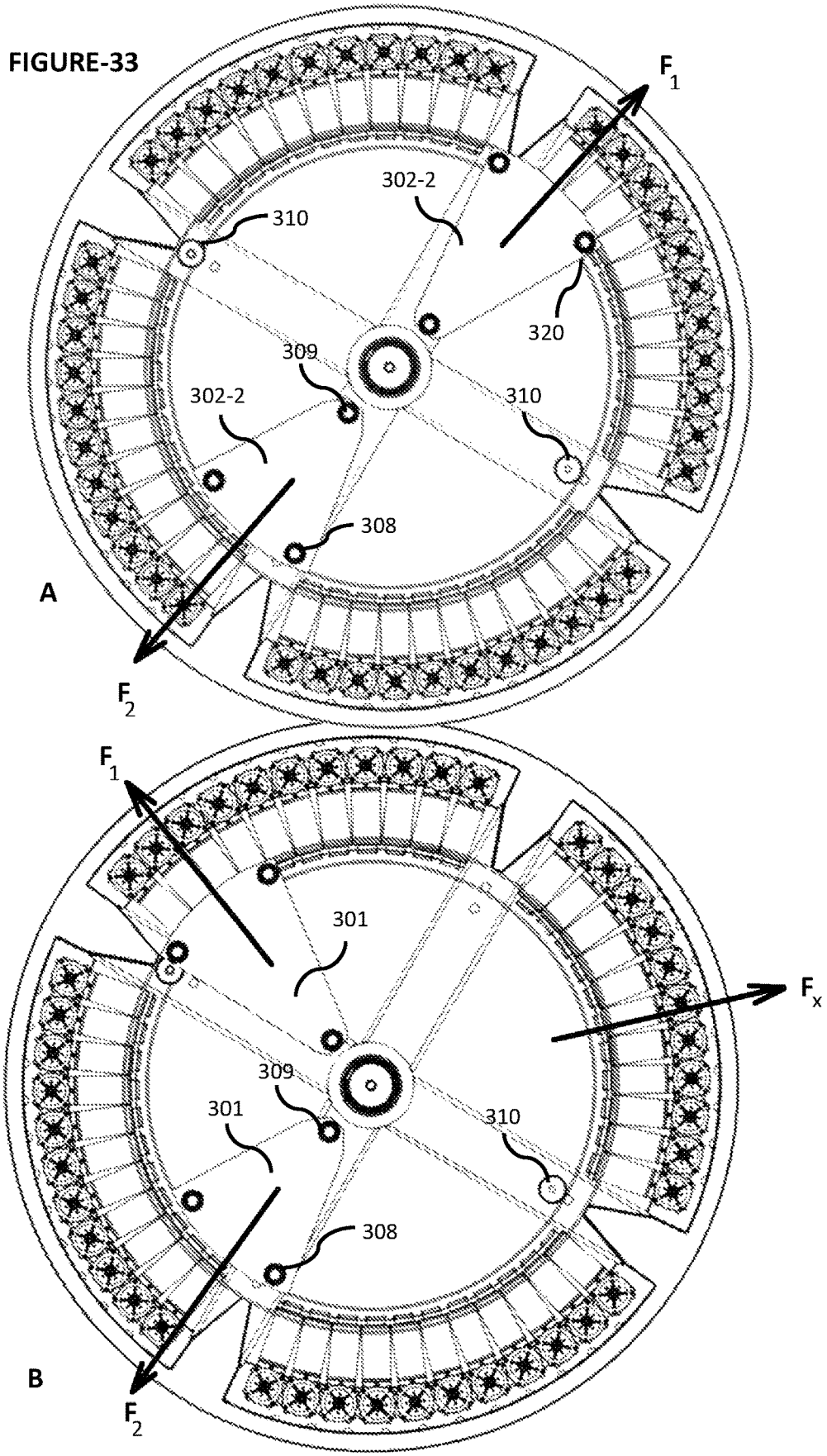

FIG. 33 demonstrates an example of a schematic view of an example of (A) opposing forces F1 and F2 created by balance weights balancing each other and (B) and the opposing force created by F1 and F2 created by balance weights balancing the Fx force creating an imbalance in the drum in a two weight balance system.

Figure 34:
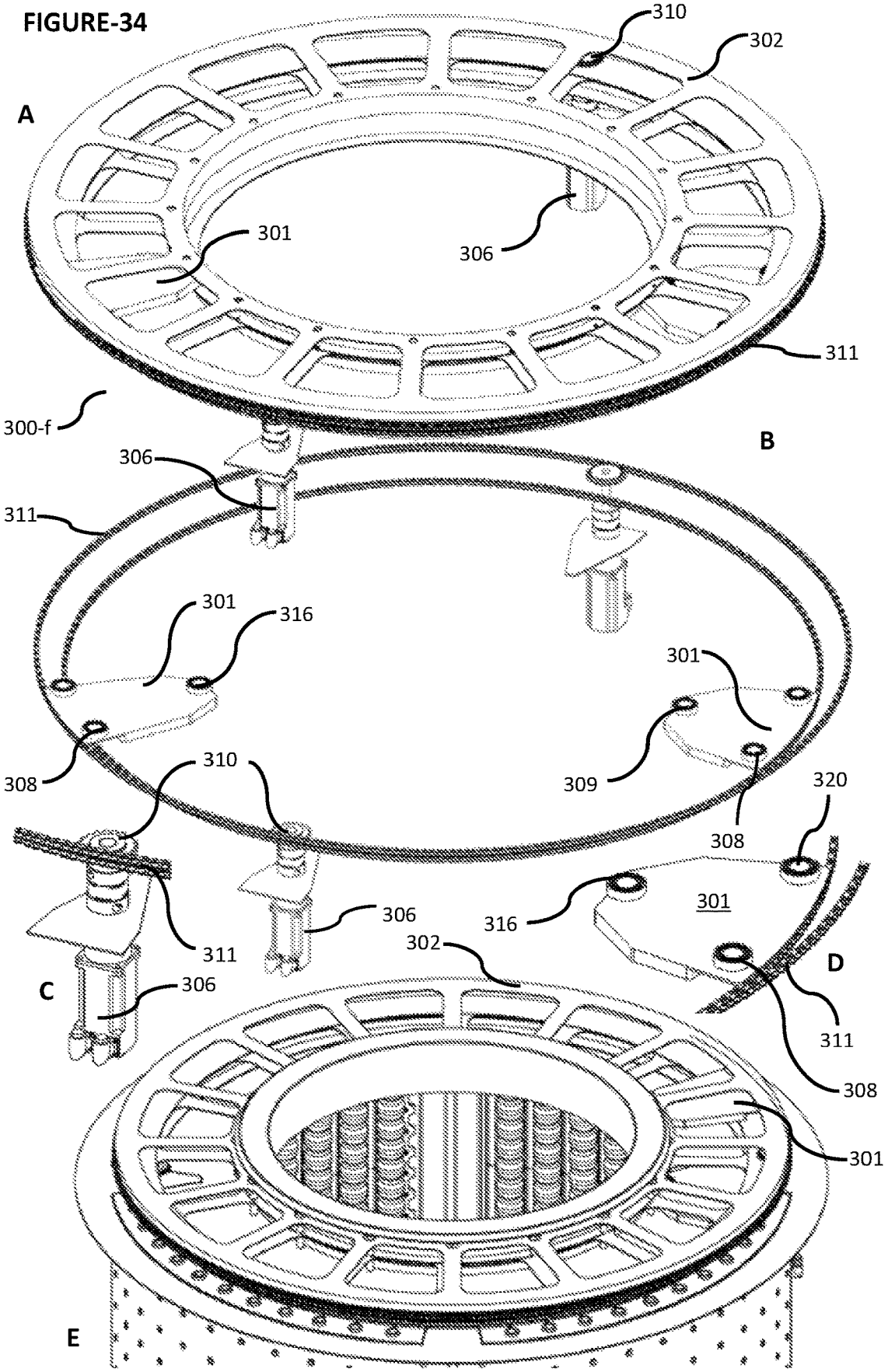

FIG. 34 demonstrates an example of (A) a schematic perspective view showing an example of assembled the two-weight balance system and (B) a exploded perspective view showing moving system of a two weight balancing system having two weights and balance weight movement motors with chain gear and chain connected with balance weights and (C) a view of the connection details of and (D) a close up detailed perspective view of motor-gear-chain and (E) a front perspective view from a drum having a two weight front balance system around drum opening.

Figure 35:
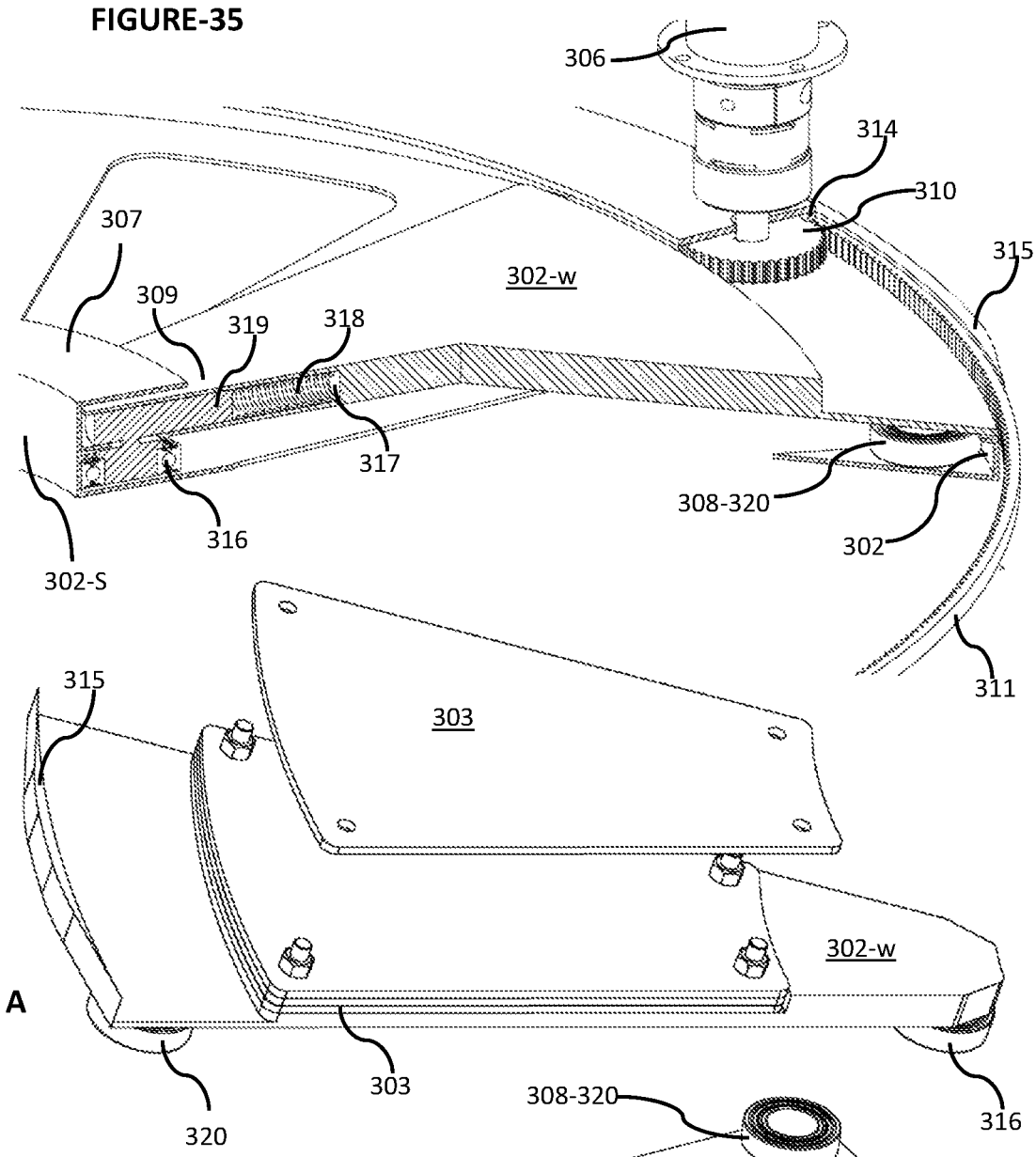

FIG. 35 demonstrates a sectional perspective view of an example of a gear belt of the gear connected to a motor driving the weight part, drive wheels carrying said weight part on the travelling path and a guide wheel ensuring that said weight remains in the guide channel of a two-weight front balance system.

Figure 36:
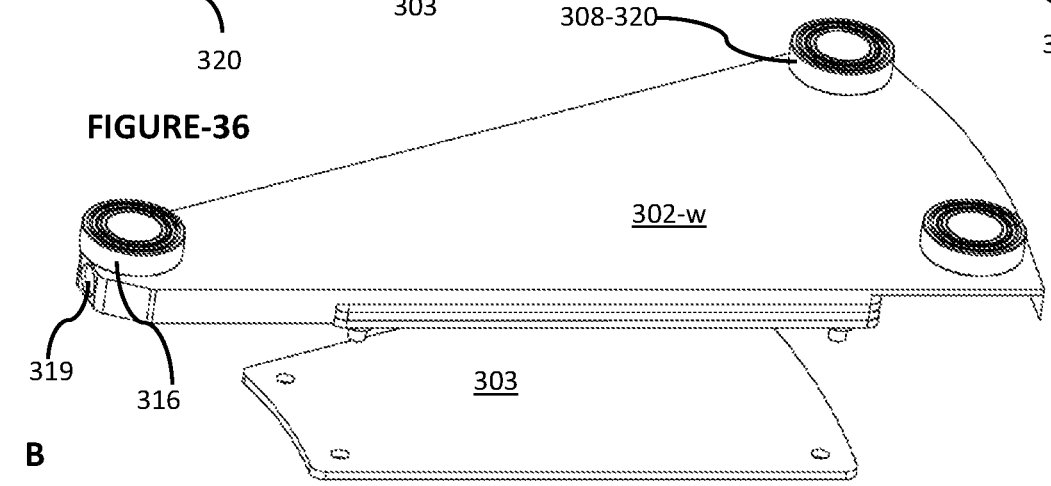

FIG. 36 demonstrates (A) a top perspective view and (B) a bottom perspective view of an example of additional weight parts of a two-weight front balance system.

FIG. 37 demonstrates (A) a side sectional perspective view of a midsize industrial washing machine drum comprising poly-ribs, or channel members extending radially toward the axis of rotation of the drum, having a two-weights balance system and drain system through drum perforations collect in a narrow zone and monitoring with pneumatic valves on water discharge chamber to drain via collection chamber and having gas burner in gas combustion chamber to heat drum and (B) close-up sectional perspective view of a pneumatic valve on water discharge chamber.

FIG. 38 demonstrates an exploded side sectional perspective view of a mid-size stone washing machine's drum having balance system to show balance weights moving system of the two weight balance system on a drum comprising cylindrical abrasive rollers over the inner drum surface.

FIG. 39 demonstrates a perspective view of a complete two weight balance system and only moving systems of a two weight balance system comprising chain drive by geared electric motors to move balance weight.

Figure 40:
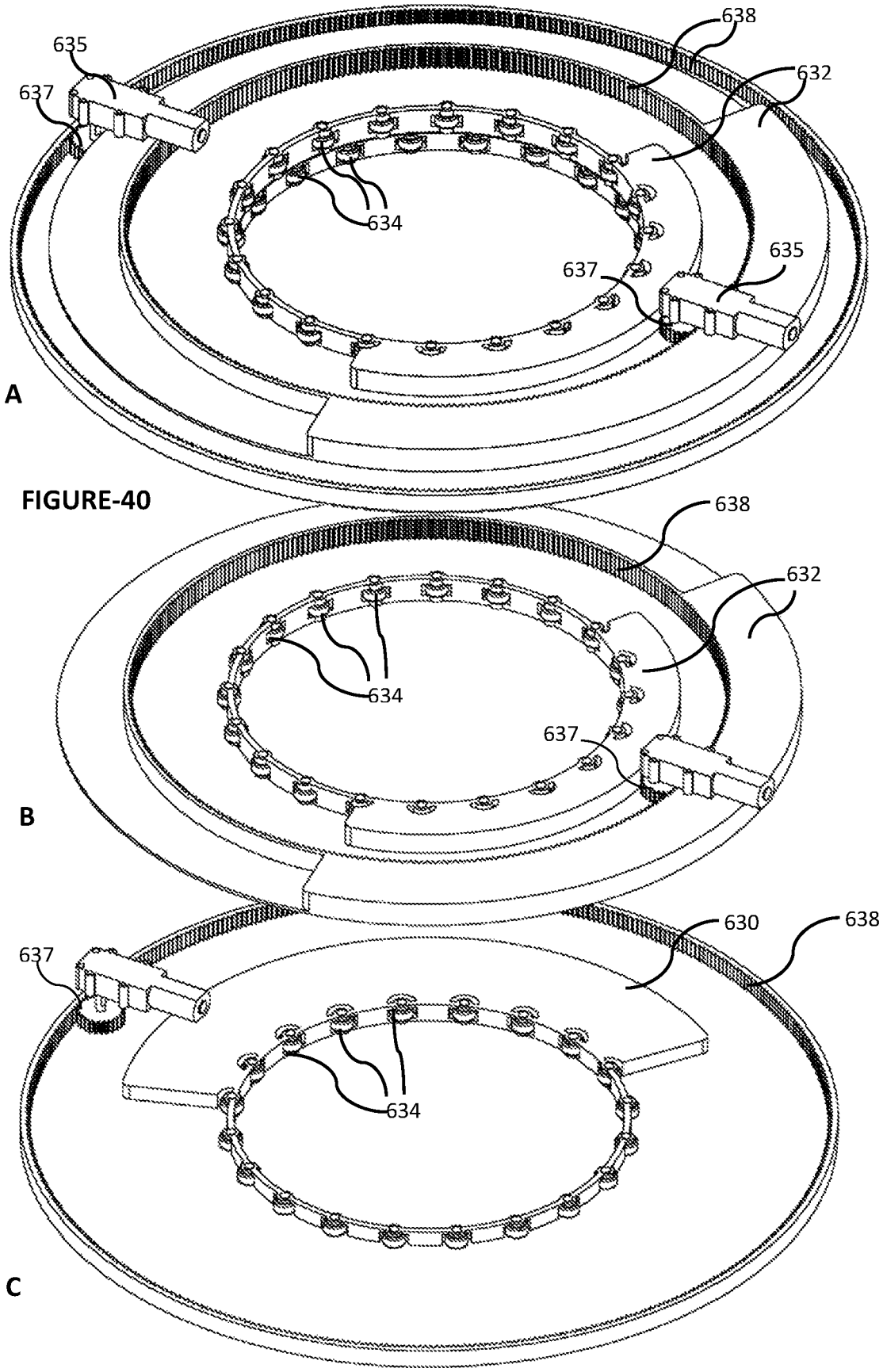

FIG. 40 demonstrates a perspective view of an example of (A) mounting of both weight parts along with motors having gears, (B) mounting of weight part closest to drum sheet along with motors having gears and (C) mounting of weight part farthest from drum sheet along with motors having gears in a two weight balance system mounted on the front of a household washing machine.

Figure 41:
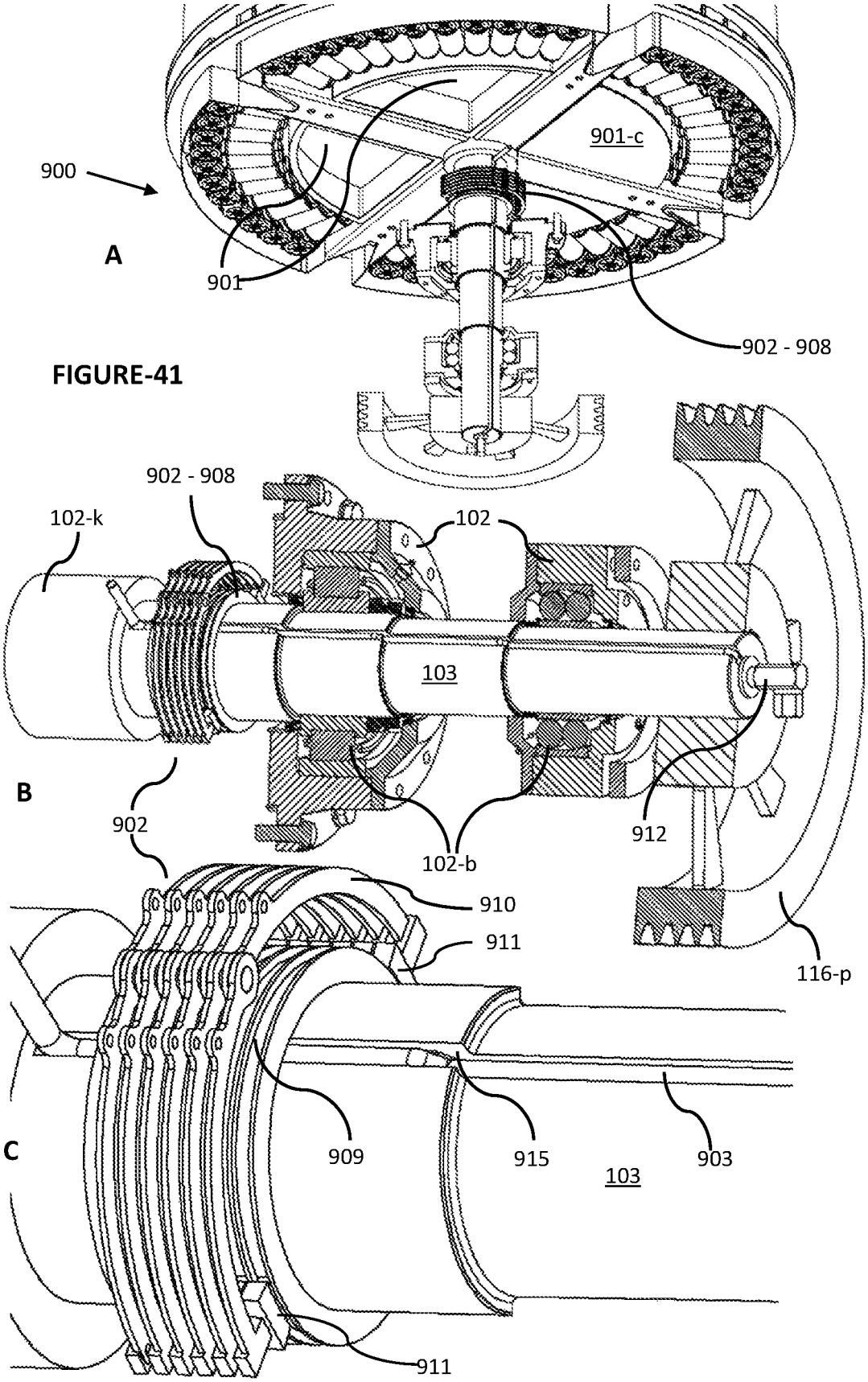

FIG. 41 demonstrates (A) a perspective view of an example of boards wherein materials and equipment that need to be placed in a board on a drum with and without a cover and a close up detailed perspective view of a slip ring ensuring that required communications for electricity and fluid transfer to the drum are realized via drum shaft and rotating fluid connection element (B) from a sectional view of bearing-pulley parts on the shaft and (C) slip ring and hose channel on the shaft.

DETAILED DESCRIPTION OF THE PREFERRED EMBODIMENTS

Explanation of the Principles of the Washing Machine Disclosed Herein Via FIGS. 1-17.

The figures illustrate a stone washing and spinning machine that is one of the important areas of application of the washing machine disclosed herein. As explained before one of the most important moving systems that are applied in the drum are rollers (201). Abrasive rollers (202) with grindstones are placed between lifter ribs (107) for stone washing. The rollers (201) can be rotated about their central axis between bearings placed on drum front circular base/opening side (109) and drum rear circular base/shaft side (110) of the drum sheet, at desired speeds via motors placed on drum rear circular base/shaft side (110) as in the front. A balance system (300) is mounted both on the rear along with the roller motors connected to moving parts (134) and on the front of the drum. The peripheral perforated narrow zone (510) is surrounded by a water chamber (500) on the sides, with its front and rear left uncovered. The front and rear sections of drum (104), which exist inside water tank/outer drum (101) in conventional machines, is removed from the tank by replacing the water tank in conventional machines with water chamber (500) that able to redesign using the system described in EP2229475. As described in this patent document, drum (104) has 10-20 times less number or size of holes in an interior cylindrical surface of the drum compared to conventional drums, and said drum perforations/holes (105) prevented from being blocked by the materials by protruding structures placed on or next to said holes. Said drum perforations/holes (105) are positioned below rollers (201) that also serve as protruding structures within drum (104). Therefore, even though the number of holes is low, the discharge of water from drum (104) is almost fixed at the desired flowrate. As drum perforations/holes (105) are not blocked by the materials, draining water flow through perforations in between the water barriers (122) on cylindrical perforated drum sheet (106), also described herein as an interior cylindrical surface of the drum, will flow through water chamber (500) to either the inlet of circulation pump (112) or to water storage chamber (504). Water, having flown from water chamber (500) to either the inlet of circulation pump (112) is pumped back into drum (104) via a circulation line in a controlled manner during the washing and rinsing cycles. The pumping capacity of said circulation pump (112) is higher than the flowrate of water exiting the drum, therefore water chamber (500) and water storage chamber (504) never overflows. As the front and rear of drum (104) are outside of the water chamber (500), these areas have no contact with water. Therefore different types of electric, pneumatic and mechanical systems other than motors directly connected to rollers (412), such as motor controlled balance systems (300) be mounted on the front and rear of drum (104), as can be seen from the figures. In the machine shown in FIG. 6 in exploded view, it is possible to separate drum (104) and fixed chassis (111) where drum rotation motor (115) is located and water chamber (500) with pumping system together with machine front panel (119) where drum door (118) is located from each other. Therefore the weights of drum (104) and the bearing system for drum (104), are lightened.

Preferred embodiments of the present washing machine disclosed herein are described below.

1. The Descriptions Commence with Water-Free Dry Zones (100) and Presence of Water-Free Dry Zones (100) Outside the Drum Via FIGS. 1-12, 16, 17.

One of the objects of the washing machine disclosed herein is to provide dynamism and different functionalities to a drum (104) of a washing machine (50) wherein a cylindrical shape perforated drum (104) is made from a stainless sheet, and for some applications only some parts may be made from plastic. So inner drum (104) is very basic, important and indispensable part of the conventional washing machine but also it is one of the simplest parts. Moving parts (200) drive with motors to move parts on the drum (130) by using energy such as electricity, pressurized air and steam, under control with electric, electronic, control systems (900) placed inside and/or outside drum (104) provide said drum (104), which is now more important part of a washing machine, with many new and useful functions that were previously unavailable. The control systems described herein include control circuitry. The control circuitry may include one or more processors executing logic or instructions stored in memory to perform the functionality described herein. The present washing machine disclosed herein effectively overcomes the disadvantages of the drum (104) being placed in a water tank/outer drum (101) full of water.

The question that the washing machine disclosed herein seeks to answer is how to prevent the presence of water in the regions of the movement transfer system (401) moving these moving parts outside drum (251) when there is enough water in the drum (104) and when the water in the drum is drained at the end of the washing and rinsing cycles and also during high speed extraction it is inevitable that the discharged water leaving the interior cylindrical surface of the drum from perforations and passes into the water tank/outer drum (101). The first solution to come to mind will be isolation.

On the regional isolated area in movement system (142) or isolated unit in movement system (143) basis, isolation is possible, but due to their restrictions the preferred method is to prevent the ingress of water into the areas where movements systems are located without isolation. In other words, to render areas required for movement system outside the drum (104) are water-free zones (100).

Drum (104), at least a part of the drum (104) taken out of the water tank/outer drum (101) and especially clearing water from areas where systems that are dangerous to be placed and operated in water are located has paved the way for many new useful possibilities and applications on the drum. Even though it is not necessary for the area where movement transfer system (401) is located to be free of water, it is preferable for the functionality and economy of the system.

In addition to being easier and more applicable than isolated areas in movement system (142) or isolated units in movement system (143), said method also makes it possible to use all kinds of mechanical, electric, electronic and control parts in movement systems (401) in the area between water chamber (500) for collecting water draining from the drum (104). In this manner, drum (104) is changed from a cylindrical perforated drum sheet (106) into a moving, dynamic and functional device, i.e., a machine by itself. It can be referred to as a machine, because even though the rotation of the drum stops, the systems on the drum can continue its operations which ensures that drum (104) remains functional.

2. Forming of Water-Free Dry Zones (100) in Water Chamber (500) by A Circulation Pump (112) is Explained Below Via FIGS. 1-3, 6-11, 13-17.

The areas that are always kept dry on drum outer surface (104-*s*) the drum are water-free dry zones (100).

Areas on drum outer surface (104-*s*) where water-free zone (100), i.e., the dry zone conditions cannot be obtained are areas where water drains from the drum. These areas can be determined as drum perforations/holes (105) part of drum inner surface (104-*n*) or interior cylindrical surface of the drum, allowing water discharge from the drum and the gap around drum opening between drum and front panel (114) around drum entrance/inlet opening (108) that needs to be left gap around drum opening between drum and front panel (114) in-between drum (104) which is the rotating part and the fixed part unless additional precautions are taken.

The function of outer drum, i.e., water chamber with the new shape (500), is not to fill the drum with water but to collect the water draining from the drum and direct it towards the water chamber drain outlet (503). Rather than a water tank/outer drum (101) wrap the drum completely, the water exiting drum (104) can be collected by water chamber(s) (500) placed only in areas where water discharge occurs.

It is clear that in order to turn necessary areas on drum outer surface (104-*s*) into water-free zones (100) by simple water chamber barrier (511), there needs to be enough water in the chamber on the other side of chamber barriers to not pass through the barrier due to pressure The systems according to the present washing machine disclosed herein prevent the water from passing into water-free zones (100) without need for using sealing elements such as gaskets or felts, even at the highest possible water level. Water build-up levels high enough to go over water chamber barrier (511) between areas containing water and water-free zones (100) and build-up of pressure enough to push water over should not be allowed. Structural water chamber barriers (511) are actually only barriers to direct water flow in order to keep the water in the desired area without overflowing.

To ensure that the areas required for the system outside the drum (104) are water-free zones (100), it was possible to implement the Eco-Drum system (61) as described in EP3252207 so that there was no water accumulated in the water chamber (500), outside the drum to reach the drum. According to the system explained in this document, the pumping flow rate is higher than draining flow from the drum (104) to the water chamber (500), will keep the water in the drum and keep at a desired level in the chamber that will prevent it from entering the water-free zones during the process requiring the presence of water in the drum. In other words to make sure that the water level stays low enough to prevent water from flowing into water-free zones using a circulation pump (112) having a pumping flowrate higher than the flowrate of the water flowing from drum (104) to water chamber (500), using the Eco-Drum system (61).

However, depending on the treatment operation, it may be necessary to reduce the amount of water in the drum without discharging the water from the machine. In this case, circulation pump (112) will also need to be stopped. When water in drum (104) has to be reduced or discharged as much as possible, there is a need for a storage space to store this water in the machine. This storage tank may be a water accumulation chamber (502) or a water storage chamber (504) connected to said water chamber (500). Water accumulation chamber (502) or water storage chamber (504) can be used to store water for a treatment operation of the machine as well as transferring water from one treatment operation to another. When a water accumulation chamber (502) or a water storage chamber (504) is present, the water level inside the drum can be changed in a controlled manner during the treatment operation. In addition, in case of a malfunction, all the water in the drum can be transferred to the storage space (502, 504) to prevent water from overflowing from water chamber (500).

For this reason, placing drum perforations/holes (105) in drum (104) at locations where they won't be blocked by the laundry material and reducing their number and diameter will allow circulation pump (112) required to drain the water in water chamber (500) or control the water level to have reasonable capacity and size and economic energy consumption. Reducing the number and/or size of drum perforations/holes (105) will make it possible to limit the flowrate of discharged water exiting the tank as desired. However, it is also important to ensure that the flowrate of discharged water exiting the tank is constant. Therefore, blockage of drum perforations/holes (105) designed to control water permeability by materials being treated in the drum must be prevented. In this case, drum perforations/holes (105) must be positioned so that the materials cannot reach and block them completely. To achieve this, either drum (104) must have a structure suited to preventing the materials from reaching drum perforations/holes (105), or drum perforations/holes (105) must be placed in the hollows between the protruding structures (261, 234, 240) placed on the surface of the drum or drum perforations/holes (105) must be placed in the effective area of the protrusions so that the materials cannot block most of the said drum perforations/holes (105). For drum (104) to have a structure suited to preventing the materials from reaching drum perforations/holes (105), the function of protruding structures (261, 234, 240) in drum (104), which may be described as channel members extending radially toward the axis of rotation of the drum, as described in an example by the Poly-Rib system (60) must be fulfilled by other parts on drum (104) surface. For example, drum perforations/holes (105) positioned beneath or in the effective area of rollers (201) inside drum, fixed grindstone pieces (216) and similar parts can ensure that drum perforations/holes (105) are open to water flow.

3. The Preparation of Water-Free Zones (100) on and Around the Drum Shaft (103) and Drum Rear Circular Base/Shaft Side (110) of Drum (104) According to the Present Washing Machine Disclosed Herein is Explained Below Via FIGS. 5, 6, 10-14.

When it becomes possible to form water-free zones outside drum (104), the first area to be considered will be drum shaft (103) and its surrounding drum rear circular base/shaft side (110). As is known, in washing machines having a perforated drum (104) inside an outer drum, flow of water out from water tank/outer drum (101) is prevented by sealing elements such as felt or gasket placed between drum shaft (103) and the outer drum. When the need for said sealing system is eliminated, drum shaft (103), which is the point of connection between drum (104) and the outer drum, sealing system around shaft can be canceled. Shaft will become free and the simplest way to transfer energy or fluids to the drum. In conventional washing machines as known in the art, water tank/outer drum (101) and inner drum (104) need to move together, be a part of the same system, in short, be connected to each other due to the sealing elements used therein. Whereas if contact of water within the tank with the drum shaft is prevented using methods other than felt, there will be no need to use sealing elements around the drum shaft (103), inner drum (104) and water tank/outer drum (101) can be separated from each other. The separation of drum (104) and water tank/outer drum (101) allows for radical changes in washing machine design. When there is no need for drum shaft (103) felts, drum (104) can be removed from outer frame chassis (120) and moved along with drum chassis (529). Therefore water tank/outer drum (101) in the form of water chamber (500) and machine cover and drum door (118) connected to water tank/outer drum (101) become an independent chassis. This will especially provide ease or production and maintenance of large industrial washing machines (51).

4. Moving Parts Inside Drum (250), Moving Parts Outside Drum (251), and the Techniques of Driving Said Parts Using a Movement Production Motor System (400), Movement Transfer Systems (401) and Electrical, Electronic, Control Systems (900) According to the Present Washing Machine Disclosed Herein is Explained Below Via FIGS. 1-12, 20-41.

Moving parts (200) mounted inside (250) and/or outside (251) drum (104) so that they can move in a controlled manner will increase the efficiency of the machine and therefore provide savings in resources such as water, energy, chemicals and time.

A function of the washing machine disclosed herein is providing controlled movement of said moving parts (200) by motors connected to moving parts (134) or via movement transfer systems (401).

Said moving parts outside drum (251) may be moved to rotate, oscillate or vibrate. As rotation is the easiest among these to apply and has the highest efficiency, rollers (201) providing rotational motion will be the most commonly utilized moving parts.

The most important advantage of rollers (201) driven directly by motors connected to moving parts (134) is that it allows rollers (201) to be rotated at desired speeds by controlling the speed of said motors connected to moving parts (134). Rollers (201) can be completely stopped when necessary and can be rotated at very high rotation speeds within the limits of motors connected to moving parts (134) and roller bearings (205) when necessary. For the moving parts (200) on drum to move in the desired way in a controlled manner, motor system (400), mechanical movement transfer system (401), electric and electronic control systems (900) need to be present on drum (104).

The system proposed by the present washing machine disclosed herein discloses methods for smooth operation of necessary equipment mounted on drum (104), referred to as "movement transfer system (401)" and comprising motors, pump, valves, pistons connected to drum (104) to provide controlled movement of moving parts (200) and electricity, pressurized air and steam system to use with them, movement transfer systems (401) such as pulleys, gears, belts, chains, etc., and related equipment such as sensors, control systems, electrical and electronic systems, cables, hoses and other connection equipment and auxiliary devices and electric system panels on drum (901) where these devices are placed.

5. The Moving Parts Inside of the Drum (250) which Increase the Physical Effect within the Drum (104) Presented in Accordance with the Present Washing Machine Disclosed Herein Will be Described Below Via FIGS. 3-12, 20, 21, 23-26.

All of the treatments done in drum (104) require physical effect and dynamism in varying degrees. This is the reason for the rotation of the drum. Increasing the movement within drum (104) will increase the efficiency and decrease the operation time of wet and dry treatment operations such as washing, dyeing, stoning, polishing and brushing.

The main function of moving parts inside of the drum (250) is to increase the physical effect provided by the rotation of the drum. For example, in a front-load washing machine (50) with drum the rubbing effect obtained by the friction between the materials and dropping materials from the top of the drum during the rotation of the drum will be increased by placement of brush rollers (203) in the drum. In addition, it also becomes possible to obtain physical effects that cannot be obtained only by the rotation of drum (104). For example, while it is not possible to impart a stoning effect to the material only by the rotation of drum (104) without adding abrasive materials into the drum of a stone washing machine, addition of moving abrasive parts in the drum will make this possible.

In this way, moving parts (200) added into drum (104) perform functions such as, mixing, shuffling, rubbing, fluffing, stoning and brushing the materials undergoing treatment in the drum.

6. Water Tanks According to the Present Washing Machine Disclosed Herein, Namely, Water Chamber (500), Water Chamber Surrounding Partially Perforated Cylindrical Drum Surface (501), Water Chamber Surrounding Around Whole Perforated Cylindrical Drum Surface are Explained Below Via FIGS. 1-17.

As the water level in water tank/outer drum (101) is controllable using the Eco-Drum system (61) described in EP3252207, the system of the present washing machine disclosed herein proposes a large storage volume under drum (104) where a certain amount of water may be collected, and all the water in the washing machine may be collected without coming into contact with drum (104) when necessary. As the water volume under drum (104) will be controlled by the system and can be drained by the pump, its size is irrelevant to the amount of water consumption. Until today, the main reason for the closed volume outside the drum to be referred to as water tank/outer drum (101) was that it was filled with water. However, in the system proposed by the present washing machine disclosed herein, the volume surrounding the drum should never be filled with water. Because these volumes are always empty and only serve the purpose of directing the water exiting the drum towards the discharge outlet, it is more appropriate to refer to said volumes as water chamber (500) instead of water tank/outer drum (101) to avoid confusion.

As discharged water exits interior cylindrical surface of the drum (104) from drum perforations/holes (105) and the gap around drum opening between drum and front panel (114) around drum entrance/inlet opening (108), it is possible to collect water exiting the drum by placing water chambers (500) at these areas if desired.

7. A Water Storage Chamber (504) in Communication with a Water Accumulation Chamber (502) Positioned in a Water Chamber (500) According to the Present Washing Machine Disclosed Herein is Explained Below Via FIGS. 3-7, 9, 13, 16, 17.

In contrast to conventional washing machines (50), it will be beneficial for a system according to the present washing machine disclosed herein to comprise a water accumulation chamber (502) below the water chamber (500) which has the capacity to store partially or all the water in the drum (104) when necessary.

This storage volume may be in the form of a water accumulation chamber (502) directly inside water chamber (500) or it may be a separate volume as water storage chamber (504) in communication with a water chamber (500) with a water chamber-water storage chamber connection (507) serving the function of collecting and storing water from drum (104) when necessary.

8. The Placement of a Portion of Drum (104) Outside Water Chamber (500) and Solution for the Problem about Steam that Coming Out from the Machine According to the Present Washing Machine Disclosed Herein are Explained Below Via FIGS. 1-9, 11, 14, 16-18, 24, 29, 32-34.

Placement of mechanical, electric, electronic devices and all auxiliary parts and equipment belonging thereto of movement transfer system (401) on drum (104) and/or moving parts system (141) outside drum in areas outside water chamber (500) will make it easier to provide periodic maintenance or repair services in case of malfunction.

Creating water-free zones (100) within water chamber (500) and preventing water entry to areas where moving parts (200) of moving parts system (141) outside drum and movement transfer system (401) are placed do not protect these areas from the effects of steam. As washing machines can provide services at temperatures above the boiling point of water when necessary, it is not possible to prevent steam from exiting the areas confining the water by water chamber barrier (511) and entering water-free zones (100 When steam condenses on the parts constituting movement transfer system (401), it is expected that it causes corrosive effects to said parts as well as many other problems. In this case, the steam coming out of the water chamber must be aspirate by a fan and removed from the machine properly. Solutions for this application are known from various examples in the art.

9. The Case where Water Chamber (500) is a Chamber Surrounding Whole Wet Parts of the Drum, I.E., Front and Sides Surfaces According to the Present Washing Machine Disclosed Herein is Explained Below Via FIGS. 6, 7, 12-14.

The water drain from the drum is from the drum inlet opening gap around drum opening between drum and front panel (114), except the drum perforations/holes (105) in the cylindrical perforated drum sheet (106).

When water chamber (500) for collecting the water leaving drum (104) is designed in a way to leave drum rear circular base/shaft side (110) outside (also described herein as rear circular base in the drum), it will be a water chamber close whole wet parts of the drum surrounding drum front circular base/opening side (109) (also described herein as front circular base in the drum) and perforated cylindrical perforated drum sheet (106) as exemplified in the figures. In terms of design and appearance, said water chamber resembles a customary half water tank/outer drum (101) without a rear sheet. So from now on this water chamber surrounding whole wet parts of the drum will be referred to as a half water chamber (505)

Said half water chamber (505) must contain water chamber barrier (511) systems designed to prevent water flowing from drum (104) to water chamber (505) at the edge portion at drum rear circular base/shaft side (110) from leaving half water chamber (505).

10. Water Chamber Around Drum Opening Gap (506) at Around the Drum Gap Around Drum Opening Between Drum and Front Panel (114) Around Drum Entrance/Inlet Opening (108) According to the Present Washing Machine Disclosed Herein is Explained Below Via FIGS. 5, 8, 15 47 49, 50.

If a moving parts system (141) outside drum is present on drum front circular base/opening side (109), it would be advantageous for this section to be a water-free zone (100) as well. To achieve this, a water chamber around drum opening gap (506) formed to surround drum gap around drum opening between drum and front panel (114) around drum entrance/inlet opening (108) can collect the water exiting from said drum opening and directing it to water chamber surrounding partially perforated cylindrical drum surface (501) or a water accumulation chamber (502) via a water chamber-water storage chamber connection (507) pipe connected below.

Dividing water chamber (500) into a water chamber around drum opening gap (506) for collecting water exiting from drum opening gap around drum opening between drum and front panel (114) and water chamber surrounding partially perforated cylindrical drum surface (501) for collecting discharged water exiting drum perforations/holes (105) provides a practical solution to the problem of taking drum front circular base/opening side (109) out of water chamber (500) like drum rear circular base/shaft side (110). In this way, when the water chamber (500) is divided into two sections (501, 506), the area left between will be a water-free zone.

Using water chambers (500) mounted only onto areas where water exits the drum instead of a water tank surrounding the entire drum will both make it easier to provide service to the outside of the drum and save on materials and labor for producing said water tank and make the washing machine lighter.

If the machine to which a system as exemplified in FIG. 15 is applied is an industrial washing machine (51), it is possible for the exiting water to be pumped directly back into the drum by a drum opening water collection chamber circulation pump (528) connected to the household drum opening water chamber (615) outlet instead of connecting water chamber or other tanks.

11. Water Chamber Surrounding Partially Perforated Cylindrical Drum Surface (501) Surrounding the Portion of the Drum where Drum Holes are Located According to the Present Washing Machine Disclosed Herein is Explained Below Via FIGS. 3, 5-9, 15, 16, 21, 22.

When a water chamber surrounding only perforated cylindrical drum surface (501) is placed in the area where drum perforations/holes (105) are located, the water exiting from said drum holes can be directed to circulation pump (112) pumping the water directly back to the drum or a water storage chamber (504) via a water chamber drain outlet (503). With this design, water tank/outer drum (101) that consisted of one piece until today will be divided into two or, necessary, more sections referred to as water chamber surrounding partially perforated cylindrical drum surface (501). In this manner, the cylindrical sheet of the drum will be a cylindrical drum sheet peripheral perforated narrow zone (510) wherein said drum perforations in peripheral zone (509) are placed in peripheral perforated narrow zone (510) will have the appearance of a cylindrical sheet without holes. Water chamber surrounding partially perforated cylindrical drum surface (501) for water exiting from drum holes can be placed around the middle, front or rear of cylindrical drum sheet perforated in the peripheral perforated narrow zone (510). In this case, as drum perforations in peripheral zone (509) will be only in this area, it must be ensured that the water in the drum flows towards this area.

A flow path on water chamber (508) may be formed by structural obstacles and barriers to prevent water from overflowing outside from between water chambers surrounding drum opening and drum holes and the drum. Overflow of the water flowing from drum (104) to water chambers surrounding around partially perforated cylindrical drum surface (501) from said water chamber limits can be blocked by a water chamber barrier (511) placed on water chamber surrounding partially perforated cylindrical drum surface (501) and corresponding external water barriers (122) placed on the drum. The function of the barriers on water chamber surrounding partially perforated cylindrical drum surface (501) is to prevent water at the bottom of the tank from overflowing into water-free zones (100) of water chamber surrounding partially perforated cylindrical drum surface (501) and overflowing out of water chamber surrounding partially perforated cylindrical drum surface (501). The function of external water barrier (122) placed on the drum is preventing water exiting the drum from overflowing past water chamber barrier (511) while being flung by the rotation of drum (104) during the spin cycle and wetting every surface of flow path on water chamber (508) in water chamber (500). Water barriers may be positioned in single lines opposite each other and side by side or they may have a multiple cascading structure in the form of successively positioned sets.

12. Use of a Discharge System to Prevent Steam/Gas Leaking from the Water Chambers According to the Present Washing Machine Disclosed Herein is Explained Below Via FIGS. 1, 2, 8, 16, 17, 19, 21.

It has been mentioned above that by taking water-free zones (100) out of water tank/outer drum (101) or water chamber (500) devices placed in these areas (400-900) are protected from negative pressure effects caused by the steam generated due to the high water temperature in the drum. Also some of the washing processes need to inject harmful gas into the drum. We have to avoid also uncontrolled gas leakage from water chambers. However, as structural barriers preventing water drain or leakage do not prevent steam or gas leakage, steam and gas will continue to leak out of drum (104) and water chambers (500) having water-free zones (100).

With additional measures to be taken it is possible to prevent steam and gas leaking out from of water chambers (500) and entering into water-free zones (100) also means surroundings from wet zones through water chambers (500).

The hot air, steam and also gas exiting from drum perforations/holes (105) or drum entrance opening will go into water chamber (500). In machines where water tank/outer drum (101) is completely closed off, steam is discharged via a ventilation flue at the top of water tank/outer drum (101). It is possible to place a similar steam/gas flue outlet from water chamber (513) on the top section of water chambers (500). Water chamber (500) surrounding drum (104) being open to the atmosphere around the periphery of drum (104) does not impose of all steam outflow occurring from said steam/gas flue outlet from water chamber (513).

13. The Formation of Water Channels/Poly-Channels (524) within Drum (104) According to the Present Washing Machine Disclosed Herein are Explained Below Via FIGS. 2,16, 18, 19, 27, 29.

A problem that needs to be solved is ensuring that water flows from non-perforated regions of drum (104) towards where drum perforations in peripheral zone (509) are located at a constant flowrate that is suitable to the discharge flowrate.

A solution to this problem is forming water channels/Poly-Channels (524), also referred to as channel members extending radially toward the axis of rotation of the drum, on the conical drum sheet perforated in the narrow belt zone (512). Water will flow through water channels/Poly-Channels (524) without coming across any obstacles in drum (104) according to the system described in EP2229475, as explained above. This system preferably comprises a water channel grate (526) forming water channels along the drum inner surface (104-*n*) of cylindrical or conical drum (512) which are parallel to or make an angle with the rotation axis of drum (104) using Poly-Ribs/protrusions//sheet bar/grate bars (525) made of metal or plastic protrusions. Said water channels/Poly-Channels (524) are comprised of water channel grates (526) placed on drum outer surface (104-*s*) or plastic or metal conically molded roller housing (240) parts. Water flows towards the area where drum perforations in peripheral zone (509) though said water channels/Poly-Channels (524). In a conical drum sheet perforated in the narrow belt zone (512), flowrate increases with degree of the conicity of the conical drum sheet perforated in the narrow belt zone (512).

14. Discharging Water from Drum (104) Via Drum Discharge Chamber (517) and Drum Discharge Chamber Water Discharge Valve (519) to Create Completely Closed Drum According to the Present Washing Machine Disclosed Herein is Explained Below Via FIGS. 8, 16, 21, 22.

When water is discharged from drum (104) as discharged water through drum perforations in peripheral zone (509) on a peripheral perforated narrow band zone (510) an important embodiment is made possible. The aim of trying to collect a large portion of the water draining drum (104) back inside the drum by pumping said water back into the drum using a circulation pump (112) having a greater flowrate capacity than the drain flowrate of water from the drum is to save water and chemicals in the water by using them only in the drum. In fact, drum (104) could simultaneously be used as a water tank/outer drum (101) and the outlet of the water therein could be opened and closed as desired, and the problem will be solved at the source. In other words, when drum (104) is simultaneously used as a water tank/outer drum (101), there will be no need for water to be present outside the drum. The present washing machine disclosed herein makes this possible. As exemplified in FIGS. 16C, 21 and 22, when a drum discharge chamber (517) completely surrounding the where drum perforations in peripheral zone (509) on a peripheral perforated narrow band zone (510) on drum outer surface (104-*s*) on drum (104) and covering and sealing said holes, the water exiting from said drum perforations in peripheral zone (509) will enter and collect in said drum discharge chamber (517). Said drum discharge chamber (517) will cover the areas where the holes are located by creating a small volume on the conical drum sheet perforated in the narrow belt zone (512). Water exiting drum perforations in peripheral zone (509) will flow to drum discharge chamber (517). When the outlet from drum discharge chamber (517) is closed, drum water will be collected in the drum. However, as the volume of the discharge chamber is markedly smaller than water chamber (500) and the circulation system, the amount of water present in drum discharge chamber (517) during washing will not affect the targeted water saving values. In case water outflow from drum opening gap around drum opening between drum and front panel (114) in between drum and front panel is prevented by fully covering drum entrance/inlet opening (108) with a rotatable door (533, 542) or pumping the water exiting from drum opening gap around drum opening between drum and front panel (114) back into the drum using a drum opening water collection chamber circulation pump (528) having a suitable capacity, it will be possible to confine the water inside drum (104) during washing. The solution provided for connecting drum (104) and water chamber (500) by mounting moving parts outside drum (251) on drum (104) is opening a drum discharge chamber water valve opening (518) in the drum to allow water outflow from drum (104). For this, one or more drum discharge chamber water discharge valves (519) need to be placed around drum discharge chamber (517). FIG. 22 shows drum discharge chamber water discharge valves (519) of drum discharge chamber (517) for collecting drum water in the drum in closed position. Said drum discharge chamber water discharge valves (519) mounted on drum discharge chamber (517) can be opened and closed using an electric motor or a pneumatic piston of drum discharge chamber discharge valve (520) of drum discharge chamber discharge valve (519).

In this way, as the drum becomes a fully closed system during washing operations, the highest water savings can be reached.

A preferred result of the washing machine disclosed herein is mounting moving parts inside the drum (250) that are driven by a movement transfer system (401) which is mounted outside the drum in order to create a physical effect and enhance the physical effect imparted by the movement of the drum on the materials being treated in the drum.

15. Rollers (201) Inside the Drum (104) According to the Present Washing Machine Disclosed Herein are Explained Below Via FIGS. 4-12, 20, 21, 23, 24, 26.

Moving parts inside drum (250) to change the physical effect provided inside the drum are rotating parts whose rotation speeds can be adjusted according to the treatment operation. There are obvious technical advantages and practical application areas provided by choosing the rotating parts to be rollers (201) that are placed lengthwise inside the drum. Because rollers (201) which are placed onto cylindrical perforated drum sheet (106) side by side covering the inside of the drum can be rotated at desired speeds or not at all as required, the provide the dynamism that is the object of the washing machine disclosed herein.

Rollers (201) placed in-between roller bearings (205) located at drum rear circular base/shaft side (110) on the drum shaft (103) side and at drum front circular base/opening side (109) on the drum door (118) side, parallel to the rotation axis of the drum can be rotated in the desired direction or oscillate within predetermined angular limits, at the desired speed for the desired length of time by movement transfer system (401) mounted on the front or rear circular base surface of the drum to create or enhance the physical effect required by the ongoing treatment operation within the drum.

16. A Brushing Machine and Brush Rollers (203) Inside Drum According to the Present Washing Machine Disclosed Herein is Explained Below Via FIG. 23.

A good example for fully rotating moving parts are abrasive rollers (202) placed inside the drums of industrial stone washing machines (54). However, if brush rollers (203) are used as rotating parts inside drum, new treatment operation applications that were not possible to achieve with conventional washing machines will become available.

Round brush rollers (203) will provide different stoning effects on the materials that are not possible to obtain by abrasive stones.

Round brush rollers (203) shown in FIG. 23 can be used for creating surface effects such as felting and wearing down on textile products, as well as for cleaning rubber mats or similar hard and semi-hard materials by brushing during washing.

Brush rollers (203) will be especially useful for washing heavily stained and dirty materials such as work uniforms and table cloths. Using brushes having a special surface structure along with chemicals will provide faster and more effective cleaning.

Moving parts inside drum (250), which can be controlled in a controlled manner in the desired speed, with abrasive characteristics, make the systems described by the present washing machine disclosed herein optimized for stone washing applications.

The desired abrasion effect on the textile can be achieved even if there are no additional abrasive materials inside the drum by covering the surface of moving abrasive parts (260) mounted on drum inner surface (104-*n*) with abrasive materials, mechanically or chemically treating the material constituting the surface of said moving abrasive parts (260) to impart abrasive character or choosing an abrasive material such as grindstone as surface material for said moving abrasive parts (260).

One of the most important embodiments of the washing machine disclosed herein is having moving abrasive parts (260) mounted on drum inner surface (104-*n*) be in the form of abrasive rollers (202).

It is also advantageous for the material constituting the surface of abrasive rollers (202) to be grindstone pieces (207).

When the surface of roller (201) is covered by an abrasive material to obtain abrasive rollers (202), both the material undergoing treatment and the abrasive material will be worn down in time.

Moving parts inside drum (250) may be in the form of vibrating parts (222) vibrating on a linear plane. The movement of grindstones mounted on drum inner surface (104-*n*) instead of fixed grindstone pieces (216) will contribute to the dynamism desired to be created inside drum (104).

In this way, vibrating parts (226-260) having abrasive feature placed between abrasive rollers (202) will contribute to the stone washing treatment process. It is known that eccentric movements are not as efficient as rotating systems in terms of mechanism and energy consumption. In spite of this, providing different abrasive movements inside drum (104) will provide many options to achieve the desired effect on the material.

17. The Electrical Drive Motor on Drum (132) and Moving Systems (200) According to the Present Washing Machine Disclosed Herein are Explained Below Via FIGS. 3, 5-8, 13-15, 16, 17, 18, 31, 42B.

One of the most important gains of the washing machine disclosed herein is, of course, that it makes it possible to mount the electrical drive motor on drum (132) directly on the drum (104). Electrical drive motors on drum (132) that provide movement for moving systems (200) on the drum can work with electricity or pressure air.

It is clear that in order to provide movement to moving parts placed inside and/or outside the drum (200, 250), movement acquired from a drive source, namely a motor, must be transferred to said parts. Related systems may be exemplified by the following three embodiments.

18. The Balance System and Moving Parts Providing Balance During the Spin Cycle According to the Present Washing Machine Disclosed Herein are Explained Below Via FIGS. 1, 2, 5-8A, 21, 27-40.

One of the most important aspects of the washing machine disclosed herein is the balance system.

One of the main issues of washing machines (50) performing high speed spin extraction cycles is that when drum (104) enters the high spin extraction, the material that is unbalanced distributed therein causes oscillations at low spin speeds and vibrations at high spin speeds. Actually, "dynamic balance system" technique has been known and used for many years in "dynamic balance machines" wherein measurements are taken for allowing addition of balance weights to eliminate balance problems. It is clear that in order for the dynamic balance system to be applied to the drum; electrically controlled moving mechanical systems must be mounted outside said drum. The present washing machine disclosed herein has made it possible to directly mount a dynamic balance system onto the drum by providing electrical connections and water-free zones (100) on the drum whereby balance weight movement motors (306), moving system and parts together with control systems can be mounted onto said drum. Another difficulty in applying balance systems to washing machines having a conventional water tank/outer drum (101) and drum (104) system was the mechanical moving interaction between said water tank/outer drum (101) and drum (104). Separating drum (104) from water tank/outer drum (101) eliminates this problem and makes it possible to measure unbalance conditions directly from inner drum and apply the dynamic balance technique directly to the system. The system proposed by the washing machine disclosed herein provides water-free zones (100) where balance system (300) can be mounted, which have made it much simpler to use said system.

So it is possible to move balance weights at a position to create counter force against unbalance force occurred by unbalanced weight distribution on the drum. The balancing system applied to the drum is essentially a controlled movement of at least one counterweight to compensate for imbalance.

Connecting an electrical drive electrical drive motor on drum (132) controlled by electric, electronic, control systems (900) will make it possible to apply best known methods of providing balance to the drum. In this way, the drum of washing machine (50) with drum will become a "dynamic balance machine" by itself. While current dynamic balance machines determine the position and magnitude of the imbalance and provide information on the position and magnitude of weight needed to be added/removed to balance said imbalance and leave the rest up to the operator, the present washing machine disclosed herein provides a system where correction of the imbalance is performed by said balance system during the spin extraction cycle.

It will be possible to move balance weights (301) having different structures and properties placed on drum front circular base/opening side (109) and drum rear circular base/shaft side (110) in different ways in a controlled manner to restore the balance and maintain the balance by changing the positions of balance weights (301) during the spin cycle It is clear that different application methods can be found for providing a counterweight to balance the unbalanced load distribution by changing the positions or creating the mass of balance weights (301) at both drum front circular base/opening side (109) and drum rear circular base/shaft side (110). Balance weights (301) normally placed on drum front circular base/opening side (109) and drum rear circular base/shaft side (110) or on the front and rear of cylindrical perforated drum sheet (106) to balance each other out will be moved by balance weight movement motor (306) in order to balance the imbalance in drum (104). Therefore, at last one balance weight (301) each must be present on either side of drum (104).

The mechanical balance system (300) described by the present washing machine disclosed herein comprises essentially of a balance control system (300-C) and at last one balance weight system (301-W) placed on drum. Balance system (300) may comprise one or two balance weights (301). In cases where there are balance systems (300) on both drum front circular base/opening side (109) and drum rear circular base/shaft side (110), it will be understood that four balance weights (301) are present. Each balance system (300) comprises at least one balance weight (301), balance weight handling and rotation structure (308) whereby said balance weight (301) is carried and rotated, a balance weight movement motor (306) to provide rotation and a movement transfer system for transferring this rotation motion. Each balance system (300) is capable to rotate around the rotation axis at least one balance weight (301) to a position to provide balance of the drum. Said balance weight movement motor (306) may be an electrical, pneumatic or other type of motor.

All balancing system examples given in the descriptions and figures are for horizontal, front-loading and rear-shaft-bedding drums of washer-extractor machines. However, it should be noted that the explained balancing system as described will be applied to the horizontal side loading washer-extractor machine with two shaft on both side or to the vertical top-loading drums mounted via shaft-bedding on the lower side of the washer-extractors machines or the centrifuge type spin machines used only for extraction.

19. The Movement of Balance Weights (301) According to the Present Washing Machine Disclosed Herein is Explained Below Via FIGS. 1, 2, 5-8, 21, 27-40.

In the exemplary balancing system (300), the two balance weights (301) on each side of the drum (104) are mounted on balance weight handling and rotation structure (308) so that the two balance weights are positioned in the home position to compensate each other mutually. Except from the balancing process, their masses are good to create equal centrifugal force when they are mutually positioned against each other. Therefore, there is no imbalance effect created by these weights in all other washing processes. The two balance weights (301) have their own movement systems with a balance weight handling and rotation structure (308) driven by separate balance weight movement motor (306) so that they can move independently around their own path. Said balance system may be positioned on drum front circular base/opening side (109) and/or drum rear circular base/shaft side (110) or on the front and/or on the rear of cylindrical perforated drum sheet (106) so that the axis of rotation of drum (104) is also the axis of rotation of balance weights (301).

Figure 1:
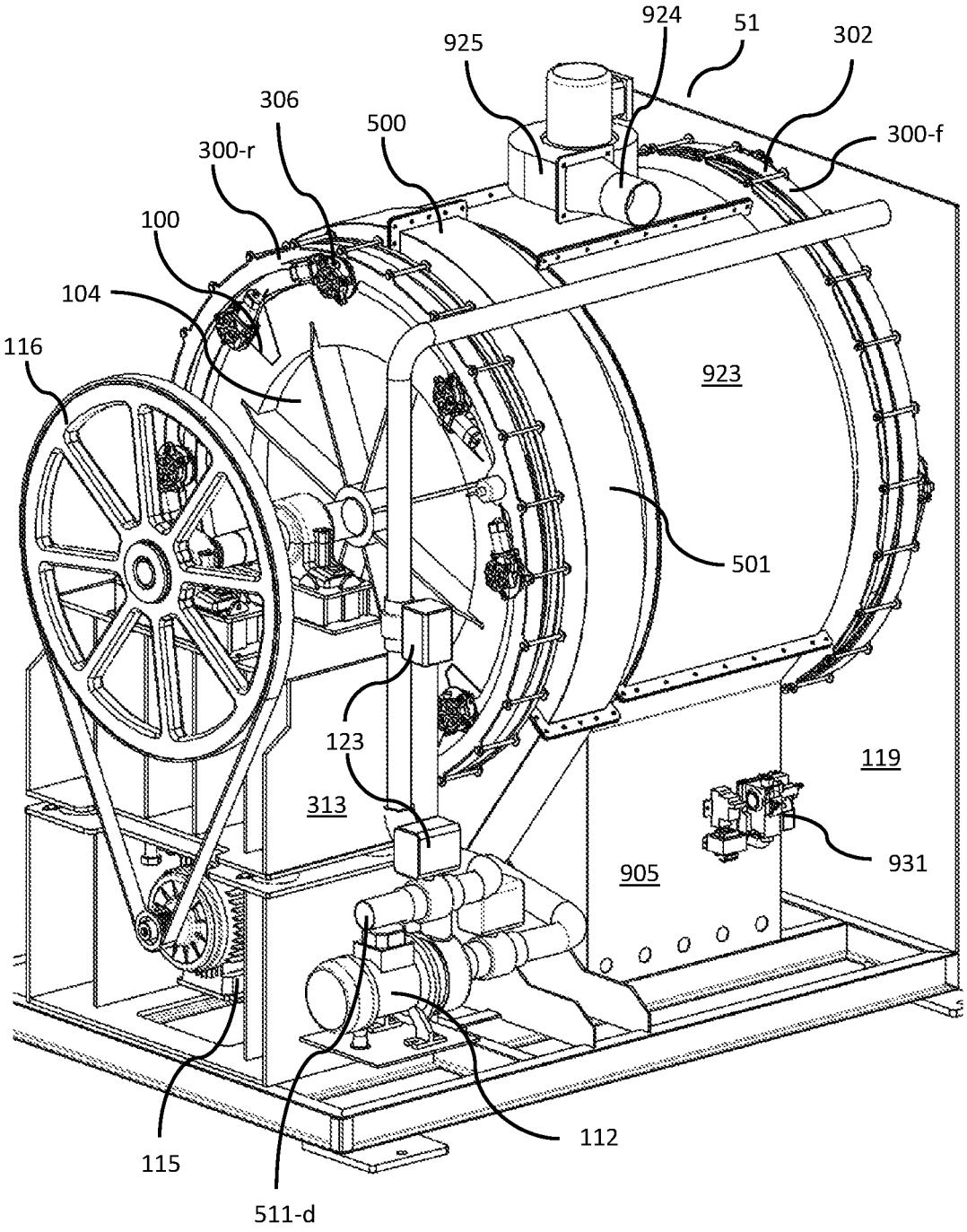
FIG. 1 demonstrates a rear perspective view of an example of a midsize industrial washing machine having a two-weights balance system applied around cylindrical drum surface at both side of the drum and drain system through water collection chamber with circulation pump and having direct heating gas combustion chamber.
Figure 2:
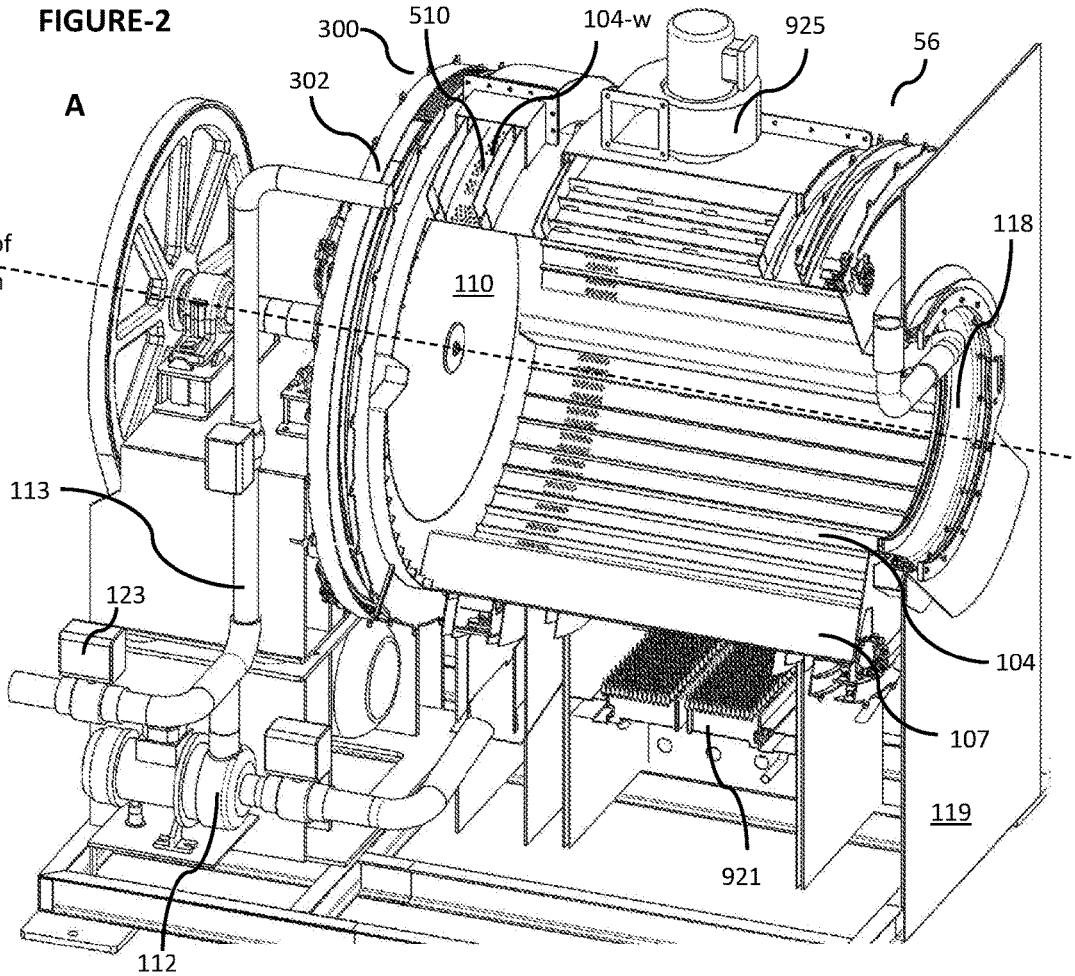
FIG. 2 demonstrates a (A) side sectional and (B) close up view of an example of a midsize industrial washing machine having a two-weights balance system applied around cylindrical drum surface at both side of the drum and drain system with poly-ribs through water collection chamber with circulation pump and having direct heating gas combustion chamber.
Figure 2:
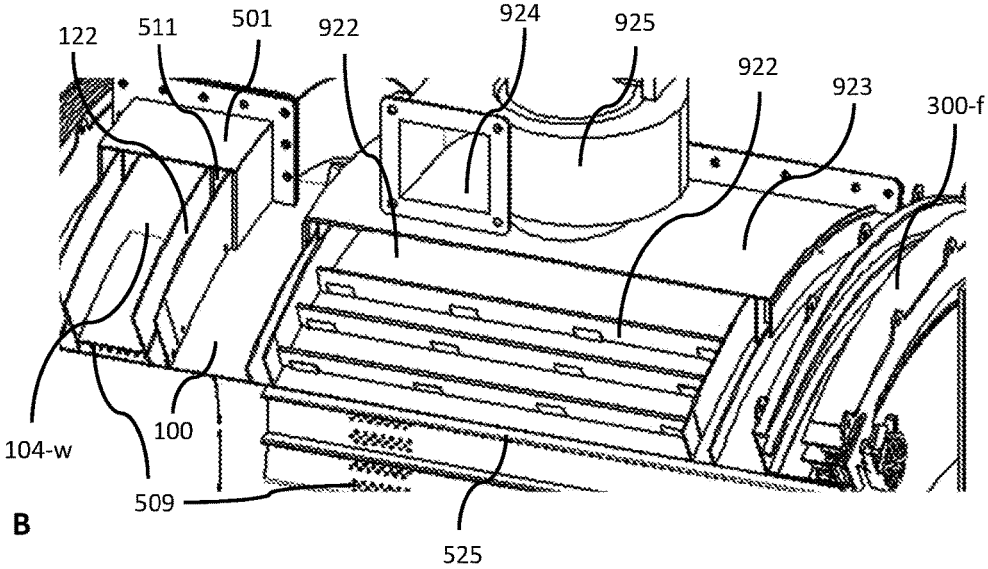
Figure 3:
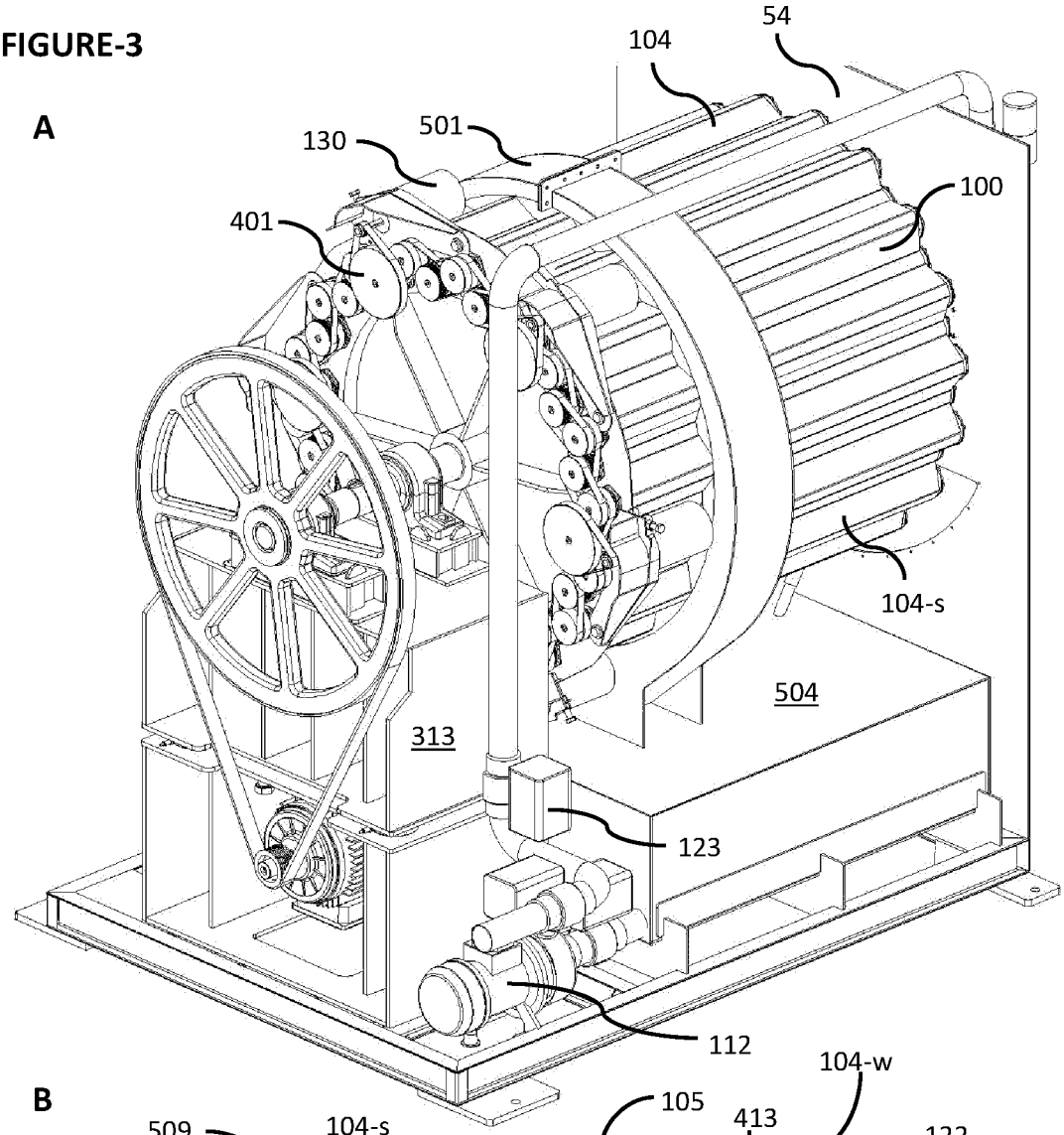
FIG. 3 demonstrates a (A) rear perspective and (B) close up view of an example of a midsize industrial abrasive roller stoning washing machine with abrasive rollers in the drum driven by motors in groups and having a drain system through water collection chamber and water storage tank with circulation pump.
Figure 3:
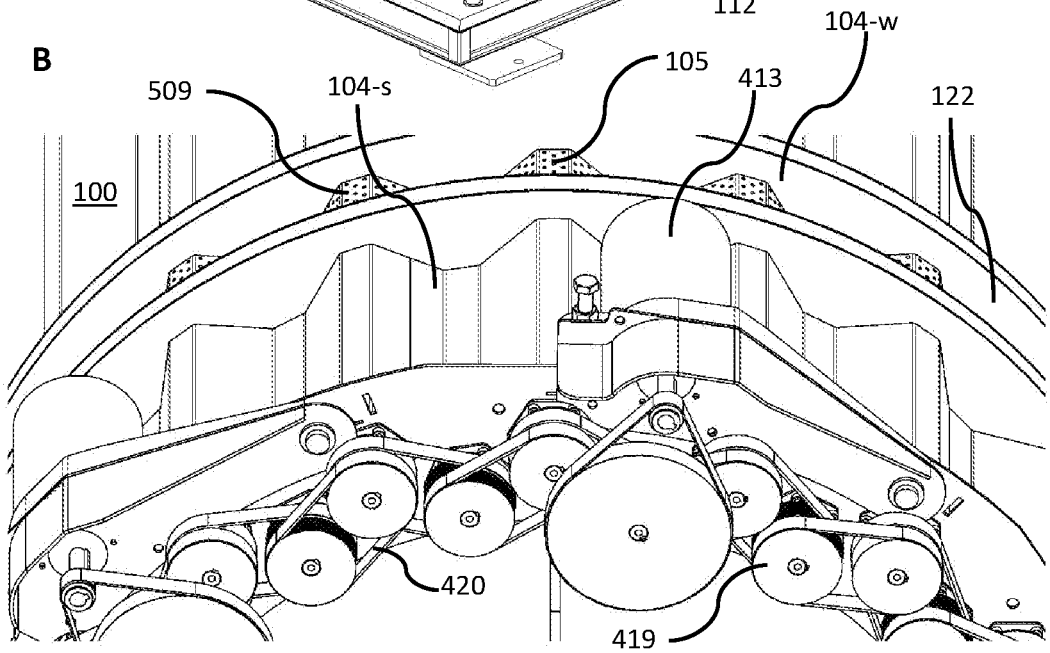
Figure 5:
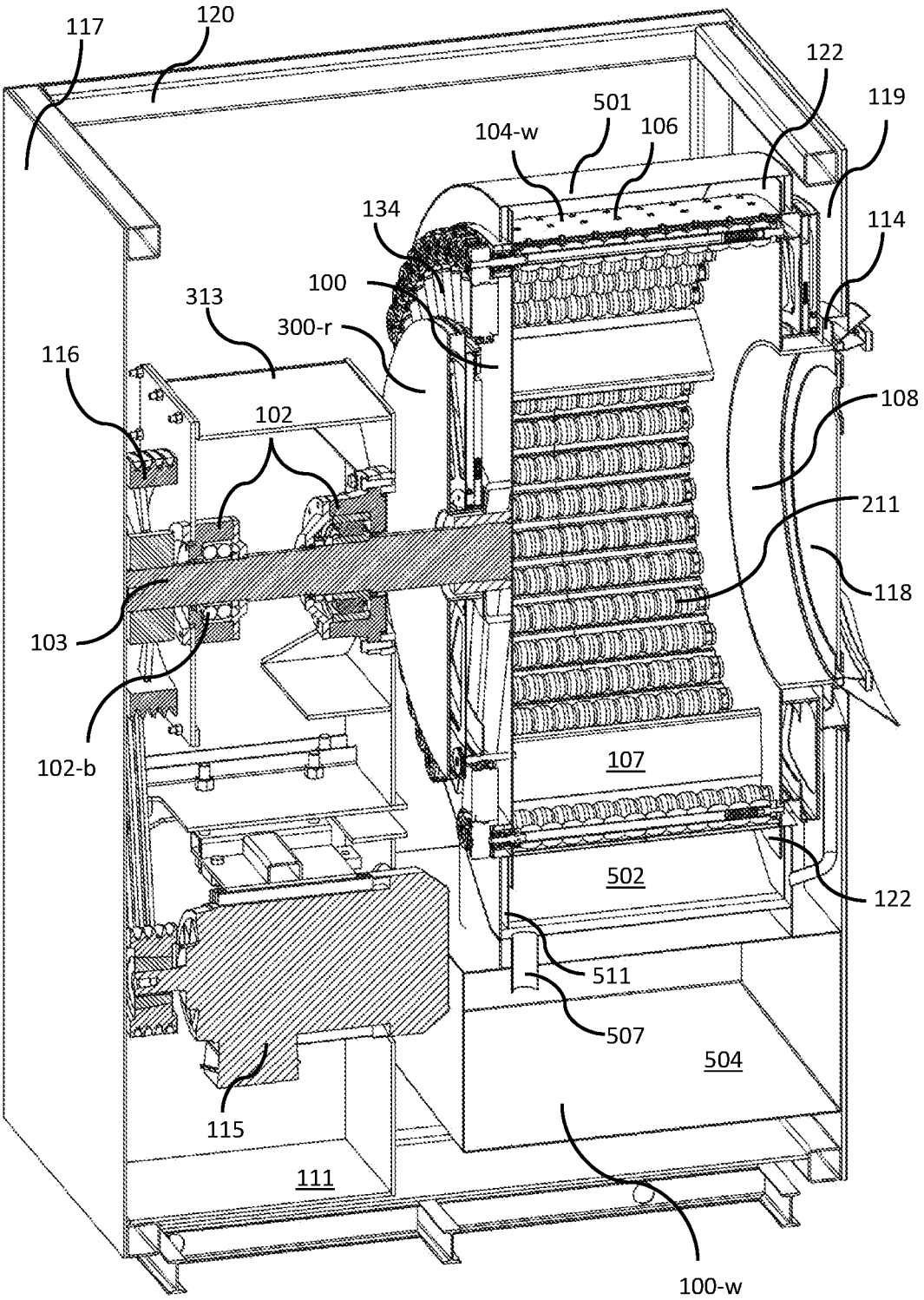
FIG. 5 demonstrates a sectional view of an example of a midsize industrial washing machine having buckled grindstone of rollers driven by separate motors and a two-weights balance system placed on both circular base of the drum and rotate in a water collection chamber surrounding cylindrical perforated drum surface and water storage tank with circulation pump.
Figure 6:
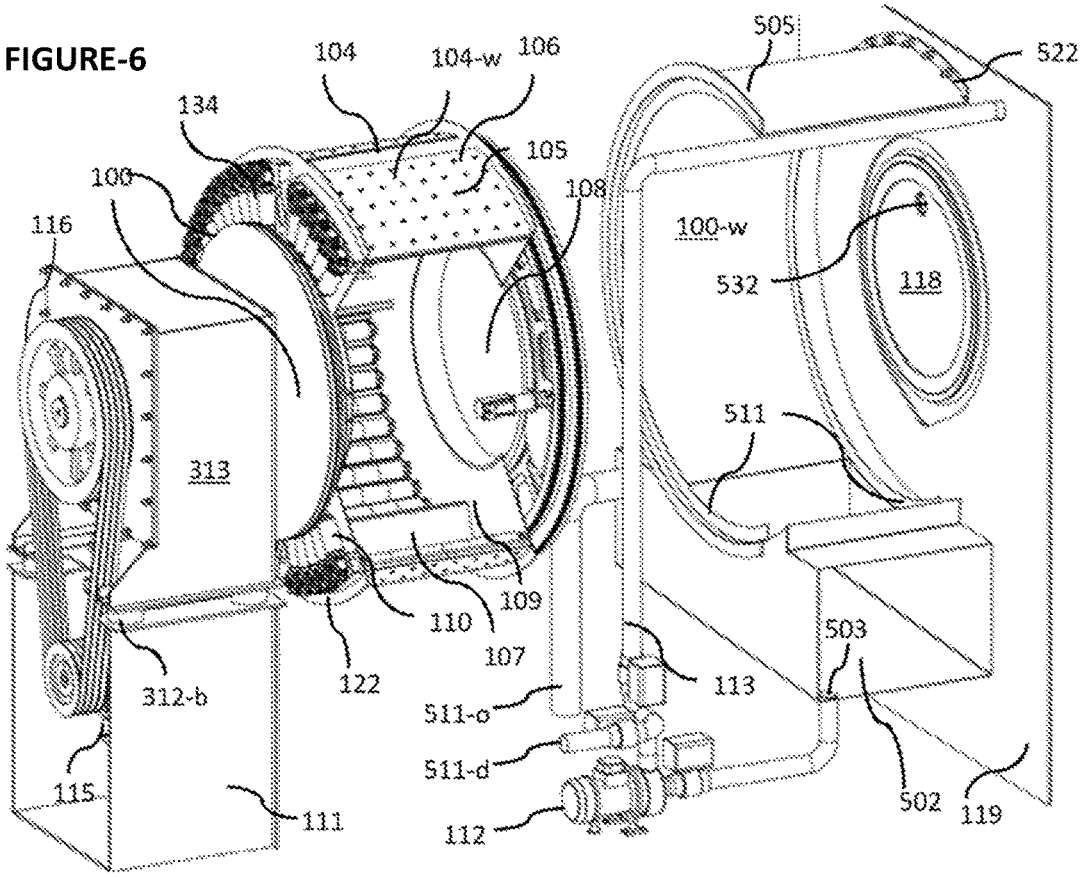
FIG. 6 demonstrates an exploded sectional view of an example of a drum in a water collection chamber surrounding cylindrical perforated drum surface and water storage tank with circulation pump also having abrasive rollers and a balance system placed on both circular base of the drum.
Figure 7:
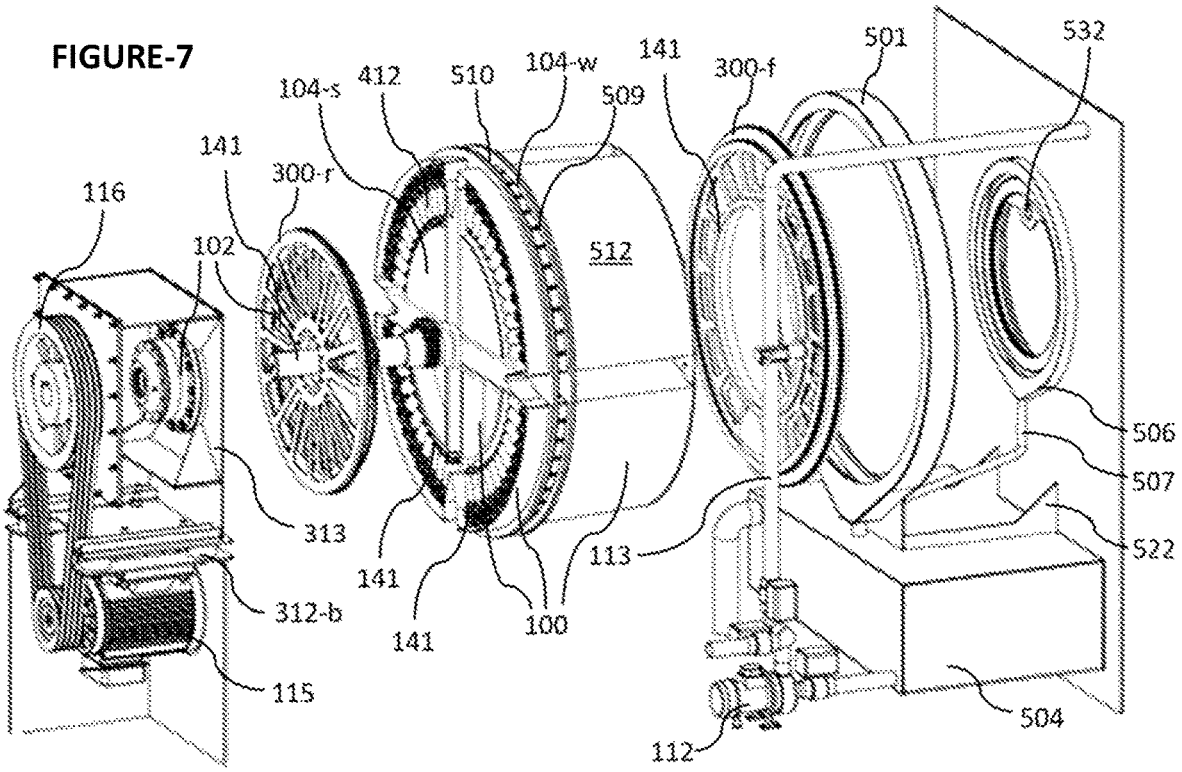
FIG. 7 demonstrates an exploded side view of an example of a drum chassis, a rear balance system, a conical stone washing drum having abrasive rollers with perforations in a narrow zone of the drum surface, a front balance system, a water collection tank and a water storage tank.
Figure 9:
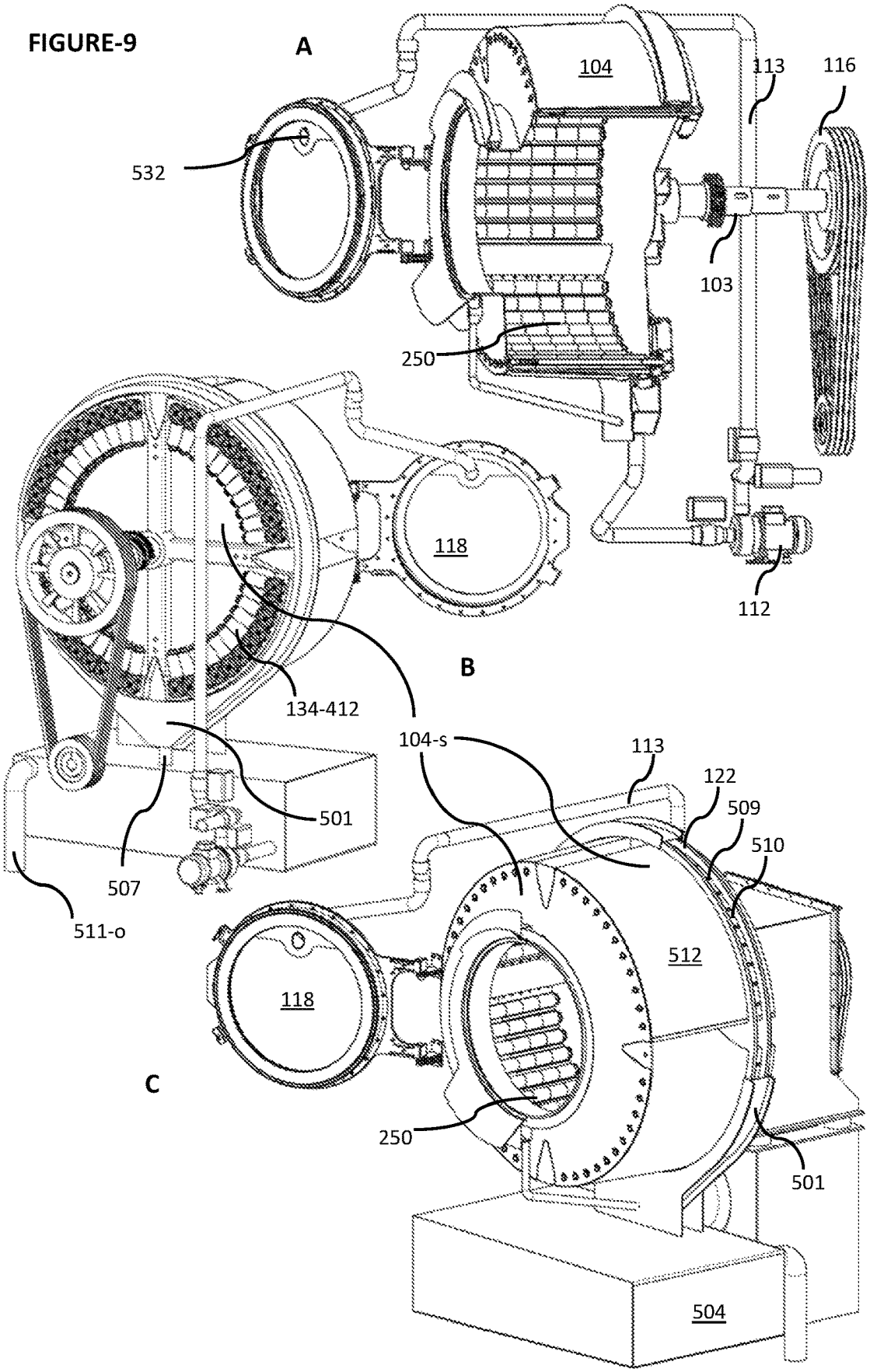
FIG. 9 demonstrates (A) an example of a drum sectional view, (B) an example of a water storage tank rear perspective view and (C) an example of a water storage tank front perspective of a conical stone washing drum having abrasive rollers driven by separate motors with holes in a narrow zone and circulation pump and circulation line of narrow water collection chamber.
Figure 10:
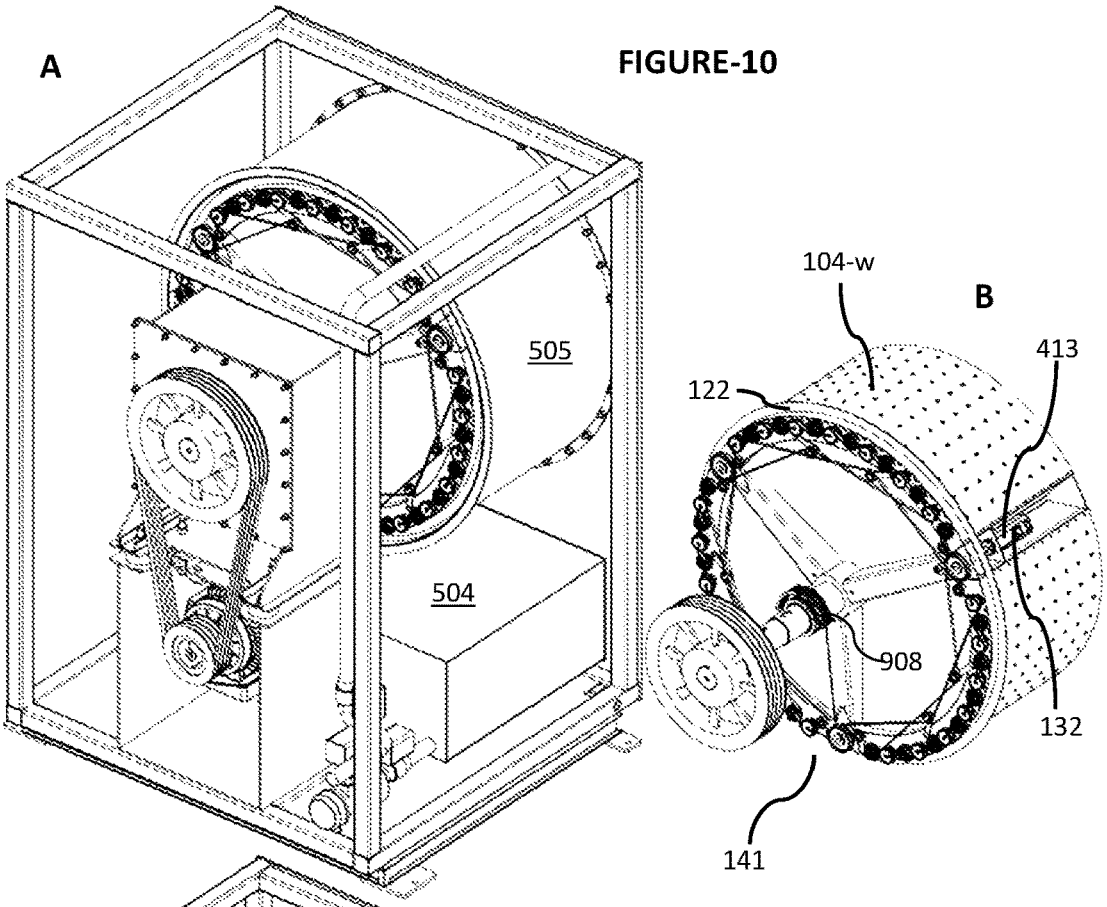
FIG. 10 demonstrates (A) a rear perspective view in an example of a closed water collection chamber of and (B) a rear perspective view outside a water tank of a drum comprising rollers attached to gear pulleys grouped together and driven by belts rotated by motors in the drum fin space.
Figure 11:
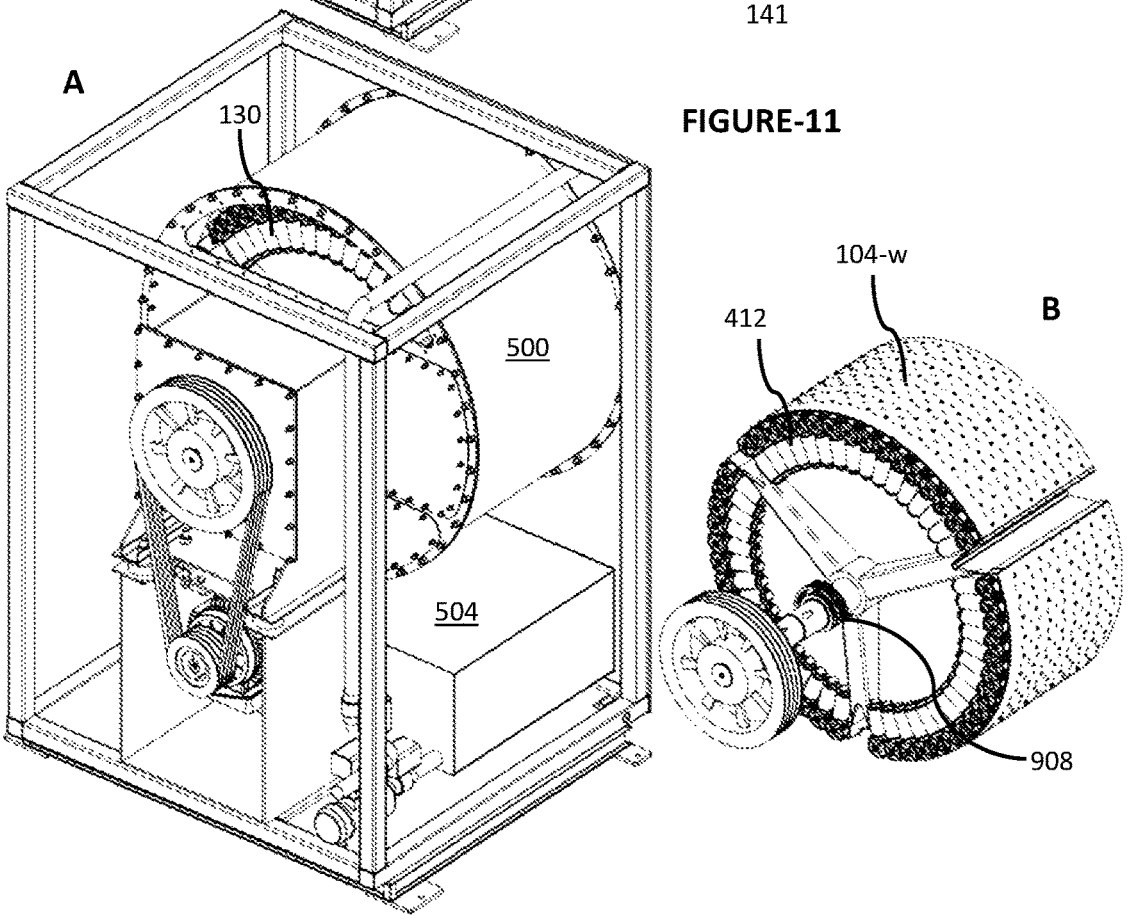
FIG. 11 demonstrates (A) a rear perspective view of an example of a drum inside a closed water collection chamber having service covers at its rear cover sheet and (B) a rear perspective view outside a whole perforated cylindrical surface drum comprising rollers driven by motors that are attached respectively to each roller and are placed in the rear of said drum.

Frontal balance system (300-*f*) at drum front circular base/opening side (109) is mounted around drum cylinder at front side as shown in FIG. 21 or at drum front circular base, around drum entrance/inlet opening (108) as shown in FIG. 34E. Rear balance system (300-*r*) at drum rear circular base/shaft side (110) is mounted around drum cylinder at rear side as shown in FIG. 1 or at drum rear circular base, around drum shaft (103) as shown in FIG. 5-7.

FIG. 38 shows an exploded view of balancing systems mounted around drum cylinder and FIG. 34 shows an exploded view of balancing systems mounted on drum circular base surfaces. FIGS. 34-40 provide detailed images of the balance system from different angles.

Each balance weight system comprises a balance weight handling and rotation structure (308) to rotate each balance weight (301) 360° around drum (104) rotation axis independent of the others. Balance weight handling and rotation structure (308) comprises weight bearings for balance weight bearing system (302-S) and a weight guide path (307) in the form of a rail or channel for guiding the movement of said weights on said bearings. Balance weights (301) are positioned on balance weight bearing system (302-S) to be rotatable 360°. A sliding or rotating balance weight handling and rotation structure (308), such as a sled, wheel or pulley will ensure that a balance weight (301) moving along a suitable path will move to rotate on drum front circular base/opening side (109) and drum rear circular base/shaft side (110

When the bearing systems where the weights move are such that the centers of gravity of the weights are on circles having different diameters as exemplified in FIG. 33, the weights create a centrifugal force, even when they are chosen to be of equal mass. They need not be of equal mass but they must be producing equal centrifugal forces ($F_1$=$F_2$) when placed opposite each other 180° apart, as shown in FIG. 33A. Information coming from balance sensors is analyzed by the control system to determine the angle and magnitude of the imbalance force ($F_x$) in drum (104) after the distribution of materials within. Then, balance weight movement motors (306) controlling balance weights for two-weights balance system (302) will move said balance weights (301) together, keeping the 180° angle between them constant to preserve their balance position, to the position where the direction of the centrifugal force created by balance weights (301) is perpendicular to the imbalance force of the unbalanced load. Therefore, the imbalance force will fall in the middle balance weights (301). In this case, as balance weights (301) still balance each other out, the only force causing imbalance on drum (104) will be the force created by the unbalanced load that is perpendicular to the balanced centrifugal forces of balance weights (301). In order to restore the balance, balance weight movement motors (306) move balance weights (301) at equal angles to create a balancing force against the unbalance force created by the unbalanced load. Balance weights for two-weights balance system (302) will be moved towards each other until they create a force equal to the unbalance force ($F_x$) against the unbalanced load and until the vector average of the force created by said balance weights is equal to the magnitude of the imbalance force. The highest unbalance force will be created at the beginning of the spin cycle. While the increase of the rotation speed of drum (104) will cause the centrifugal force to increase, as water will be discharged, the force will also decrease. For this reason, if a counterbalance force to balance the unbalance force after uneven distribution of load can be created at the beginning, the adjustments needed as drum gains speed will be comparatively very small. In fact, at a certain point in the spin cycle, balance weights (301) will have to move in the opposite direction to compensate for the unbalanced load losing more water.

20. Balance Weights Moving Away from the Center According to the Present Washing Machine Disclosed Herein is Explained Below Via FIG. 32.

An exemplary system is a system comprising bodies of equal weight that can balance each other when positioned equal angles apart on weight guide bearing for three-weights balance system (304) as close to weight starting position for two-weights balance system (322) as possible. Threaded balance weight movement screw connected to balance weight movement motors (306) positioned close to cylindrical perforated drum sheet (106) as shown in FIG. 32 is passed through threaded holes on balance weights to provide bearing on the drum sheet for said balance weights. Figures only show an embodiment comprising worm gears as bearings for the balance weights on drum (104). Other embodiments may comprise any bearing system known in the art wherein balance weights can move thereon. When worm gear is rotated by the motor, the balance weight moves away from the rotation axis and towards the edge of the cylinder. As the balance weight moves away from the rotation axis, the generated centrifugal force will increase. As the system comprises at least three balance weights, two weights can be moved together depending on the position of desired counterweight force vector if needed to create a force vector of desired direction and magnitude. Therefore, counterweight force of desired direction and magnitude may be created using weights that are displaced to different degrees towards the outside of drum (104). To achieve this, the highest imbalance load possible to be generated in drum (104) for the spin cycle must be determined beforehand. It is possible to increase the proportion of the counterweight force to the total weight by dividing the weights into smaller weights and increasing the number of weights while keeping the total weight constant. However, it should be taken into account that each weight requires its own motor gear system.

In addition, the addition/removal of extra weights described above for two-weights balance systems can also be applied to this embodiment. Depending on the imbalance load, additional balance weights (303) may be added to balance weights for three-weights balance system (301-*w*).

21. Direct Heating System (905) Using Gas Burner (921) to Heat Drum (104) from the Outside According to the Present Washing Machine Disclosed Herein is Explained Below Via FIGS. 1, 2, 8, 19, 21.

One of the most important aspects of the washing machine disclosed herein is direct heating of drum (104) using gas, for previously explained reasons. This washing machine disclosed herein also provides solutions to many problems associated with embodiments disclosed elsewhere in this document. One problem that needs to be solved in relation to washing operation taken place in a closed drum (104), especially as explained in section 24 titled "Discharging water from drum (104) via drum discharge chamber water discharge valve (519) to create completely closed drum", the problem of heating the water once it is in drum (104). A way of heating water without taking it out of drum (104) is using drum heating elements (913) placed in drum (104). However, as drum heating elements (913) require electrical systems and fittings to supply the required energy, which increases with drum capacity and can therefore only used with machines having low capacity. It was stated before that machines with high capacity require use of steam for heating. This is achieved by injecting steam directly into drum (104) using rotatable fluid connection element (912) described by the washing machine disclosed herein or passing steam through a serpentine or jacket around drum (104) to heat the water within. While it is possible to utilize these two heating systems, use of gas burners (921) to heat drum (104) is preferable due to its practicality and low cost. In order for this system to be applied to drum (104) in an efficient manner, there must be a large non-perforated heating area (920) on drum outer surface (104-*s*). Methods for creating said non-perforated heating area (920) was explained in section 18 titled "the features of the drum and drum perforations in peripheral zone (509) forming a peripheral perforated narrow band zone (510)." When exit of discharged water from drum (104) is confined to drum perforations in peripheral zone (509) in a peripheral perforated narrow band zone (510), the area outside said narrow area, cylindrical drum sheet having holes in the said peripheral perforated narrow zone (510) can be used for other purposes. Cylindrical drum sheet having holes in the peripheral perforated narrow zone (510) is not perforated and is very suitable to use as a non-perforated heating area (920) for drum (104). The heat produced by the fire created by the combustion of gas in the gas burner (921) placed under cylindrical drum sheet having perforations in the peripheral perforated narrow zone (510) reaches cylindrical perforated drum sheet (106) via heat transfer leaves/fins (922) placed on the surface of drum (104). Gas burner (921) system is also applicable for all drum types that has peripheral perforated narrow zone (510). Gas burner (921) placed under the non-perforated cylindrical or protrusive drum surface part of the drum. Having an open flame is not suitable for the technique, safety regulations, guidelines for using gas equipment, the standards and the desired efficiency of the machine. First the flame must be secured and flue gases need to be removed. Therefore, a combustion chamber (923) needs to be created; starting from the gas burner (921) and encompassing the areas where heat transfer leaves/fins (922) placed on the surface of drum (104) are located. A tank that is similar to drum discharge chamber (517) used for discharged water leaving drum (104) from drum perforations in peripheral zone (509) is placed surrounding the area where areas where heat transfer leaves/fins (922) are placed on the surface of drum (104) as a combustion chamber. The hot air mixture passes between heat transfer leaves/fins (922) placed on the surface of drum (104) and rises to the top of drum (104) through said combustion chamber (923). Said combustion chamber comprises a fume hood and flue connection (924) for collecting flue gases. It is clear that there needs to be an opening between the combustion chamber and drum (104). A combustion chamber flue fan (925) is positioned in the combustion chamber at the flue connection (924) to create negative pressure so that flue gases do not escape through this opening.

Another advantage of heating drum (104) directly using the heat produced by the gas burner (921) aside from the speed of heating is the speed of the change in the temperature of the washing water. When combustion starts in gas burner (921), the effect of heat in drum (104) can be seen quickly. Therefore, it will be easier to maintain the washing water temperature at the desired value.

It is clear that the most suitable fuel for gas burner (921) used to heat drum (104) is liquid petroleum gas or liquid natural gas. However, it should be noted that any other type of fuel suitable for gas burners (921) may be used.

Heating the water and materials within drum (104) directly is a preferable method due to its practicality and low cost as well as its speed. However, its application requires that a large section of drum (104) be non-perforated and that drum perforations in peripheral zone (509) are located in a peripheral perforated narrow zone (510). Such an application is only one of the embodiments described by the present washing machine disclosed herein, and is not possible to use with many of the embodiments. In this case, this heating system may be applied to water chamber (500), half water chamber (505) or water tank/outer drum (101) instead of directly to drum (104). In these embodiments, the water leaving drum (104) is collected by water chamber (500) or water tank/outer drum (101) and discharged. When the interior of drum (104) is desired to be heated, water chamber (500), water storage chamber (504), water chamber discharge line (511-*d*), half water chamber (505) or water tank/outer drum (101) can be heated by one of the heating methods described above.

The present invention proposes a washing machine (50) for performing wet, dry, physical or chemical treatments on materials, comprising a front loading (51) or side loading (52) perforated drum (104) which is mounted respectively by means of a drum shaft (103) at the rear or by means of the drum shafts (103) at both sides horizontally or having an angle with the horizontal axis to a drum shaft bearing (102) system so as to rotate around the bearing axis characterized in that said machine (50) comprises a drum (104) having at least one water-free dry zone (100) which cannot be accessed or contacted by the water draining from the drum (104) on at least one outer surface (104-S) of the drum (104) during wet treatment application processes carried out by the washing machine (50) with water.

Further, at least one water chamber (500) surrounding the wet areas on drum (104-*w*) wherefrom water is discharged, for preventing water-free zones (100) coming into contact with water, collecting discharged water in the manner to prevent overflow and ensuring said collected water reaches a water chamber drain outlet (503) on said water chamber (500).

Further, water barrier systems (122) on said drum (104) which prevent water passage from wet areas (100-W) to said water-free zones (100) of said drum (104) to keep said part of the outer surface of the drum (104) dry.

Further, said water chamber (500) is designed so that at least one outer drum surface (104-*s*) is prevented from coming into contact with the water discharged from drum (104) in any situations and conditions.

Further, said water chamber (500) is configured to prevent the water leaving the drum (104) from reaching the level so as to reach the drum (104) again after its contact with the drum (104) is interrupted and/or prevent the water leaving the drum (104) from reaching areas or surfaces of the drum (104) which should not contact water and/or prevent the water leaving the drum (104) from leaving and/or overflowing from the water chamber (500).

Further, said water chamber (500) comprises a water flow path (508) on water chamber (500) which is configured to enable the water leaving the drum (104) to reach the water chamber drain outlet (503) and to leave the water chamber (500).

Further, the water flow capacity of said water flow path (508) to drain the water leaving the drum (104) toward the water chamber drain outlet (503) is higher than the drain flow rate of the water from the drum (104) in any case in order to prevent the water leaving the drum (104) from accumulating in the water chamber (500).

Further, said washing machine (50) comprises a pump or pumping system (112) having a pumping capacity higher than the flowrate of water flowing from drum (104) to water chamber (500) for pumping water flowing to water chamber (500) and flow path on water chamber (508) from drum (104) back into drum (104) to prevent water from accumulating to levels high enough to reach drum outer surface (104-*s*) or overflow into water-free zones (100).

Further, said pump or pumping system (112) is configured to pump the water draining from the water chamber (500) into the drum (104) in order to provide the amount of water in the drum (104) required during the process and to prevent the water from accumulating in the water chamber (500) up to a level to reach the drum (104) or overflow from the chamber (500).

Further, said pump or pumping system (112) is positioned on a circulation line (113) connected from water chamber (500) to the drum (104) so as to carry out its function.

Further, the pumping capacity of said pumping system (112) is higher than the flow rate of the water draining from the drum (104) and reaching the pumping system (112) via the water flow path (508) on water chamber (500).

Further, said circulation pump (112) is positioned on a circulation line (113) connected from water chamber (500) to the drum (104) and has a higher pumping capacity than the drum discharge flowrate, and is configured to ensure that the drum discharge flowrate is lower than the pumping capacity of circulation pump (112) so that water draining from drum (104) to water chamber (500) via the water flow path on water chamber (508) does not overflow from water chamber (500), reach drum outer surface (104-*s*) or overflow or pass to water-free zone (100).

Further, said drum (104) comprises drum perforations/holes (105) wherein the number and/or size of the said drum perforations (105) is limited to enable the flow rate of the discharged water passing through the perforations (105) to be below the capacity of the pump (112) such that the pumping capacity of said pump (112) is higher than the maximum water drain flow rate of the drum (104).

Further, said tank/outer drum type water chamber (101) has two drum surface areas, namely the wet drum surface area (104-*w*) and the dry drum surface area (100).

Further, said tank/outer drum type water chamber (500) comprises a flow path (508) on water chamber having a structure suitable for collecting the water draining from the drum (104) in wet area (100-*w*) of said tank/outer drum type water chamber (101) and ensuring the flow of water to water chamber drain outlet (503).

Further, said water chamber (500) wherein the water exiting through the drum perforations (105) is a water chamber (501) surrounding the area of the cylindrical drum sheet (106) with the drum perforations (105).

Further, said washing machine (50) comprises a dry area (104-D) of the drum (104) positioned outside said water chamber (500) and said dry area (104-D) of the drum (104) is visible from outside said water chamber (500).

Further, said water chamber (500) is in connection with a pumping system (112) which has a pumping capacity higher than the drain flow rate of the drum (104), and which pumps the drum (104) drain water reaching the water drain outlet (503) to the drum (104), whereby said water-free zones (100) on drum outer surface (104-*s*) are formed.

Further, said tank/outer drum type water chamber (500) comprises water barrier systems (511) on said water chamber (500) together with water barrier systems (122) on the drum (104) surface which prevent the water passing from the wet area of the drum surface (104-*w*) to the water-free zone (100) of the drum surface.

Further, said water chamber (500) comprises water tank barrier systems for preventing water draining from the drum (104) leaving from the wet areas (100-*w*) are systems such as water chamber barriers (511) on said water chamber (500) which prevent draining water from drum (104) overflowing from water chamber (500) wet areas (100-*w*).

Further, said drum (104) comprises at least one external water barrier (122) on said drum (104) which aligns with said water chamber barriers (511) on said water chamber (500) corresponding to said water chamber barriers positioned water chamber (501) surrounding partially perforated cylindrical drum surface (510) for preventing water overflow from said water chamber surrounding partially perforated cylindrical drum surface (510).

Further, said washing machine (50) comprises a drum (104) having at least one perforated wet area (104-*w*) and at least one non-perforated (510-*n*) water-free zones (100) on the cylindrical drum sheet (106), surrounding the drum (104) peripherally.

Further, said non-perforated (510-*n*) water-free zones (100) of the drum (104) are separated from the perforated wet area (104-*w*) of the drum (104) so as not to contact the water draining from perforations of the drum (104) in the operational conditions of the washing machine (50).

Further, said drum (104) comprises water barrier systems (122) on said drum (104) which separate the water-free zones (100) from the perforated wet areas (104-*w*) of the cylindrical drum surface (106).

Further, said drum (104) comprises free water flow paths in order to enable the water to be drained from said drum (104) to flow from the non-perforated areas (510-*n*) of the drum (104) to the perforated areas (510) inside the cylindrical drum surface (104-*n*) without being restrained or blocked by the material being treated in the drum (104) or in order to increase the flow rate thereof.

Further, said water flow paths are in the form of water channels/Poly-Channels (524).

Further, said drum perforations/holes (105) are positioned inside said water channels/Poly-Channels (524).

Further, said water channels/Poly-Channels (524) are configured to prevent the material being treated in the drum (104) from entering the water channels/Poly-Channels (524) so as to limit the flow rate or decrease the water flow rate or from filling in the water flow path so as to block or interrupt the water flow.

Further, said water channels/Poly-Channels (524) are configured to form water passage gaps which will prevent the material from completely blocking the water passage from the unperforated areas of the drum (104) to the perforated areas by jamming the water channels/Poly-Channels (524).

Further, said drum perforations (105) and water channels/Poly-Channels (524) are configured to prevent the material from reaching the perforations (105) or from covering the perforations (105) in a manner to completely block the water passage such that the water to be drained from the drum (104) passes through the perforations (105) without being blocked by the material being treated in the drum (104) or the flow rate through the perforations (105) is increased.

Further, said perforations (105) are partially or completely in the water passage gaps so as to form the water passage gaps which prevent the material from reaching and completely blocking the drum perforations (105) in order to ensure the continuity of water drain.

Further, said drum perforations in peripheral zone (509) are positioned in said water channels/Poly-Channels (524) and at least partially in the empty gap under the protrusions (531-*g*).

Further, the perforated drum sheet (106) has a protrusive Poly-Ribs/protrusions/sheet bar/grate bars (525) structure such that the drain from the drum (104) has an efficiency such that saving on time is provided by shortening the drain time as much as possible.

Further, said poly-protrusive structure comprises movable protrusive parts over drum surface (525-*m*) or fixed Poly-Ribs/protrusions/sheet bar/grate bars (525) and/or protrusive drum surface forms (525-*s*) around or on the drum perforations (105) having shapes, heights and densities suitable for partially or fully preventing the material undergoing treatment from partially or completely reaching and covering the cylindrical perforated drum sheet (106) and drum perforations/holes (105), whereby said water-free zones (100) on drum outer surface (104-*s*) are formed.

Further, said Poly-Ribs/protrusions/sheet bar/grate bars (525) structure on the cylindrical perforated drum sheet (106) creates a plurality of water channels/Poly-Channels (524) on the perforated drum sheet (106).

Further, said water channels/Poly-Channels (524) are formed with the Poly-Ribs/protrusions/sheet bar/grate bars (525) provided on the cylindrical drum sheet (106) and/or with the stationary or moving parts placed onto the drum sheet (106) so as to protrude.

Further, said water channels/Poly-Channels (524) are positioned in the gap under the protrusions (531-*g*) under the fixed or moving parts which are placed so as to form Poly-Ribs/protrusions/sheet bar/grate bars (525) over the cylindrical drum sheet (106) such that the material being treated in the drum (104) is prevented from entering the water passage paths (524) in a manner to interrupt or block the drum (104) drain water flow in the drum (104) or decrease the flow rate.

Further, said the water channels/Poly-Channels (524) are positioned under said protruding movable protrusive parts over drum surface (525-*m*) or fixed Poly-Ribs/protrusions/sheet bar/grate bars (525) configured to have the structure, form, depth and width to enable water flow from the drum (104) at the drain flow rate of the drum.

Further, said movable protrusive parts over drum surface (525-*m*) or fixed Poly-Ribs/protrusions/sheet bar/grate bars (525) are configured to have the structure, form and features to prevent the material being treated in the drum (104) from reaching under the movable protrusive parts over drum surface (525-*m*) or fixed Poly-Ribs/protrusions/sheet bar/grate bars (525) parts in a manner to interrupt, block and/or limit the drum (104) drain water flow from the non-perforated zones (510-*n*) to the perforations (105) in the drum (104) or decrease the flow rate.

Further, said water channels/Poly-Channels (524) in the form of water channels/poly-channels are configured to be the spaces remaining between the cylindrical drum sheet (106) and the movable protrusive parts over drum surface (525-*m*) or fixed Poly-Ribs/protrusions/sheet bar/grate bars (525) placed over cylindrical drum sheet (106).

Further, the parts positioned so as to be under said movable protrusive parts over drum surface (525-*m*) or fixed Poly-Ribs/protrusions/sheet bar/grate bars (525) forming the protrusions in the drum (104) and to be above the cylindrical drum sheet (106) comprise the water passage path (524) which provides regular water flow.

Further, the parts (240) which serve as said water channels/Poly-Channels (524) positioned under the movable protrusive parts over drum surface (525-*m*) or fixed Poly-Ribs/protrusions/sheet bar/grate bars (525) comprise the water channel (241) so as to enable the drain water to flow towards the drum perforations (105).

Further, the drum perforations (105) are provided in said water channel (241).

Further, the drum (104) comprises a drum discharge chamber (517) configured to completely enclose the perforations in peripheral zone (509) on the cylindrical sheet (106) so as to surround the perforations (509) in a waterproof volume.

Further, said water discharge chamber (517) comprises at least one water discharge valve (519) configured to enable the water entering said drum discharge chamber (517) via the drum perforations (509) to be discharged to the water chamber surrounding partially perforated cylindrical drum surface (501).

Further, said water discharge valve (519) configured so that when said water discharge valve (519) is closed such that the drum discharge chamber (517) blocks the water passage, water discharge from the drum (104) via the drum perforations (509) is completely prevented.

Further, said washing machine (50) comprises a water chamber surrounding partially perforated cylindrical drum surface (501) which is placed so as to enclose the drum discharge chamber (517).

Further, the drum (104) comprises a sealed hinged drum door (533) which rotates together with the drum (104) and is connected to the drum (104) so as to prevent water exit from the drum entrance/inlet opening (108).

Further, said water discharge valve (519) of the water discharge chamber (517) is configured to enable the collection and retention in the drum (104) of the water and chemicals required for the washing process during the process when a sealed hinged drum door (533) of said drum (104) is closed.

Further, said drum (104) comprises moving parts (250) inside the drum (104) which are placed into the drum (104) and which move by being driven by a motor movement system (400) outside the drum (104) so as to create a physical abrasion effect on the material being treated in the drum (104) or increase the physical abrasion effect generated by the movement of the drum (104).

Further, said moving parts (250) inside the drum (104) are cylindrical or eccentric rollers (201) which rotate around their own central axes inside the drum (104).

Further, said moving parts (250) in the drum (104) are rollers (201) which are placed between the two roller bearings (205) on the surface of drum front circular base/opening side (109) and drum rear circular base/shaft side (110) of the drum (104) so as to be parallel or inclined with respect to the axis of rotation of the drum (104).

Further, said rollers (201) are controllably rotated by means of motor systems (400).

Further, said moving parts (250) in the drum (104) are the rollers (201) which make rotational/oscillating movements to left and right in a controlled and/or programmable manner in the defined direction and at the defined speed or within predetermined angular limits by means of the motor directly connected to roller (412) or the motor systems (400) connected to a motor driving multiple movable parts (413).

Further, said rollers (201) are brush rollers (203) which are composed of wires with the form, hardness and thickness suitable for the treatment produced from bristle, steel or plastic so as to brush, abrade, nap, polish, rub, shake the material being treated in the drum (104) or said rollers (201) have protruding or helical surfaces so as to agitate or rub or move or beat or shake or displace the material being washed and/or painted in the drum (104).

Further, said rollers (201) are abrasive rollers (202) which comprise grindstones thereon.

Further, said abrasive rollers (202) have abrasive surfaces so as to impart the desired abrasion onto the surface of the material being stone or stone washed in the drum (104).

Further, said grindstone is one piece (206) or a plurality of pieces (207) placed side by side on an angled or circular grindstone carrier (212) used as a carrier.

Further, said grindstone carrier (212) comprises at the two ends thereof shafts (213) which are suitable for rotating in the roller bearings (205) provided on the front and rear circular sheets (109-110) of the drum (104).

Further, said grindstone pieces (207) have a cylindrical grindstone (210), spherical/buckled grindstone (211), conical or ribbed structure.

Further, said drum (104) comprises moving parts (250) inside the drum (104) which are placed in the drum (104) and which move by being driven by the motor system (400) outside the drum (104) so as to create a physical abrasion effect on the material being treated in the drum (104) or increase the physical abrasion effect generated by the movement of the drum (104).

Further, said moving parts (250) in the drum (104) comprise vibrating parts (222) placed onto the drum inner surface as connected to the vibrators mounted outside the drum (104) so as to create abrasion, rubbing, scrubbing, or brushing on the material being treated in the drum (104) or increase the existing physical effects.

Further, said vibrating parts (222) are parts with abrasive surfaces which provide stone washing effect on the material being washed by abrasion or parts with brushes provided on the surface thereof which provide rubbing, abrasion, or cleaning effect on the material being washed.

Further, said drum (104) comprises at least one motor to move parts on the drum (130) configured to provide the movement of said moving parts (250) inside the drum (104), which are directly connected to the drum (104), and which are operated with electrical or pressurized air energy.

Further, said motor to move parts on the drum (130) mounted onto the drum (104) comprises a belt-pulley system or movement transfer mechanisms to transfer the movement of the moving parts (250).

Further, said motor to move parts on the drum (130) mounted onto the drum (104) are configured to transfer the movement to the moving parts (250).

Further, said washing machine (50) comprises control systems, electrics, electronics, cables, hoses and other connection equipment and auxiliary devices required by said movement systems (400) in an electric system panel on drum (901).

Further, drum (104) of the said machine (50) comprises a mechanical balance system (300) configured to compensate for the oscillations and vibrations generated by the imbalance occurring at high drum (104) rotation speeds during the extraction process.

Further, said mechanical balance system (300) comprises a balance control system (300-S) configured to monitor and control the imbalance generated in the drum (104) during the extraction process and determine the position and magnitude of the counterforce to compensate the imbalance and a balance weight system (301-W) which is mounted onto drum rear circular base/shaft side (110) and/or drum front circular base/opening side (109) on the drained dry areas (100) of the drum (104) and to generate a counterforce to balance the force created by the imbalance.

Further, said balance weight system (301-W) comprises at least one balance weight handling and rotation structure (301-S) which is driven and rotated by means of a balance weight movement motor (306) on the drum (104) such that the axis of rotation thereof is the axis of rotation of the drum (104).

Further, said balance weight handling and rotation structure (301-S) comprises at least one balance weight (301).

Further, said balance weight system (301-W) comprises a movement transfer system which transfers the movement provided by the balance weight movement motor (306) to the balance weight handling and rotation structure (301-S).

Further, said washing machine (50) comprises an energy source on drum (104) in order to provide the energy required for the operation of the balance weight movement motor (306) which provides the movement of said balance weight(s) (301) is supplied via the drum (104).

Further, said energy source is electrical or pressurized air.

Further, said balance control system (300-S) comprises contact or contactless balance sensors (312-B) required for the operation thereof and sensors monitoring the rotation speed of the drum (104).

Further, said balance sensors (312-B) are sensors which measure the movement or force or stress created by the unbalanced load on the drum (104) chassis.

Further, said balance control system (300-S) is configured to evaluate the data received from the balance sensors (312) to determine and evaluate the direction and magnitude values of the imbalance force vectors caused by the unbalanced load distribution generated at the drum rear circular base/shaft side (110) and/or drum front circular base/opening side (109), and to operate the movement systems in the balance system (300) according to the results in order to enable the balance weight(s) (301) to generate the balance force which will compensate the unbalanced load force.

Further, said balance weight (301) contains metal balance weight piece or balance weight container (331) which can be filled with liquid.

Further, electrical and electronic devices and power sources providing the control and operation of said balance systems (300) and the cable connections of said devices and the panels are directly positioned on the drum (104).

Further, electrical energy is supplied on the drum (104) for the electrical or electronic components (900) in said balance system which require electrical energy.

Further, each of said mechanical balance systems (300) mounted to the drum rear circular base/shaft side (110) and/or drum front circular base/opening side (109) comprises two balance weight systems (301-W).

Further, each of said balance weight systems (301-W) comprises one balance weight handling and rotation structure (301-S) having at least one balance weight piece (301).

Further, said balance weight handling and rotation structure (301-S) comprises a balance weight bearing system (302-*s*) which is configured to enable the balance weight pieces (301) to rotate at least 360 degrees around the axis of rotation.

Further, said balance weight handling and rotation structure (301-S) comprises a balance weight movement motor (306) which is configured to enable said balance weight handling and rotation structure (301-S) to rotate around the axis of rotation of the balance system (300).

Further, a movement transfer system is provided between said balance weight handling and rotation structure (301-S) and the balance weight movement motor (306) configured to transfer the movement from the balance weight movement motor (306) to the weight handling and rotation structure (301-S).

Further, said balance weight pieces (301) have a mass that is suitable for creating a counter centrifugal force (F1, F2) for compensating the largest possible imbalance force (Fx) in the drum (104).

Further, said balance control system (300-S) is configured to change the places of said balance weights (301) in order to create a counterbalance force (F1, F2) which will compensate the imbalance force (Fx) monitored and determined during the extraction process.

Further, the balance control system (300-S) is configured to rotate said balance weights (301) to a position and to maintain said position in order to continuously ensure balance by being driven by a balance weight movement motor (306) in a peripheral balance weight bearing system (302-*s*) of which the center on the drum (104) is the axis of rotation of the drum (104).

Further, said weight pieces (301) provided in the balance weight handling and rotation structure (301-S) at the same side of the drum (104) have a mass suitable for generating the centrifugal forces which will balance each other when said weight pieces (301) are oppositely positioned even if the latter are at different distances from the axis of rotation of the drum (104).

Further, said balance control system (300-C) is configured to move said two balance weights (301) in the same balance weight handling and rotation structure (301-S) move close to each other so as to create a force vector which is 180 degrees opposite to the imbalance force vector (Fx) determined by the balance control system (300-C) and which is equal to the imbalance force vector (Fx).

Further, aid balance weight handling and rotation structure (301-S) comprises a circular channel or rail weight guide path (307) configured to match said balance weight handling and rotation structure (301-S) in the weight pieces (301) or any sliding component and to support the balance weights (301) to enable said balance weights (301) to rotate in the balance weight bearing system (302-*s*).

Further, said balance weights (301) are configured to be lockable by the weight guide path (307) so as to move over the balance weight bearing system (302-*s*) which supports the balance weights (301).

Further, said balance weights (301) are connected to a motor-gear pulley system (311) mounted to the drum (104) and balance weight (301) by means of a gear, chain or threaded belt (311).

Further, said movement transfer systems are configured to move a guide apparatus in the form of circular channel or rail weight guide path (307) located at the same center as the axis of rotation of the drum (104) and the balance weight bearing system (302-*s*) and to move the balance weights (301) a full turn around the weight bearing center continuously.

Further, additional balance weights (303) can be added to or removed from the balance weights (301) in accordance with the balancing capacity required by the extraction characteristics of the machine (50) where the balance system is applied.

Further, said balance system (300) is in the form of a plastic molded balance part (630).

Further, said plastic molded balance part (630) comprises a weight area serving as a balance weight, a sliding system providing the rotation thereof in a balance part bearing (633) on the drum (104) and a balance part movement gear (638) providing the rotation thereof around said balance part bearing (633).

Further, the sliding system providing rotation in the balance part bearing (633) comprises a rotatable balance part bearing wheel (634).

Further, said balance system (300) comprises a balance motor movement gear (637) connected to a balance part movement motor (635) is configured to rotate in the balance part movement gear (638) on the plastic molded balance part (630) so as to enable said plastic molded balance part (630) to rotate around the balance part bearing (633) continuously and to stop at the required position.

Further, said plastic molded balance part (630) comprises a single metal weight on plastic molded balance part (631) embedded into the weight area.

Further, at least three movable balance weight pieces for 3-weights balance system (303-*p*) are provided on the drum rear circular base/shaft side (110) and/or drum front circular base/opening side (109).

Further, said balance weight pieces for 3-weights balance system (303-*p*) are mounted so as to get close to or move away from the center in a position perpendicular to the axis of rotation of the drum (104).

Further, said balance weight pieces for 3-weights balance system (303-*p*) are configured to be moved so as to move away from the center to create a counterbalance vector against the imbalance force vector (Fx) if the material is distributed so as to create an imbalance at the drum rear circular base/shaft side (110) and/or drum front circular base/opening side (109), and to be moved away from the center so as to create a counterforce which will balance the unbalanced load weight force (Fx).

Further, said water-free zones (100) of the drum outer surface (104-*s*) are located at the drum rear circular base/shaft side (110) of the drum at shaft side connected to drum shaft (103), and said drum rear circular base/shaft side (110) comprises at least one of a motor system (400) and movement systems in connection with said motor systems and energy and control systems necessary for said systems to operate.

Further, said drum (104) comprises a motor system (400) for generating and/or transferring movement and moving parts (200) connected to said motor system (400) and electric, electronic and control systems (900) required for and/or connected to said systems (400, 200) for the operation thereof with the systems (400, 200, 900) being mounted outside and/or inside the drum (104).

Further, at least one element of said motor system (400) for generating and/or transferring movement, moving parts (200) and electric, electronic and control systems (900) necessary for the operation of said motor systems outside drum (400) are positioned on drum water-free zone (100) outside the surface of the drum (104) such that it does not come into contact with water and continue its operation under the operation conditions of the washing machine (50).

Further, the electric, electronic and control systems (900) configured to provide and control the operation of the devices on the drum (104) is positioned on the drum (104), wherein the data exchange between the electric, electronic and control systems (900) on the drum (104) and other control systems of the machine (50) is carried out via an electricity transfer slip ring (908) positioned on the shaft (103) and/or by means of wireless communication methods.

Further, said motor system (400) mounted outside the drum (104) comprises at least one of motor to move parts on the drum (130), pump, valve, piston, gear, pulley, belt, chain or similar movement transfer parts (402) in order to generate or transmit movement.

Further, said motor system (400) comprises at least one of sensors, control systems, electrical and/or electronic pressurized air systems, vapor systems, cables, hoses, connection means, panel components or systems as mounted to the drum (104) which are used together with said movement transfer parts (402).

Further, said motor to move parts on the drum (130) configured to provide movement in the moving parts (200) outside and/or inside the drum (104) are devices which are operable in the atmospheric conditions and the ambient conditions suitable for the operation of the washing machine (50) and apparatuses and equipment related to the machine (50).

Further, said drum (104) comprises sources of electricity or pressurized air for the operation of said motors to move parts on the drum (130) are provided on the drum (104).

Further, said drum (104) is configured to provide the conditions suitable for the operation of said motors to move parts on the drum (130) and electric, electronic and control systems (900) which are positioned on the drum (104) as connected to the motors to move parts on the drum (130).

Further, said electric, electronic and control systems (900) are mountable onto the drum (104).

Further, said motors to move parts on the drum (130) are directly connected to the moving parts (200), or said motors to move parts on the drum (130) are connected to the moving parts (200) by means of movement transfer parts (402).

Further, said washing machine (50) comprises at least one of a dynamo, pump, compressor, ventilator, valve, and piston which are mounted outside the drum (104).

Further, said electrical devices (900) comprise devices that do not possess isolation properties that allow them to be operable in contact with or submerged in water.

Further, said drum (104) comprises electrical connections required for the operation of said electric, electronic and control systems (900) which are provided on the drum (104).

Further, the components of the motor system (400) for generating movement outside the drum (104) and the mechanical, electrical, or electronic components of the movement transfer system (401) and the components of the motors to move parts on the drum (130) mounted onto the drum (104) to move said moving parts (200) in a controlled manner are positioned on drum water-free zones (100) located outside the water chamber (500).

Further, said moving system components and/or electric, electronic and control systems (900) and motor system (400) components which are positioned in the wet areas (104-*w*) of the drum (104) and are connected to the moving parts (200) which are located on water-free zones (100) of the drum (104) and the support or auxiliary components or systems for said systems (900, 400) are insulated so as not to be affected from water in case of contact with water.

Further, said washing machine (50) comprises volumes containing said moving parts (200) components and/or electric, electronic and control systems (900) and motor system (400) components and the support or auxiliary components or systems for said systems (900, 400) which are positioned on water-free zones (100) of the drum (104) and are connected to the motor system (400) located on water-free zones (100) of the drum (104) and the systems moving as connected to said systems (400) contain isolated areas (142) which can be opened and closed.

Further, said washing machine (50) comprises a pressurized air and/or liquid line which is connected to the drum (104) or electrical components which are mounted onto the drum (104) comprising at least one of a water pump, hydrophore, compressor, air pump and sensors which are configured to monitor and control said devices or the process being performed in the drum (104) can be operated inside or on the drum (104).

Further, said machine (50) comprises an electricity, pressurized air or liquid fluid and steam connection from the fixed part of the washing machine (50) to the rotating drum (104) via cables and/or hoses so as to provide the energy required for the operation of the moving parts in the drum (104).

Further, said electricity connection is provided by means of electricity transfer slip rings (908) which are positioned on the shaft (103).

Further, said electric, electronic and/or control systems (900) and/or pneumatic systems to move parts on the drum (131) are located in the water-free zones (100) of the drum (104).

Further, said machine (50) comprises a combustion chamber (923) which is placed so as to enclose the unperforated dry area of the cylindrical drum sheet (106).

Further, said combustion chamber (923) comprises at least one heat source which is configured to heat the material washed with the washing water in the drum (104) in the desired time or which maintains the current heat level.

Further, wherein the heat supplied by said heat source is configured to reach the cylindrical drum sheet (106) in the combustion chamber (923) surrounding the drum (104) and the required amount of heat is transferred to the drum sheet (106) and to the material washed with the washing water in contact with the drum sheet (106).

Further, said combustion chamber (923) comprises a gas burner (921) group which provides the burning of a liquid or gas fuel wherein the heat generated by the flame formed as a result of the burning in said gas burner (921) and/or carried by the hot air-gas mixture circulates around the drum (104) in contact with the cylindrical drum sheet (106) to heat the drum sheet (106) in order to heat the washing water and the material being washed in the drum (104).

Further, said combustion chamber (923) comprises a steam/gas flue chimney (515) at the peak point of the combustion chamber (923), which provides the discharge of the exhaust gas generated in the burner.

Further, said steam/gas flue chimney (515) comprises a combustion chamber flue fan (925) system which has a suction capacity to prevent the gas exit from the areas of the combustion chamber (923) other than said steam/gas flue chimney (515).

Further, said washing machine (50) comprises prevention systems which are mounted between the fixed combustion chamber (923) and the drum (104) rotating inside the combustion chamber (923) configured to prevent the flame and hot air-gas mixture generated due to the combustion in said gas burner (921) from getting out of the areas of the combustion chamber other than the combustion chamber flue connection (924).

Further, the area of the cylindrical drum sheet (106) enclosed by said combustion chamber comprises surface forms which will increase the non perforated heating area (920) of the drum sheet (106).

Further, the area of the non perforated heating area (920) enclosed by said combustion chamber (923) comprises heat transfer foils/blades produced from metals with high heat transfer coefficient which are placed onto the drum sheet (106) so as to increase the heat transfer area of the non perforated heating area 920).

The methods, devices, processing, circuitry, and logic described herein as control, control systems, control circuitry and the like for the washing machine may be implemented in many different ways and in many different combinations of hardware and software. For example, all or parts of the implementations may be circuitry that includes an instruction processor, such as a Central Processing Unit (CPU), microcontroller, or a microprocessor; or as an Application Specific Integrated Circuit (ASIC), Programmable Logic Device (PLD), or Field Programmable Gate Array (FPGA); or as circuitry that includes discrete logic or other circuit components, including analog circuit components, digital circuit components or both; or any combination thereof. The circuitry may include discrete interconnected hardware components or may be combined on a single integrated circuit die, distributed among multiple integrated circuit dies, or implemented in a Multiple Chip Module (MCM) of multiple integrated circuit dies in a common package, as examples.

Accordingly, the circuitry may store or access instructions for execution, or may implement its functionality in hardware alone. The instructions may be stored in a tangible storage medium that is other than a transitory signal, such as a flash memory, a Random Access Memory (RAM), a Read Only Memory (ROM), an Erasable Programmable Read Only Memory (EPROM); or on a magnetic or optical disc, such as a Compact Disc Read Only Memory (CDROM), Hard Disk Drive (HDD), or other magnetic or optical disk; or in or on another machine-readable medium. A product, such as a computer program product, may include a storage medium and instructions stored in or on the medium, and the instructions when executed by the circuitry in a device may cause the device to implement any of the processing described above or illustrated in the drawings.

The implementations may be distributed. For instance, the circuitry may include multiple distinct system components, such as multiple processors and memories, and may span multiple distributed processing systems. Parameters, databases, and other data structures may be separately stored and managed, may be incorporated into a single memory or database, may be logically and physically organized in many different ways, and may be implemented in many different ways. Example implementations include linked lists, program variables, hash tables, arrays, records (e.g., database records), objects, and implicit storage mechanisms. Instructions may form parts (e.g., subroutines or other code sections) of a single program, may form multiple separate programs, may be distributed across multiple memories and processors, and may be implemented in many different ways. Example implementations include stand-alone programs, and as part of a library, such as a shared library like a Dynamic Link Library (DLL). The library, for example, may contain shared data and one or more shared programs that include instructions that perform any of the processing described above or illustrated in the drawings, when executed by the circuitry.

In some examples, each unit, subunit, and/or module of the control system(s) may include a logical component. Each logical component may be hardware or a combination of hardware and software. For example, each logical component may include an application specific integrated circuit (ASIC), a Field Programmable Gate Array (FPGA), a digital logic circuit, an analog circuit, a combination of discrete circuits, gates, or any other type of hardware or combination thereof. Alternatively or in addition, each logical component may include memory hardware, such as a portion of the memory, for example, that comprises instructions executable with the processor or other processors to implement one or more of the features of the logical components. When any one of the logical components includes the portion of the memory that comprises instructions executable with the processor, the logical component may or may not include the processor. In some examples, each logical components may just be the portion of the memory or other physical memory that comprises instructions executable with the processor or other processor to implement the features of the corresponding logical component without the logical component including any other hardware. Because each logical component includes at least some hardware even when the included hardware comprises software, each logical component may be interchangeably referred to as a hardware logical component.

A second action may be said to be "in response to" a first action independent of whether the second action results directly or indirectly from the first action. The second action may occur at a substantially later time than the first action and still be in response to the first action. Similarly, the second action may be said to be in response to the first action even if intervening actions take place between the first action and the second action, and even if one or more of the intervening actions directly cause the second action to be performed. For example, a second action may be in response to a first action if the first action sets a flag and a third action later initiates the second action whenever the flag is set.

To clarify the use of and to hereby provide notice to the public, the phrases "at least one of <A>, <B>, . . . and <N>" or "at least one of <A>, <B>, <N>, or combinations thereof" or "<A>, <B>, . . . and/or <N>" are defined by the Applicant in the broadest sense, superseding any other implied definitions hereinbefore or hereinafter unless expressly asserted by the Applicant to the contrary, to mean one or more elements selected from the group comprising A, B, . . . and N. In other words, the phrases mean any combination of one or more of the elements A, B, . . . or N including any one element alone or the one element in combination with one or more of the other elements which may also include, in combination, additional elements not listed.

While various embodiments have been described, it will be apparent to those of ordinary skill in the art that many more embodiments and implementations are possible. Accordingly, the embodiments described herein are examples, not the only possible embodiments and implementations.

LIST OF PARTS

The following numerals are referred to in the detailed description of the present washing machine disclosed herein:

50 Washing machine
51 Industrial washing machine
52 Industrial textile washing machine
53 Industrial piece dyeing machine
54 Industrial stone washing machine
55 Industrial heavy material washing machine
56 Commercial washing machine
57 Household washing machine (Household W.M.)
60 Poly-Rib System
61 Eco-Drum System
100 Water-free zones
100-*w* Wet areas/surface
101 Water tank/outer drum
102 Drum shaft bearing
102-*b* Drum shaft ball bearing
103 Drum shaft
103-*c* Water entrance to drum through drum shaft
104 Drum
104-*n* Drum inner surface
104-*s* Drum outer surface
104-*w* Drum wet-outer surface
105 Drum perforations/holes
106 Perforated drum sheet
107 Lifter ribs
108 Drum entrance/inlet opening
109 Drum front circular base/opening side
110 Drum rear circular base/shaft side
111 Fixed chassis
112 Circulation pump
113 Circulation line
113-*a* Drum drain chamber circulation line
113-*b* Drum opening drain chamber circulation line
114 Gap around drum opening between drum and front panel
115 Drum rotation motor
116 Drum pulley
117 Outer frame of the machine
118 Drum door
119 Machine front panel
120 Outer frame chassis
121 Water tank service door
122 Water barrier
123 Water Circulation/discharge line valves
130 Motor to move parts on the drum
131 Pneumatic system to move parts on the drum
132 Electrical drive motor on drum
133 Electrical drive motor on fixed chassis
134 Motor connected to moving part
141 Moving parts system
142 Isolated areas in movement system
142-*w* Cover for isolated areas in movement system
143 Isolated units in movement system
200 Moving parts
201 Roller
202 Abrasive roller
203 Brush roller
204 Eccentric roller
205 Roller bearing
205-*f* Roller frontal bearing
205-*r* Roller rear bearing
206 Abrasive grindstone roller
207 Grindstone pieces
208 Fixed brush between rollers
209 Recessed protruding threaded roller
209-*p* Tab of recessed protruding threaded roller
209-*r* Recess of recessed protruding threaded roller
209-*s* Grindstone of recessed protruding threaded roller
210 Cylindrical grindstone
211 Spherical/buckled grindstone
212 Grindstone carrier
212-2 2 flat surface on circular shaft carrier
212-4 Quadrangular grindstone carrier
213 Roller frontal bearing shaft
214 Roller frontal bearing shaft housing
215 Roller frontal bearing lock system
216 Fixed grindstone piece
217 Fixed grindstone rod
218 Material holding part
219 Protrusive surface of fixed grindstone
220 Water channel
221 Oscillating part
222 Vibrating part
223 Vibrating part connection spring
224 Vibrating part platform
225 Vibrating part vibrator
226 Roller shaft lock
226-2 Roller shaft lock part
227 Protrusions on protruding parts in rollers
228 Protruding parts in rollers
229 Propeller parts in rollers
230 Roller rear bearing shaft
230-*f* Shaft-roller connection
230-*f*1 Shaft-roller cornered lock structure
230-*f*2 Shaft-roller wedged lock structure
230-*r* Shaft-movement system connection
231 Roller ball bearing
232 Roller shaft seal ring
233 Roller bearing water discharge hole

234 Molded roller housing
235 Molded roller housing water discharge hole
236 Fixed part housing in molded roller housing
237 Molded roller housing lock system
238 Molded roller housing-drum connection
239 Shaped sheet roller housing
240 Conically molded roller housing
241 Conically molded roller housing water channel
242 Drum sheet in the form of roller housing
243 Fixed grindstone
244 Roller side bumper prevent material entrance
250 Moving parts inside of the drum
251 Moving parts outside of the drum
260 Moving abrasive parts
261 Protrusions on cylindrical drum surface
262 Recess between protrusions on cylindrical drum surface
263 Abrading inner drum surface
264 Abrasive sheet
265 Abrasive hard parts
266 Abrasive/perforated/Protrusive surface structure of drum
300 Balance system
300-C Balance control system
300-*f* Front balance system
300-*r* Rear balance system
301 Balance weights
301-S Balance weight handling and rotation structure
301-W Balance weight system
302 two-weights balance system
302-*w* Balance weights for two-weights balance system
302-S Balance weight bearing system
303 Additional balance weight
303-P Balance weight pieces for three-weights balance system
303-*w* Balance weight for three-weights balance system
304 Weight guide bearing for three-weights balance system
305 Threaded balance weight movement screw
306 Balance weight movement motor
307 Weight guide path
308 Balance weight handling and rotation structure
309 Weight-guide path lock system
310 Gear connected to motor
311 Gear chain/belt
312-*b* Balance sensor
312-*p* Weight position detection sensor
313 Drum bearing chassis
314 Gear chain/belt guide channel
315 Gear chain/belt-weight connection
316 Weight-guide path lock wheel
317 Weight-lock pin housing
318 Weight-lock pin spring
319 Weight-lock pin
320 Weight wheel
321 Balance-fixed parts connection sheet
322 Weight starting position for two-weights balance system
323 Fixed home position sensors
324 Weight position control sensor/Encoder
325 Sliding bed
330 Two rotatable Liquid container balance system
330-1 One rotatable Liquid container balance system
331 Balance liquid container
331-*s* Balance liquid container rotation structure
332 Balance liquid container moving chassis
333 Balance liquid pump
334-L Liquid transfer line between balance containers
334-G Air transfer line between balance containers
335 Balance liquid container movement motor
336 Balance liquid container movement transfer system/gear
336-*b* Balance liquid container movement belt/chain
337 Balance liquid
338 Balance liquid valve
339 Balance liquid tank axis
340 Rotatable balance liquid container
341 Equilibrium weight
342 Equilibrium liquid container
343 Balance liquid fittings
344 Balance control system
400 Motor system
401 Movement transfer system
402 Movement transfer part such as belt
403 Drum peripheral rotation pulley
411 Movable belt for drum peripheral rotation pulley
412 Motor directly connected to roller
413 Motor driving multiple movable parts
414 Gear connected to motor
415 Pulley transferring movement to rollers
416 Idler pulley bearing
417 Idler pulley
418 Gear connecting to rollers and each other
419 Roller pulley
420 Roller pulley belt
500 Water chamber
501 Water chamber surrounding partially perforated cylindrical drum surface
502 Water accumulation chamber
503 Water chamber drain outlet
504 Water storage chamber
505 Half water chamber
506 Water chamber around drum opening gap
507 Water chamber-water storage chamber connection
508 Flow path on water chamber
509 Drum perforations in peripheral zone
510 Peripheral perforated narrow zone
510-*n* Peripheral non-perforated zone
511 Water chamber barrier
511-*o* Water chamber overflow line
511-*d* Water chamber discharge
512 Cylindrical or conical drum sheet having holes in the narrow belt zone
513 Steam/gas flue outlet from water chamber
514 Steam/gas flue fan
515 Steam/gas flue chimney systems
517 Drum discharge chamber
518 Drum discharge chamber water valve opening
519 Drum discharge chamber water discharge valve
520 Pneumatic piston of drum discharge chamber discharge valve
521 Drum discharge chamber water valve door
522 Tank-front panel connection
523 Tank-drum chassis connection
524 Water channel/Poly-Channel
525 Poly-Ribs/protrusions/sheet bar/grate bars
525-*s* Protrusive drum surface forms
525-*m* Movable protrusive parts over drum surface
526 Water channel grate
527 Angularly cut water channel sheet/grate bars
528 Drum opening water collection chamber circulation pump
529 Drum chassis
530 Gasket at the outside of the water chamber
531 Tent on the protrusions
531-*g* Gap under the protrusions/tents
532 Water inlet

532-*a* Drum collection chamber circulation entrance
532-*b* Drum opening gap chamber circulation entrance
533 Hinged drum door
534 Hinged drum door water inlet hole
535 Hinged drum door hinge
536 Hinged drum door lock
537 Hinged drum door rotatable buffer gasket
538 Hinged drum door gasket
539 Hinged drum door rotatable buffer
540 Fixed chassis drum safety door
541 Bearing for rotatable door on fixed door
542 Rotary door carried by a door with a bearing
601 Water discharge recess in household drum sheet around perforated area
602 Household drum bearing system
603 Household drum shaft
604 Household drum
605 Household drum holes/perforations
606 Cylindrical household drum sheet
607 Household lifter ribs
608 Household drum entrance/inlet opening
609 Household drum frontal circular base sheet
610 Household drum rear circular base sheet
611 Household water chamber
612 Household circulation pump
613 Household circulation pipeline
614 Household door bellow
615 Household drum opening water chamber
616 Household outer frame
617 Household drum door
618 Household frame frontal sheet
619 Water discharge chamber
620 Household water discharge chamber peripheral cover sheet
621 Household drum water channel/Poly-Canals
622 Household drum water channel grate
623 Household grate bars/Poly-Ribs
624 Household water collection chamber-storage tank connection
625 Household water collection/storage tank
626 Household drum opening water collection tank-water collection/storage tank connection
627 Household drum entrance opening gap
628 Household drum rotation motor
630 Plastic molded balance part
631 Single metal weight on plastic molded balance part
632 Two metal weights on plastic molded balance part
633 Balance part bearing
634 Balance part bearing wheel
635 Balance part movement motor
636 Balance motor housing on drum sheet
637 Balance motor movement gear
638 Balance part movement gear
700 Movable drum fin
701 Movable fin side sheet hinge
702 Movable fin side sheet
703 Movable fin topsheet
704 Movable fin jack
705 Movable fin motor
706 Movable fin jack gear shaft
707 Movable fin jack gear shaft nut
708 Movable fin jack cross arm
709 Movable fin jack gear nut joint
710 Movable fin topsheet—cross arm connection joint
900 Electric, electronic and control systems
901 Electric system panel on drum
901-*c* Electric system panel cover
902 Slip ring for electrical, electronical cables
903 Hose/pipe embedded in drum shaft
904 Electric dynamo in drum
905 Direct gas heating system
907 Air compressor/pump
908 Electricity transfer slip ring
909 Slip ring copper ring
910 Slip ring spring mechanism
911 Slip ring conductive coal
912 Rotatable fluid connection element
913 Drum heating element
914 Drum heating steam injection system
915 Hose/cable recess in drum shaft
918 Lighting units inside drum
919 Pulverizing nozzle inside drum
920 Non perforated heating area
921 Gas burner
922 Heat transfer leaves/lifter ribs
923 Combustion chamber
924 Combustion chamber flue connection
925 Combustion chamber flue fan
926 Electrical heating coils
927 Steam heater jacket
928 Heat isolation around heaters
929 Combustion flue barrier on drum surface
930 Combustion flue barrier on combustion chamber
931 Gas burner control unit

What is claimed is:

1. A washing machine for performing wet, dry, physical or chemical treatments on materials, comprising:

a front loading or side loading perforated drum mounted respectively by a drum shaft at a rear of the drum, or by drum shafts at both sides horizontally, or having an angle with a horizontal axis, the drum mounted to a drum shaft bearing system so as to rotate around a bearing axis, the drum having a water-free zone, the water-free zone being on an outer surface of the drum and not accessible or contacted by water draining from the drum during wet treatment application processes carried out by the washing machine;

a water chamber surrounding a wet area on the drum from which the water is discharged, the water chamber arranged to prevent the water-free zone from coming into contact with discharged water from the drum, to collect said discharged water, to prevent overflow of said water chamber, and to channel said discharged water to a water chamber drain outlet on said water chamber;

wherein said drum comprises comprising a plurality of drum perforations in a cylindrical surface of the drum and wherein the water exiting through the drum perforations is discharged into the water chamber surrounding the cylindrical surface part of the drum having the drum perforations, said water chamber comprising a water flow path configured to prevent the discharged water from contacting the drum again after contact with the drum is interrupted and/or to prevent the discharged water from contacting areas or surfaces of the drum which should not contact the discharged water and/or prevent the discharged water from leaving and/or overflowing from the water chamber, the water flow path configured to enable the discharged water to reach the water chamber drain outlet and leave the water chamber, wherein a water flow capacity of said water flow path and drain out flow rate of said water chamber drain outlet is greater than a drain flow rate of the discharged water from drum such that accumulation of the discharged water in the water chamber is prevented; and a pump or pumping system having a pumping capacity greater than a flowrate of the discharged water flowing from the drum to the water chamber, the pump or pumping system configured to pump the discharged water flowing in the flow path and draining out from drain outlet of the water chamber back into the drum, wherein said pump or pumping system is configured to pump the discharged water from the water chamber into the drum to provide an amount of water in the drum required during a wet treatment application process and to prevent the accumulation of the discharged water in the water chamber from reaching the outer surface of the drum or overflowing from the water chamber, said pump or pumping system being positioned on a circulation line hydraulically connecting the water chamber to the drum, said drum comprising a plurality of drum perforations, wherein a number and/or size of the drum perforations is limited to enable a flow rate of the water passing through the drum perforations to be less than a pumping capacity of the pump or pumping system such that the pumping capacity of said pump or pump system is greater than a maximum water drain flow rate of the discharged water from the drum so that the discharged water draining from the drum to the water chamber does not overflow from the water chamber, reach the outer surface of the drum, or pass to the water-free zones, said drum comprising an external water barrier system on said drum having a plurality of external water barriers to prevent water passage from the wet area to said water-free zone of said drum, said external water barrier system configured to always keep apart of the outer surface of the drum dry by prevention of the discharged water from contact with the part of the outer surface of the drum, said water chamber comprising a water barrier system having a plurality of water barriers to prevent discharged water draining from the drum overflowing from the water chamber, said external water barriers on said drum being aligned with said water chamber barriers on said water chamber to surround the perforated part of the cylindrical surface of the drum to prevent overflow of discharged water from said water chamber, and said water barriers on said water chamber and external water barriers on the drum being positioned in the form of single lines or multiple cascading structure in opposite each other and side by side.

2. A washing machine as described in claim 1, characterized in that;

said drum comprises free water flow channels in order to enable the water to be drained from said drum to flow from the non-perforated areas of the drum to the perforated areas inside the cylindrical drum surface without being restrained or blocked by the material being treated in the drum or in order to increase the flow rate thereof, said drum perforations/holes are positioned partially or completely in the said water channels, said water channels are configured to form water passage gaps to prevent the material being treated in the drum from entering the water channels and limiting or decreasing the water flow rate or from filling in the water flow ways and blocking or interrupting the water flow from the non-perforated areas of the drum to the perforated areas and/or covering the perforations in a manner to completely block the water passage so that the water to be drained from the drum passes through the perforations without being blocked by the material being treated in the drum, the perforated drum sheet having a protrusive structure to create a plurality of said water channels, comprises movable protrusion parts or stationary parts in the form of protrusions or sheet bars or grate bars and/or protrusive drum surface forms around or on the drum perforations having shapes, heights and densities suitable for partially or fully preventing the material undergoing treatment from partially or completely reaching and covering the cylindrical perforated drum sheet and drum perforations/holes, said protrusive parts are placed on cylindrical perforated drum surface to be parallel or inclined with respect to the rotation axis of the drum along the depth of the drum, and said water channels are positioned in the gap under or beside of the fixed or moving protrusions which are placed so as to form protrusions over the cylindrical drum sheet such that the material being treated in the drum is prevented from entering the water channels and interrupting or blocking water flow in the drum and/or drum perforations.

3. A washing machine as described in claim 1, characterized in that;

the drum comprises a drum discharge chamber configured to completely enclose the perforations in peripheral zone on the cylindrical sheet so as to surround the perforations in peripheral zone, said water discharge chamber comprises at least one water discharge valve configured to enable the water entering said drum discharge chamber via the drum perforations to be discharged to the water chamber), and said water discharge valve is configured so that when said water discharge valve is closed such that the drum discharge chamber blocks the water passage, water discharge from the drum via the drum perforations is completely prevented.

4. A washing machine as described in claim 1, characterized in that;

said drum comprises moving parts inside the drum which are placed into the drum and which move by being driven by a movement motor system outside the drum so as to create a mechanical effect on the material being treated in the drum or increase the mechanical effect generated by the movement of the drum, and said movement motor system comprises at least one motor and said motor to move parts on the drum configured to provide the movement of said moving parts inside the drum, which are directly connected to the drum, and which are operated with electrical or pneumatic air energy.

5. A washing machine as described in claim 4, characterized in that;

said moving parts inside the drum are cylindrical or eccentric rollers which rotate around their own axes inside the drum, said rollers are placed between the two bearings on the surface of drum opening side and drum shaft side of the drum so as to be parallel or inclined with respect to the axis of rotation of the drum, said rollers are controllably rotated by means of motor systems, and said rollers are configured to make rotational/oscillating movements to left and right in a controlled and/or programmable manner in the defined direction and at the defined speed or within predetermined angular limits by means of the motor directly connected to roller or the movement transfer systems connected to a motor driving multiple movable parts.

6. A washing machine as described in claim 5, characterized in that;

said rollers are brush rollers which are composed of wires with the form, hardness, and thickness suitable for the treatment produced from bristle, steel, or plastic so as to brush, abrade, nap, polish, rub, or shake the material being treated in the drum or said rollers have protruding or helical surfaces so as to agitate or rub or move or beat or shake or displace the material being washed and/or dyed in the drum.

7. A washing machine as described in claim 5, characterized in that;

said rollers are abrasive rollers which comprise grindstones thereon, said abrasive rollers have abrasive surfaces so as to impart the desired abrasion onto the surface of the material being stone or stone washed in the drum, said grindstone is one piece or a plurality of pieces placed side by side on an angled or circular grindstone carrier used as a carrier, said grindstone carrier comprises at the two ends thereof shafts which are suitable for rotating in the roller bearings provided on the front and rear circular sheets of the drum, and said grindstone pieces have a cylindrical grindstone, spherical/buckled grindstone, conical or ribbed structure.

8. A washing machine as described in claim 4, characterized in that;

said moving parts in the drum comprises vibrating parts with protrusive surfaces placed onto the inner drum surface configured to connect with the vibrators mounted on the outer drum surface so as to create cleaning, abrasion, rubbing, scrubbing, brushing or stone washing effect on the material being treated in the drum or increase the existing physical effects.

9. A washing machine as described in claim 1, characterized in that;

said drum of said machine comprises a mechanical balance system configured to compensate for the oscillations and vibrations generated by the imbalance occurring at drum rotation speeds during the spin extraction process, said mechanical balance system comprises a balance control system configured to monitor and control the imbalance generated in the drum during the extraction process and determine the position and magnitude of the counterforce to compensate the imbalance and comprises balance weight system which is mounted onto drum shaft side and/or drum opening side of the drum and to generate a counterforce to balance the force created by the imbalance, said balance weight system comprises at least one balance weight handling and rotation structure which is driven and rotated by means of a balance weight movement motor on the drum such that the axis of rotation thereof is the axis of rotation of the drum and said balance weight handling and rotation structure comprises at least one balance weight, said balance weight contains at least one metal balance weight piece or at least one balance weight container which can be filled with liquid, and said mechanical balance system mounted outside the drum comprises at least one balance weight movement motor to move said balance weight system and is configured to provide the movement of said balance weight outside the drum which are directly connected to the drum, and which are operated with electrical, pneumatic, or hydraulic energy and monitoring system with electric, electronic control systems.

10. A washing machine as described in claim 9, characterized in that;

said balance weight handling and rotation structure comprises two balance weights and a circular channel or rail weight guide path configured to match said balance weight handling and rotation structure in the balance weight pieces or any sliding component and to support the balance weights, said balance weight handling and rotation structure comprises a balance weight bearing system and a balance weight movement motor which is configured to enable the balance weight pieces to rotate in the balance weight bearing system 360 degrees around the axis of rotation, the balance control system is configured to rotate said balance weights to a position and to maintain said position in order to continuously ensure balance by being driven by a balance weight motor in a peripheral balance weight bearing system of which the center on the drum is the axis of rotation of the drum, said balance weight pieces provided in the balance weight handling and rotation structure at the same side of the drum have a mass suitable for generating the centrifugal forces which will balance each other when said balance weight pieces are oppositely positioned even if the latter are at different distances from the axis of rotation of the drum, said balance control system is configured to move said two balance weights in the same balance weight handling and rotation structure close to each other so as to create a force vector which is 180 degrees opposite to the imbalance force vector ($F_x$) determined by the balance control system and which is equal to the imbalance force vector ($F_x$), and said movement transfer systems are configured to move a guide apparatus in the form of circular channel or rail weight guide path located at the same center as the axis of rotation of the drum and the balance weight bearing system and to move the balance weights a full turn around the weight bearing center continuously.

11. A washing machine as described in claim 9, characterized in that;

said mechanical balance system comprises a plastic molded balance part, said plastic molded balance part comprises a balance weight area in the form of heavier zone than the other parts of the plastic molded balance part that act as the balance weight, a sliding system, and a balance motor, said sliding system comprises a balance part bearing connected with the drum providing the rotation of the plastic molded balance part around the drum and a balance part movement gear providing the rotation thereof around said balance part bearing, said balance system comprises a balance motor movement gear connected to a balance part movement motor is configured to rotate in the balance part movement gear on the plastic molded balance part so as to enable said plastic molded balance part to rotate around the balance part bearing continuously and to stop at the required position, and said plastic molded balance part comprises a single metal weight on plastic molded balance part embedded into the weight area.

12. A washing machine as described in claim 9, characterized in that;

said mechanical balance system comprises a three-weights balance system having at least three movable balance weight pieces that are positioned on the drum shaft side circular base and/or drum opening side circular base, said balance weight piece is configured to be driven by a balance weight movement motor in order to get close to or move away from the rotation center of the drum in vertical position of the rotation axis, and said balance weight pieces for three-weights balance system are configured to be moved so as to move away from the center to create a counterbalance vector against the imbalance force vector ($F_x$) if the material is distributed so as to create an imbalance at the drum rear circular base/shaft side and/or drum front circular base/opening side, and to be moved away from the center so as to create a counterforce which will balance the unbalanced load weight force ($F_x$).

13. A washing machine as described in claim 1, characterized in that;

said motor system mounted outside the drum comprises at least one of motor to move parts on the drum and electric, pneumatic, hydraulic, electronic and control systems required for and/or connected to said systems for the operation thereof with the systems and dynamo, pump, compressor, ventilator, valve, piston, gear, pulley, belt, chain, or similar movement transfer parts in order to generate or transmit movement, and the electric, electronic and control systems configured to provide and control the operation of the devices on the drum are positioned on the drum, wherein the data exchange between the electric, electronic and control systems on the drum and other control systems of the machine is configured to be carried out via an electricity transfer slip ring positioned on the shaft and/or by means of wireless communication methods.

14. A washing machine as described in claim 1, characterized in that;

said washing machine comprises a combustion chamber which is mounted on the fixed chassis so as to circumferentially enclose the unperforated dry area of the cylindrical drum sheet of the rotatable drum, said combustion chamber comprises a heat source configured to heat the processed material with the liquid in the drum in the desired time or which maintains the current heat level by suppling required amount of heat generated by combustion in the combustion chamber directly onto the drum sheet.

15. A washing machine as described in claim 14, characterized in that;

said combustion chamber comprises a gas burner group which provides the burning of a liquid or gas fuel wherein the heat generated by the flame formed as a result of the burning in said gas burner and/or carried by the hot air-gas mixture circulates around the drum in contact with the cylindrical drum sheet to heat the drum sheet in order to heat the washing water and the material being washed in the drum, said combustion chamber comprises a steam/gas flue chimney at the peak point of the combustion chamber, which provides the discharge of the exhaust gas generated in the burner and said steam/gas flue chimney comprises a combustion chamber flue fan system which has a suction capacity to prevent the gas exit from the areas of the combustion chamber other than said steam/gas flue chimney, and the area of the non-perforated heating area enclosed by said combustion chamber comprises heat transfer foils/blades produced from metals with high heat transfer coefficient which are placed onto the drum sheet so as to increase the heat transfer area of the non-perforated heating area.

* * * * *